US012296239B2

(12) United States Patent
Morales et al.

(10) Patent No.: US 12,296,239 B2
(45) **Date of Patent: *May 13, 2025**

(54) MIXED MATERIAL GOLF CLUB HEAD

(71) Applicant: KARSTEN MANUFACTURING CORPORATION, Phoenix, AZ (US)

(72) Inventors: Eric J. Morales, Laveen, AZ (US); Ryan M. Stokke, Anthem, AZ (US); Martin R. Jertson, Phoenix, AZ (US); Clayson C. Spackman, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 39 days.

This patent is subject to a terminal disclaimer.

(21) Appl. No.: 18/069,737

(22) Filed: Dec. 21, 2022

(65) Prior Publication Data

US 2023/0124199 A1 Apr. 20, 2023

Related U.S. Application Data

(63) Continuation of application No. 17/094,722, filed on Nov. 10, 2020, now Pat. No. 11,534,666, which is a (Continued)

(51) Int. Cl.
*A63B 53/04* (2015.01)
*A63B 60/00* (2015.01)
*A63B 60/02* (2015.01)

(52) U.S. Cl.
CPC ..... *A63B 53/0475* (2013.01); *A63B 53/0466* (2013.01); *A63B 60/02* (2015.10); (Continued)

(58) Field of Classification Search
CPC . A63B 53/0475; A63B 60/02; A63B 53/0466; A63B 2209/00; A63B 53/04; (Continued)

(56) References Cited

U.S. PATENT DOCUMENTS 4,581,190 A 4/1986 Nagamoto
4,664,383 A 5/1987 Aizawa
(Continued)

FOREIGN PATENT DOCUMENTS

JP 2004024734 1/2004
JP 2006271770 10/2006
(Continued)

OTHER PUBLICATIONS

Partial translation and original of JP-2007044445-A, with inventor named Shibuki et al, and titled "Golf club has a deformation portion provided at face of head . . . ", published Feb. 22, 2007. (Year: 2007).*

(Continued)

*Primary Examiner* — Sebastiano Passaniti

(57) ABSTRACT

A golf club head includes a rear body having a crown member coupled to a sole member, and a front body coupled to the rear body to define a substantially hollow structure. The front body includes a strike face and a surrounding frame that extends rearward from a perimeter of the strike face. At least a portion of an outer wall of the club head comprises a thermoplastic composite having a plurality of lamina layers. The plurality of lamina layers include at least a fabric reinforced thermoplastic composite layer and a filled thermoplastic layer, and the fabric reinforced thermoplastic composite layer and the filled thermoplastic layer are directly bonded to each other without an intermediate adhesive.

18 Claims, 26 Drawing Sheets

Related U.S. Application Data continuation of application No. 16/252,349, filed on Jan. 18, 2019, now Pat. No. 10,828,543, which is a continuation-in-part of application No. 15/901,081, filed on Feb. 21, 2018, now Pat. No. 10,300,354, which is a continuation of application No. 15/607,166, filed on May 26, 2017, now Pat. No. 9,925,432.

(60) Provisional application No. 62/781,509, filed on Dec. 18, 2018, provisional application No. 62/781,513, filed on Dec. 18, 2018, provisional application No. 62/770,000, filed on Nov. 20, 2018, provisional application No. 62/718,857, filed on Aug. 14, 2018, provisional application No. 62/702,996, filed on Jul. 25, 2018, provisional application No. 62/703,305, filed on Jul. 25, 2018, provisional application No. 62/644,319, filed on Mar. 16, 2018, provisional application No. 62/619,631, filed on Jan. 19, 2018, provisional application No. 62/342,741, filed on May 27, 2016.

(52) U.S. Cl.
CPC ..... *A63B 53/04* (2013.01); *A63B 53/0416* (2020.08); *A63B 53/042* (2020.08); *A63B 53/0433* (2020.08); *A63B 53/0437* (2020.08); *A63B 53/047* (2013.01); *A63B 2053/0491* (2013.01); *A63B 60/002* (2020.08); *A63B 2209/00* (2013.01); *A63B 2209/02* (2013.01); *A63B 2209/023* (2013.01)

(58) Field of Classification Search
CPC ..... A63B 2209/02; A63B 53/047; A63B 2053/0491; A63B 2209/023; A63B 53/042; A63B 53/0416; A63B 53/0433; A63B 53/0437; A63B 60/002
USPC ..... 473/324–350, 287–292
See application file for complete search history.

(56) References Cited

U.S. PATENT DOCUMENTS 5,080,366 A 1/1992 Okumoto
5,193,811 A 3/1993 Okumoto
5,328,176 A 7/1994 Lo
5,586,949 A 12/1996 Aizawa
5,614,143 A 3/1997 Hager
5,624,331 A 4/1997 Lo
5,669,827 A 9/1997 Nagamoto
6,348,013 B1 * 2/2002 Kosmatka ..... A63B 60/00 473/345
6,354,963 B1 3/2002 Kodama
6,364,789 B1 * 4/2002 Kosmatka ..... A63B 53/0466 473/345
6,471,604 B2 10/2002 Hocknell
6,491,592 B2 12/2002 Cackett
6,565,452 B2 5/2003 Helmstetter
6,582,323 B2 6/2003 Soracco
6,602,149 B1 8/2003 Jacobson
6,648,774 B1 11/2003 Lee
6,663,504 B2 12/2003 Hocknell
6,739,982 B2 5/2004 Murphy
6,739,983 B2 5/2004 Helmstetter
6,758,763 B2 7/2004 Murphy
6,860,823 B2 3/2005 Lee
6,926,619 B2 8/2005 Helmstetter
6,929,565 B2 8/2005 Nakahara
6,994,637 B2 2/2006 Murphy
7,025,692 B2 4/2006 Erickson
7,066,835 B2 6/2006 Evans
7,108,614 B2 9/2006 Lo
7,118,493 B2 10/2006 Galloway
7,121,955 B2 10/2006 Stevens
7,121,957 B2 10/2006 Hocknell
7,128,661 B2 10/2006 Soracco
7,137,907 B2 11/2006 Gibbs
7,144,333 B2 12/2006 Murphy
7,147,576 B2 12/2006 Imamoto
7,163,470 B2 1/2007 Galloway
7,169,060 B2 1/2007 Stevens
7,175,541 B2 2/2007 Lo
7,252,600 B2 8/2007 Murphy
7,255,654 B2 8/2007 Murphy
7,258,624 B2 8/2007 Kobayashi
7,258,625 B2 8/2007 Kawaguchi
7,261,645 B2 8/2007 Oyama
7,278,927 B2 10/2007 Gibbs
7,303,487 B2 12/2007 Kumamoto
7,311,613 B2 12/2007 Stevens
7,318,782 B2 1/2008 Imamoto
7,320,646 B2 1/2008 Galloway
7,338,390 B2 3/2008 Lindsay
7,344,452 B2 3/2008 Imamoto
7,367,900 B2 5/2008 Kumamoto
7,387,577 B2 6/2008 Murphy
7,402,112 B2 7/2008 Galloway
7,407,448 B2 8/2008 Stevens
7,438,647 B1 10/2008 Hocknell
7,438,649 B2 10/2008 Ezaki
7,448,964 B2 11/2008 Schweigert
7,455,600 B2 11/2008 Imamoto
7,468,005 B2 12/2008 Kouno
7,488,261 B2 2/2009 Cackett
7,491,134 B2 2/2009 Murphy
7,494,424 B2 2/2009 Williams
7,497,788 B2 3/2009 Imamoto
7,520,822 B2 4/2009 Yamagishi
7,530,901 B2 5/2009 Imamoto
7,530,903 B2 5/2009 Imamoto
7,540,812 B2 6/2009 Imamoto
7,568,982 B2 8/2009 Cackett
7,582,248 B2 9/2009 Reyes
7,591,737 B2 9/2009 Gibbs
7,601,078 B2 10/2009 Mergy
7,607,992 B2 10/2009 Nishio
7,632,193 B2 12/2009 Thielen
7,658,686 B2 2/2010 Soracco
7,674,187 B2 3/2010 Cackett
7,691,008 B2 4/2010 Oyama
7,708,652 B2 5/2010 Cackett
7,749,096 B2 7/2010 Gibbs
7,749,103 B2 7/2010 Nakano
7,775,903 B2 8/2010 Kawaguchi
7,785,212 B2 8/2010 Lukasiewicz, Jr.
7,959,523 B2 6/2011 Rae
7,993,216 B2 8/2011 Lee
8,025,591 B2 9/2011 De La Cruz
8,197,358 B1 6/2012 Watson
8,308,582 B2 11/2012 Tanimoto
8,376,876 B2 2/2013 Gibbs
8,419,569 B2 4/2013 Bennett
8,425,827 B2 4/2013 Lee
8,435,137 B2 5/2013 Hirano
8,460,123 B1 6/2013 Demille
8,491,416 B1 7/2013 Demille
8,506,421 B2 8/2013 Stites
8,556,746 B1 10/2013 Demille
8,608,591 B2 12/2013 Chao
8,632,419 B2 1/2014 Tang
8,632,420 B2 1/2014 Kawaguchi
8,696,489 B2 4/2014 Gibbs
8,702,534 B2 4/2014 Demille
8,715,109 B2 5/2014 Bennett
8,727,911 B2 5/2014 Demille
8,790,196 B2 7/2014 Solheim
8,814,723 B2 8/2014 Tavares
8,870,680 B2 10/2014 Yamamoto
8,870,683 B2 10/2014 Hettinger
8,926,450 B2 1/2015 Takahashi
8,979,671 B1 3/2015 Demille
9,033,822 B1 5/2015 Demille

(56) References Cited

U.S. PATENT DOCUMENTS

| | | | | |
|---|---|---|---|---|
| 9,056,230 | B2 | 6/2015 | Golden | |
| 9,079,368 | B2 | 7/2015 | Tavares | |
| 9,168,435 | B1 | 10/2015 | Boggs | |
| 9,174,098 | B2 | 11/2015 | Hayase | |
| 9,283,448 | B2 * | 3/2016 | Sander | A63B 53/0466 |
| 9,352,198 | B2 | 5/2016 | Roach | |
| 9,393,465 | B2 | 7/2016 | Stokke | |
| 9,399,157 | B2 | 7/2016 | Greensmith | |
| 9,427,631 | B1 | 8/2016 | Larson | |
| 9,457,245 | B2 | 10/2016 | Lee | |
| 9,504,883 | B2 | 11/2016 | Demille | |
| 9,526,955 | B2 | 12/2016 | Demille | |
| 9,579,548 | B2 | 2/2017 | Boyd | |
| 9,682,299 | B2 | 6/2017 | Tang | |
| 9,724,573 | B2 | 8/2017 | Kawaguchi | |
| 9,908,014 | B1 | 3/2018 | Wester | |
| 9,925,432 | B2 | 3/2018 | Morales | |
| 10,300,354 | B2 | 5/2019 | Morales | |
| 10,675,514 | B2 * | 6/2020 | Spackman | A63B 53/04 |
| 10,765,922 | B2 * | 9/2020 | Morales | A63B 60/02 |
| 10,806,977 | B2 | 10/2020 | Spackman | |
| 10,828,543 | B2 | 11/2020 | Morales | |
| 10,940,373 | B2 | 3/2021 | Milleman | |
| 10,940,374 | B2 | 3/2021 | Milleman | |
| 11,110,325 | B2 * | 9/2021 | Spackman | A63B 53/0462 |
| 11,235,210 | B2 * | 2/2022 | Spackman | A63B 53/0466 |
| 11,278,775 | B2 | 3/2022 | Morales | |
| 11,534,666 | B2 * | 12/2022 | Morales | A63B 53/0466 |
| 11,638,859 | B2 * | 5/2023 | Milleman | A63B 60/02 473/348 |
| 11,660,511 | B2 * | 5/2023 | Milleman | A63B 60/02 473/348 |
| 11,819,743 | B2 * | 11/2023 | Morales | A63B 60/02 |
| 11,896,879 | B2 * | 2/2024 | Spackman | A63B 53/0466 |
| 11,969,632 | B2 * | 4/2024 | Milleman | A63B 53/0408 |
| 2003/0134692 | A1 | 7/2003 | Nakahara | |
| 2003/0186760 | A1 | 10/2003 | Lee | |
| 2004/0033844 | A1 | 2/2004 | Chen | |
| 2004/0116207 | A1 | 6/2004 | De Shiell | |
| 2004/0142761 | A1 | 7/2004 | Evans | |
| 2005/0026719 | A1 | 2/2005 | Yang | |
| 2005/0043115 | A1 | 2/2005 | Lin | |
| 2005/0119068 | A1 | 6/2005 | Onoda | |
| 2005/0143189 | A1 | 6/2005 | Lai | |
| 2005/0159239 | A1 | 7/2005 | Imamoto | |
| 2005/0215351 | A1 | 9/2005 | Hasegawa | |
| 2005/0215354 | A1 | 9/2005 | Kumamoto | |
| 2005/0233831 | A1 | 10/2005 | Ezaki | |
| 2005/0261082 | A1 | 11/2005 | Yamamoto | |
| 2006/0052177 | A1 | 3/2006 | Nakahara | |
| 2006/0052181 | A1 | 3/2006 | Serrano | |
| 2006/0084525 | A1 | 4/2006 | Imamoto | |
| 2006/0148588 | A1 | 7/2006 | Gibbs | |
| 2006/0229141 | A1 | 10/2006 | Galloway | |
| 2007/0060414 | A1 | 3/2007 | Breier | |
| 2007/0155533 | A1 | 7/2007 | Solheim | |
| 2008/0293512 | A1 | 11/2008 | Chen | |
| 2009/0203465 | A1 | 8/2009 | Stites | |
| 2010/0137074 | A1 | 6/2010 | Gilbert | |
| 2010/0234134 | A1 | 9/2010 | Wahlin | |
| 2011/0028239 | A1 | 2/2011 | Galloway | |
| 2011/0086723 | A1 | 4/2011 | Gilbert | |
| 2012/0142447 | A1 * | 6/2012 | Boyd | A63B 60/54 473/332 |
| 2013/0165258 | A1 | 6/2013 | Soracco | |
| 2014/0128176 | A1 | 5/2014 | Chao | |
| 2014/0162809 | A1 | 6/2014 | Soracco | |
| 2015/0045130 | A1 | 2/2015 | Roach | |
| 2015/0108681 | A1 | 4/2015 | Deshmukh | |
| 2015/0231458 | A1 | 8/2015 | Petersen | |
| 2016/0001146 | A1 | 1/2016 | Sargent | |
| 2016/0016052 | A1 | 1/2016 | Dolezel | |
| 2016/0051868 | A1 | 2/2016 | Deshmukh | |
| 2016/0332040 | A1 | 11/2016 | Lafortune | |
| 2016/0346630 | A1 | 12/2016 | Sander | |
| 2016/0346640 | A1 | 12/2016 | Boggs | |
| 2017/0100646 | A1 | 4/2017 | Demille | |
| 2017/0128792 | A1 | 5/2017 | Hope | |
| 2017/0312592 | A1 | 11/2017 | Parsons | |
| 2017/0340932 | A1 | 11/2017 | Morales | |

FOREIGN PATENT DOCUMENTS

| | | |
|---|---|---|
| JP | 2013009713 | 1/2013 |
| WO | 2007076304 | 7/2007 |
| WO | 2017205699 | 11/2017 |

OTHER PUBLICATIONS

Machine language translation of Japanese Patent Application Laid-Open No. JP-2007044445-A, pp. 1-11. (Year: 2007).*

Adams Mens Golf Speedline Super XTD Fairway Wood; Amazon, accessed Oct. 19, 2017; https://www.amazon.com/Adams-Golf-Speedline-SUPER-Fairway/dp/B007LI2S04.

Callaway Womens Great Big Bertha Driver, Amazon, accessed Oct. 19, 2017; https://www.amazon.com/Callaway-Womens-Great-Bertha-Driver/dp/B013SYR0VQ.

E9 Face Technology With Dual Roll—Multi-material Construction, Cobra Golf, accessed Oct. 19, 2017; https://www.cobragolf.com/pumagolf/tech-overview.

International Search Report and Written Opinion of the International Searching Authority from PCT Application No. PCT/US17/34807, dated May 27, 2016.

International Search Report and Written Opinion of the International Searching Authority from PCT Application No. PCT/US19/14321, dated May 9, 2019.

International Search Report and Written Opinion of the International Searching Authority from PCT Application No. PCT/US19/14326, dated May 23, 2019.

Nike Vapor Flex 440 Driver Adjustable Loft Golf Club Left Hand, accessed Jun. 7, 2016; http://www.globalgolf.com/golf-clubs/1034365-nike-vapor-flex-440-driver-left-hand/.

Taylormade M1 Driver, Multi-material Construction, accessed Jun. 7, 2016; http://www.intheholegolf.com/TM15-M1D/TaylorMade-M1-Driver.html.

* cited by examiner

MIXED MATERIAL GOLF CLUB HEAD

CROSS REFERENCE TO RELATED APPLICATIONS

This is a continuation of U.S. patent application Ser. No. 17/094,722, filed 10 Nov. 2020, which is a continuation of U.S. patent application Ser. No. 16/252,349, filed 18 Jan. 2019 and issued as U.S. Pat. No. 10,828,543 on Nov. 10, 2020, which is a continuation-in-part of U.S. patent application Ser. No. 15/901,081, filed 21 Feb. 2018 and issued as U.S. Pat. No. 10,300,354, which is a continuation of U.S. patent application Ser. No. 15/607,166, filed 26 May 2017 and issued as U.S. Pat. No. 9,925,432, which claims the benefit of priority from U.S. Provisional Patent No. 62/342,741, filed 27 May 2016. U.S. patent application Ser. No. 16/252,349 also claims the benefit of priority from U.S. Provisional Patent Nos.: 62/619,631 filed 19 Jan. 2018; 62/644,319 filed 16 Mar. 2018; 62/702,996 filed 25 Jul. 2018; 62/703,305 filed 25 Jul. 2018; 62/718,857 filed 14 Aug. 2018; 62/770,000 filed 20 Nov. 2018; 62/781,509 filed 18 Dec. 2018; and 62/781,513 filed 18 Dec. 2018. The above-referenced applications are incorporated by reference in their entirety.

TECHNICAL FIELD

The present disclosure relates generally to a golf club head with a mixed material construction.

BACKGROUND

In an ideal club design, for a constant total swing weight, the amount of structural mass would be minimized (without sacrificing resiliency) to provide a designer with additional discretionary mass to specifically place in an effort to customize club performance. In general, the total of all club head mass is the sum of the total amount of structural mass and the total amount of discretionary mass. Structural mass generally refers to the mass of the materials that are required to provide the club head with the structural resilience needed to withstand repeated impacts. Structural mass is highly design-dependent, and provides a designer with a relatively low amount of control over specific mass distribution. Conversely, discretionary mass is any additional mass (beyond the minimum structural requirements) that may be added to the club head design for the sole purpose of customizing the performance and/or forgiveness of the club. There is a need in the art for alternative designs to all metal golf club heads to provide a means for maximizing discretionary weight to maximize club head moment of inertia (MOI) and lower/back center of gravity (COG).

While this provided background description attempts to clearly explain certain club-related terminology, it is meant to be illustrative and not limiting. Custom within the industry, rules set by golf organizations such as the United States Golf Association (USGA) or The R&A, and naming convention may augment this description of terminology without departing from the scope of the present application.

DETAILED DESCRIPTION

Figure 1:
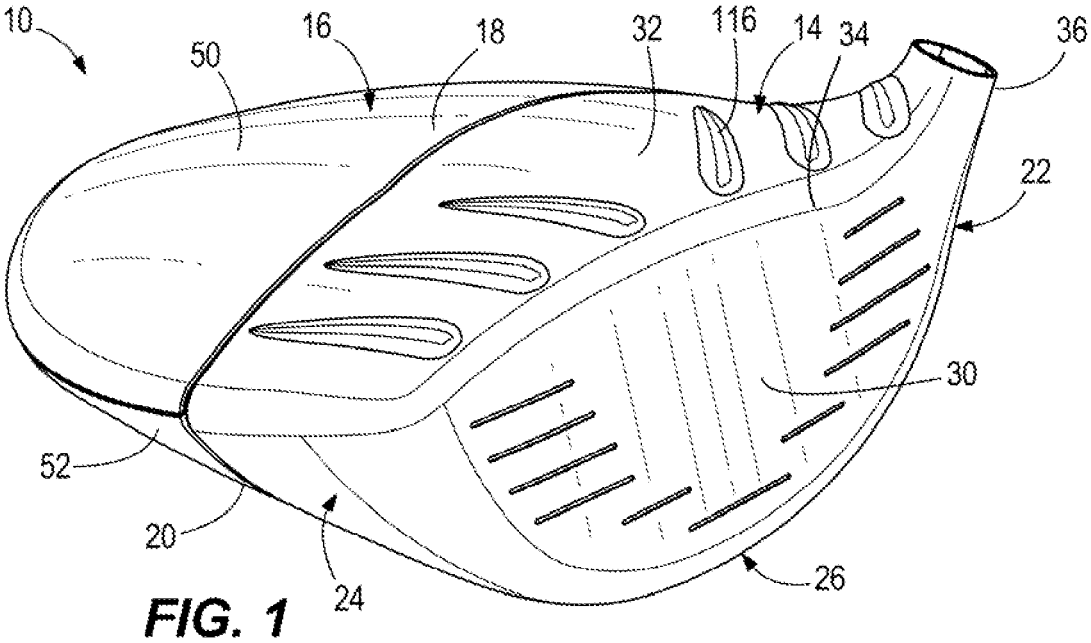
FIG. 1 is a schematic perspective view of a mixed-material golf club head.

In the embodiments described below, at least a portion of the club head may be formed from a thermoplastic composite, such as, for example, a fabric reinforced thermoplastic composite or a fiber-filled thermoplastic composite. In some embodiments, one or more layers of a fabric-reinforced thermoplastic composite may be joined with one or more layers of a molded, fiber-filled thermoplastic composite. For the purpose of easily differentiating within this disclosure, a "fabric reinforced composite" is intended to refer to a composite material having a reinforcing fabric embedded within a thermoplastic matrix. The fabric may be formed from a plurality of uni- or multi-directional constituent fibers that are aligned, layered, or woven into a fabric-like pattern. Conversely, a "fiber-filled thermoplastic composite" (or "filled thermoplastic" (FT) for short) is one where discontinuous chopped fibers are mixed with a liquid/flowable polymer prior to being injected into a mold for final part creation.

During the molding of a filled thermoplastic, a thermoplastic resin is heated to a temperature above the melting point of the polymer, where it is freely flowable. To facilitate the flowable characteristic despite having a dispersed filler material embedded within the resin, the filler materials generally include discrete particulate having a maximum dimension of less than about 25 mm, or more commonly less than about 12 mm. For example, the filler materials can include discrete particulate having a maximum dimension of 4 mm, 5 mm, 6 mm, 7 mm, 8 mm, 9 mm, or 10 mm. Filler materials useful for the present designs may include, for example, glass beads or discontinuous reinforcing fibers formed from carbon, glass, or an aramid polymer.

In contrast to the discrete nature of the fibers/filler in a filled thermoplastic, the fibers in a fabric-reinforced composite (FRC) may be substantially larger/longer, and may have sufficient size and characteristics such that they may be provided as a continuous fabric separate from the polymer. When integrated with the thermoplastic resin, even if the polymer is freely flowable when melted, the included continuous fibers are generally not.

FRC materials are generally formed by arranging the fiber into a desired arrangement, and then impregnating the fiber material with a sufficient amount of a polymeric material to provide rigidity. In this manner, while FT materials may have a resin content of greater than about 45% by volume or more preferably greater than about 55% by volume, FRC materials desirably have a resin content of less than about 45% by volume, or more preferably less than about 35% by volume. FRC materials traditionally use two-part thermoset epoxies as the polymeric matrix, however, the present designs generally use thermoplastic polymers, instead, as the matrix. In many instances, FRC materials are pre-prepared prior to final manufacturing, and such intermediate material is often referred to as a prepreg. When a thermoset polymer is used, the prepreg is partially cured in intermediate form, and final curing occurs once the prepreg is formed into the final shape. When a thermoplastic polymer is used, the prepreg may include a cooled thermoplastic matrix that can subsequently be heated and molded into final shape.

As discussed below, fabric reinforced composites are best suited for portions of the design where strength is desired across a continuous surface, whereas filled thermoplastics may be best suited where more complex and/or variable geometries are desired, or at junctures where walls or features come together at angles. Likewise, each has a different dynamic response during an impact, which may further dictate placement within the design.

In the present designs, one or both of the front body 14 and the rear body 16 may be substantially formed from a thermoplastic composite material that includes at least one of a fabric reinforced composite or a filled thermoplastic. In some embodiments, the strike face 30 and/or front body 14 can comprise a metal (e.g. titanium alloy, steel alloy). In other embodiments, however, the strike face 30 and/or front body 14 can comprise a thermoplastic polymer and/or may be formed entirely from a thermoplastic composite material. Likewise, in some configurations, portions the rear body 16 may be comprised of a fabric-reinforced composite resilient layer and a filled thermoplastic structural layer. Furthermore, one or more portions of the rear body 16 may comprise or may be substantially formed form a metal.

In configurations where both the front and rear bodies 14, 16 include a thermoplastic composite, the front body 14 can comprise a thermoplastic composite that is the same as, or different than a thermoplastic composite of the rear body 16. If compatible/miscible thermoplastic resins are used in both the front body 14 and rear body 16, then in some configurations, the front body 14 may be affixed and/or coupled to at least a portion of the rear body 16 without the need for intermediate adhesives or fasteners. Instead the polymers of the adjoining bodies may be thermally fused/welded together.

Furthermore, in embodiments including directly abutting FRC and FT layers/portions, the use of miscible thermoplastic resins in these respective layers provides a unique ability to co-mold the layers together. This provides a club head design of unique geometries for weight savings via the filled thermoplastic layers, but also manufacturing capability of merging layers of rigid strength via the composite resilient layer.

Finally, in some embodiments, the use of certain thermoplastic resins may provide acoustic advantages that are not possible with other materials. Use of the thermoplastic polymers of the present construction can enable the assembled golf club head to acoustically respond closer to that of an all-metal design.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "loft" or "loft angle" of a golf club, as described herein, refers to the angle formed between the club face and the shaft, as measured by any suitable loft and lie machine.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes with general reference to a golf club held at address on a horizontal ground plane and at predefined loft and lie angles, though are not necessarily intended to describe permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Referring to the drawings, wherein like reference numerals are used to identify like or identical components in the various views, FIG. 1 schematically illustrates a perspective view of a golf club head 10. In particular, the present technology relates to the design of a wood-style head, such as a driver, fairway wood, or hybrid iron.

The golf club head 10 includes a front body portion 14 ("front body 14") and a rear body portion 16 ("rear body 16") that are secured together to define a substantially closed/hollow interior volume. As is conventional with wood-style heads, the golf club head 10 includes a crown 18 and a sole 20, and may be generally divided into a heel portion 22, a toe portion 24, and a central portion 26 that is located between the heel portion 22 and toe portion 24.

The front body 14 generally includes a strike face 30 intended to impact a golf ball, a frame 32 that surrounds and extends rearward from a perimeter 34 of the strike face 30 to provide the front body 14 with a cup-shaped appearance, and a hosel 36 for receiving a golf club shaft or shaft adapter.

Figure 2:
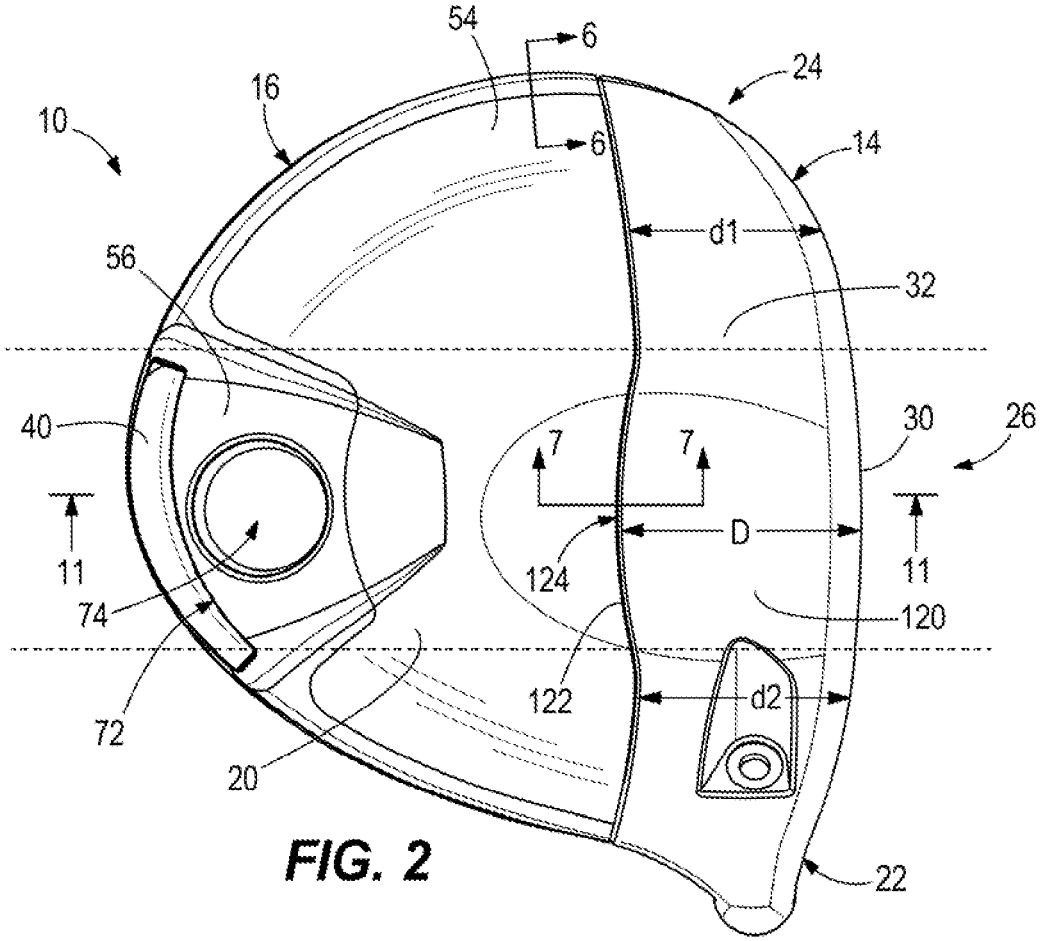
FIG. 2 is a schematic bottom view of a mixed-material golf club head.

To reduce the structural mass of the club head beyond what is possible with traditional metal forming techniques, some or all of the front body 14 and/or the rear body 16 may be substantially formed from one or more thermoplastic composite materials such as fabric reinforced composites and/or filled thermoplastics. The structural weight savings accomplished through these designs may be used to either reduce the entire weight of the club head 10 (which may provide faster club head speeds and/or longer hitting distances) or to increase the amount of discretionary mass that is available for placement on the club head 10 (i.e., for a constant club head weight). In a preferred embodiment, the additional discretionary mass is re-included in the final club head design via one or more metallic weights 40 (such as shown in FIG. 2) that are coupled with the sole 20, frame 32, and/or rear-most portion of the club head 10.

Figure 3:
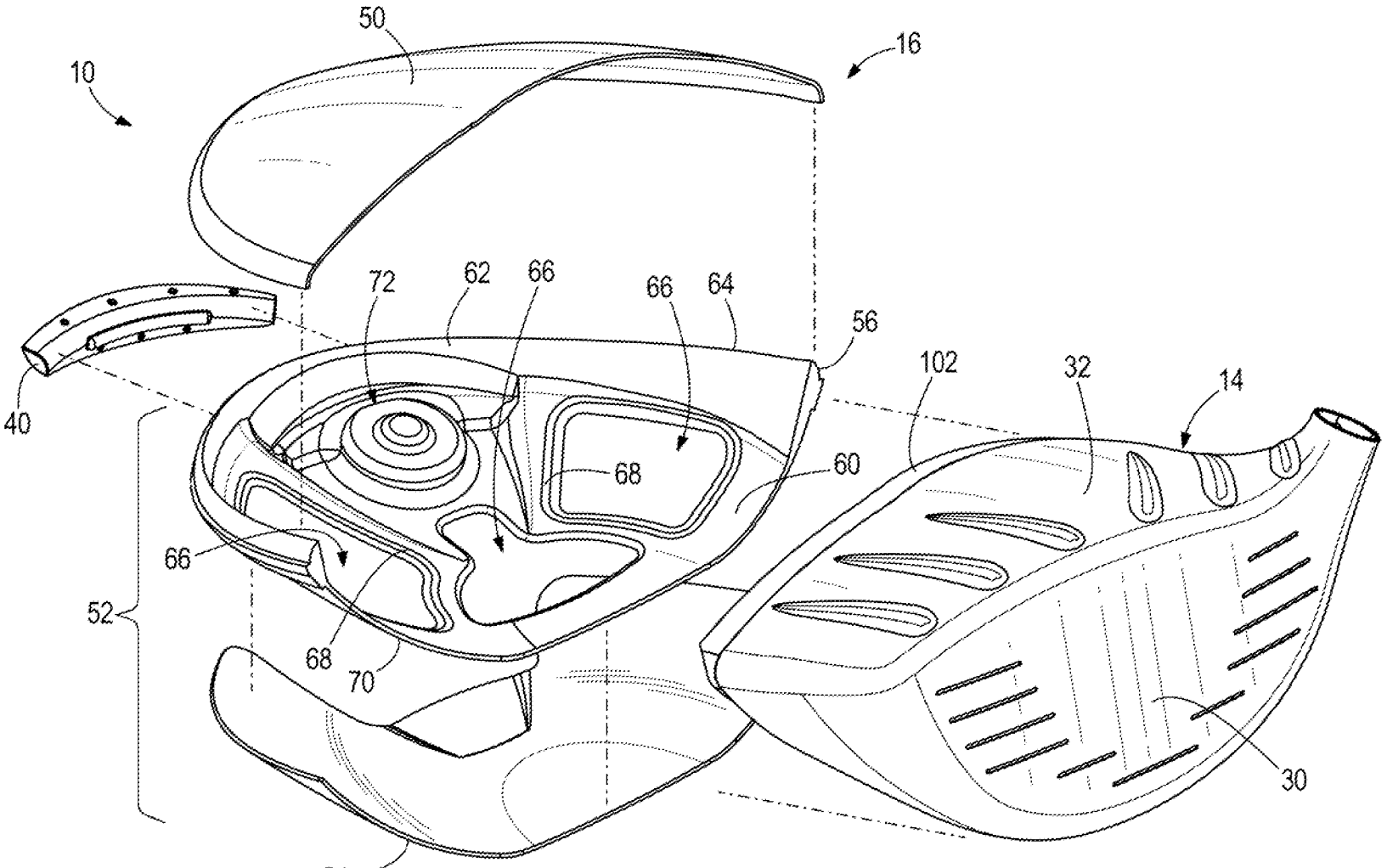
FIG. 3 is a schematic exploded perspective view of an embodiment of a mixed-material golf club head similar to that shown in FIG. 1.

Referring to FIG. 3, in some configurations, the rear body 16 may generally be formed by bonding a crown member 50 to a sole member 52. In a preferred embodiment, the crown member 50 forms a portion of the crown 18, the sole member 52 forms a portion of the sole 20, and they generally meet at an external seam that is at or slightly below where the tangent of the club head surface exists in a vertical plane (i.e., when the club head 10 is held in a neutral hitting position according to predetermined loft and lie angles).

With continued reference to FIG. 3, in an embodiment, the crown member 50 may be substantially formed from a formed fabric reinforced composite material that comprises a woven glass or carbon fiber reinforcing layer embedded in a polymeric matrix. In such an embodiment, the polymeric matrix is preferably a thermoplastic material such as, for example, polyphenylene sulfide (PPS), polyether ether ketone (PEEK), polyetherimide (PEI), or a polyamide such as PA6 or PA66. In other embodiments, the crown member 50 may instead be formed from a filled thermoplastic material that comprises a glass bead or discontinuous glass, carbon, or aramid polymer fiber filler embedded throughout a thermoplastic material such as, for example, polyphenylene sulfide (PPS), polyether ether ketone (PEEK), polyetherimide (PEI), or polyamide. In still other embodiments, such as described below with respect to FIGS. 9-10 and 20-31, the crown member 50 may have a mixed-material construction that includes both a filled thermoplastic material and a formed fiber reinforced composite material.

In the embodiment illustrated in FIG. 3, the sole member 52 has a mixed-material/multi-layer construction that includes both a fabric reinforced thermoplastic composite resilient layer 54 and a molded thermoplastic structural layer 56. In a preferred embodiment, the molded thermoplastic structural layer 56 may be formed from a filled thermoplastic material that comprises a glass bead or discontinuous glass, carbon, or aramid polymer fiber filler embedded throughout a thermoplastic material such as, for example, polyphenylene sulfide (PPS), polyether ether ketone (PEEK), polyetherimide (PEI), or a polyamide such as PA6 or PA66. The resilient layer 54 may then comprise a woven glass, carbon fiber, or aramid polymer fiber reinforcing layer embedded in a thermoplastic polymeric matrix that includes, for example, a polyphenylene sulfide (PPS), a polyether ether ketone (PEEK), polyetherimide (PEI), or a polyamide such as PA6 or PA66. In one particular embodiment, the crown member 50 and resilient layer may each comprise a woven carbon fiber fabric embedded in a polyphenylene sulfide (PPS), and the structural layer may comprise a filled polyphenylene sulfide (PPS) polymer.

With respect to both the polymeric construction of the crown member 50 and the sole member 52, any filled thermoplastics or fabric reinforced thermoplastic composites should preferably incorporate one or more engineering polymers that have sufficiently high material strengths and/or strength/weight ratio properties to withstand typical use while providing a weight savings benefit to the design. Specifically, it is important for the design and materials to efficiently withstand the stresses imparted during an impact between the strike face 30 and a golf ball, while not contributing substantially to the total weight of the golf club head 10. In general, preferred polymers may be characterized by a tensile strength at yield of greater than about 60 MPa (neat), and, when filled, may have a tensile strength at yield of greater than about 110 MPa, or more preferably greater than about 180 MPa, and even more preferably greater than about 220 MPa. In some embodiments, suitable filled thermoplastic polymers may have a tensile strength at yield of from about 60 MPa to about 350 MPa. In some embodiments, these polymers may have a density in the range of from about 1.15 to about 2.02 in either a filled or unfilled state, and may preferably have a melting temperature of greater than about 210° C. or more preferably greater than about 250° C.

PPS and PEEK are two exemplary thermoplastic polymers that meet the strength and weight requirements of the present design. Unlike many other polymers, however, the use of PPS or PEEK is further advantageous due to their unique acoustic properties. Specifically, in many circumstances, PPS and PEEK emit a generally metallic-sounding acoustic response when impacted. As such, by using a PPS or PEEK polymer, the present design can leverage the strength/weight benefits of the polymer, while not compromising the desirable metallic club head sound at impact.

With continued reference to FIG. 3, the illustrated design utilizes a mixed material sole construction to leverage the strength to weight ratio benefits of FRCs, while also leveraging the design flexibility and dimensional stability/consistency offered by FTs. More specifically, while FRCs are typically stronger and less dense than FTs of the same polymer, their strength is typically contingent upon a smooth and continuous geometry. Conversely, while FTs are marginally more dense than FRCs, they can form significantly more complex geometries and are generally stronger than FRCs in intricate or discontinuous designs. These differences are largely attributable to the FRCs heavy reliance on continuous fibers to provide strength, whereas FTs rely more heavily on the structure of polymer itself.

As such, to maximize the strength of the present design at the lowest possible structural weight, the design provided in FIG. 3 utilizes an FRC material to form a large portion of the resilient outer shell of the sole 20, while using an FT material to locally enhance design flexibility and/or strength. More specifically, the FT material is used to: provide optimized selective structural reinforcement (i.e., where voids/apertures would otherwise compromise the strength of an FRC); affix one or more metallic swing weights 40 (i.e., where the FT more readily facilitates the attachment of discretionary metallic swing weights by molding complex receiving cavities or over-molding aspects of the weight);

and/or provide a dimensionally consistent joint structure that facilitates a structural attachment between the crown member 50 and the sole member 52 while providing a continuous club head outer surface.

Figure 4:
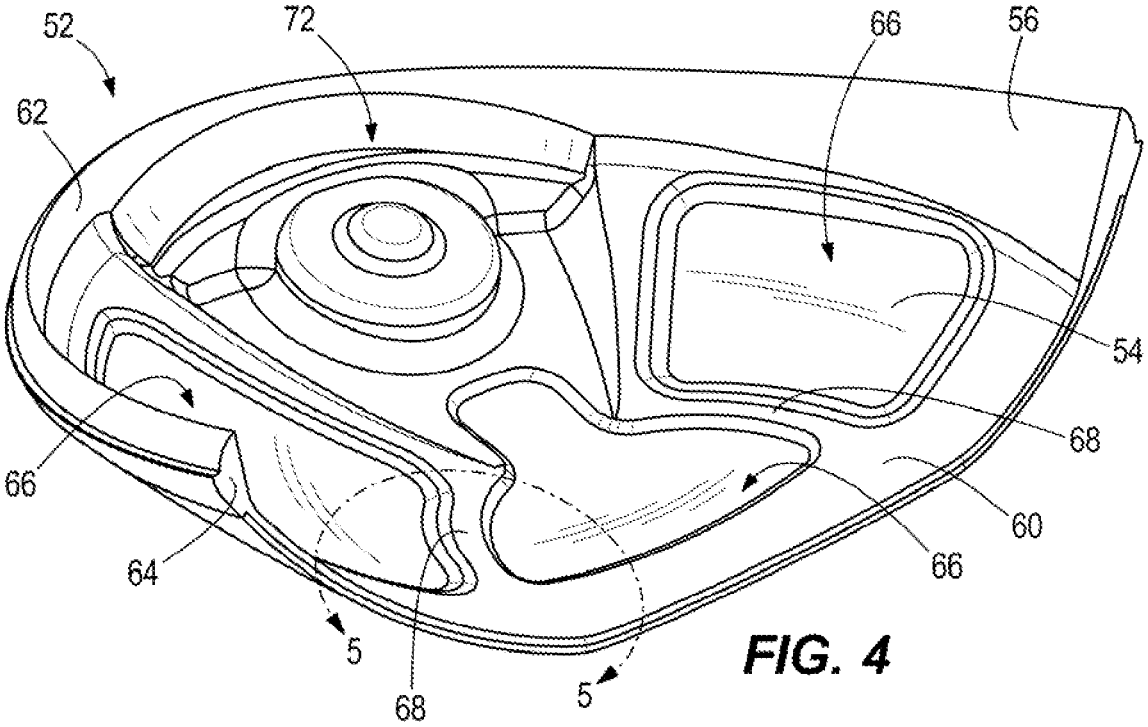
FIG. 4 is a schematic perspective view of an embodiment of a sole member of a mixed-material golf club head.

FIG. 4 more clearly illustrates an embodiment of the sole member 52, with an FRC resilient layer 54 bonded to a FT structural layer 56. As shown, the structural layer 56 may generally include a forward portion 60 and a rear peripheral portion 62 that define an outer perimeter 64 of the sole member 52. In an assembled club head 10, the forward portion 60 is bonded to the front body 14, and the rear peripheral portion 62 is bonded to the crown member 50. The structural layer 52 defines a plurality of apertures 66 located interior to the perimeter 64 that each extend through the thickness of the layer 50. Finally, the structural layer 52 may include one or more structural members 68 that extend from the forward portion 60 and between at least two of the plurality of apertures 66.

Figure 5:
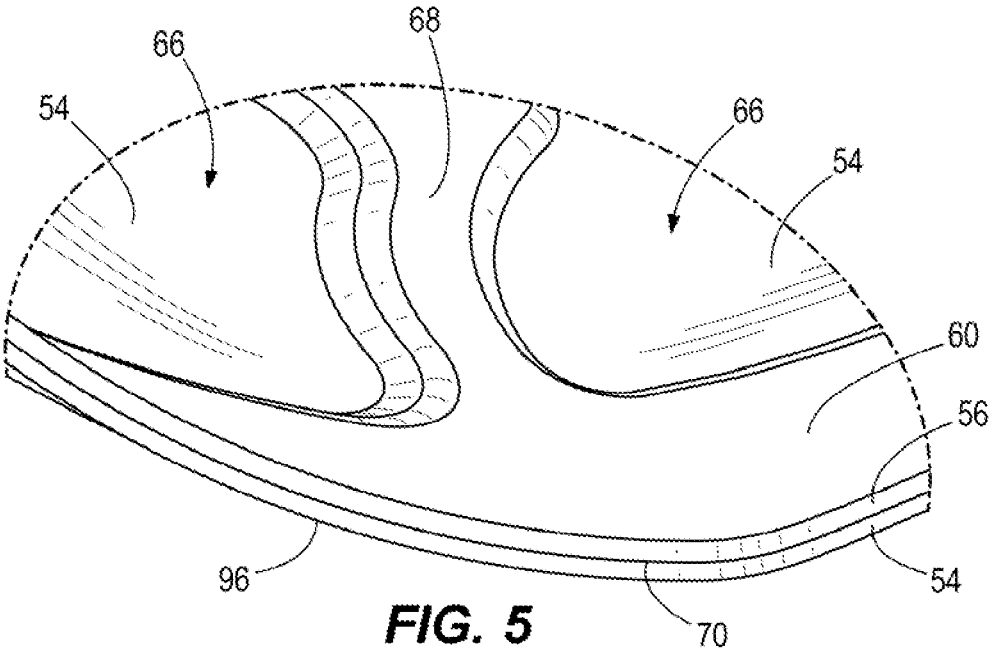
FIG. 5 is a schematic enlarged sectional view of a portion of the sole member of FIG. 4, taken along section 5-5.
Figure 6:
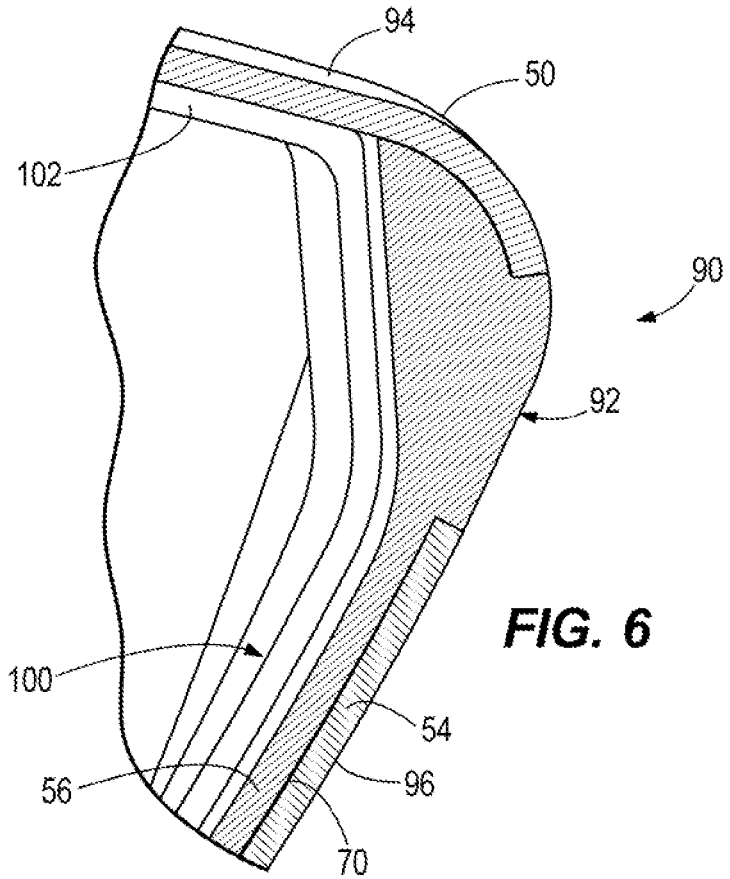
FIG. 6 is a schematic partial cross-sectional view of a joint structure of the golf club head of FIG. 2, taken along line 6-6.
Figure 7:
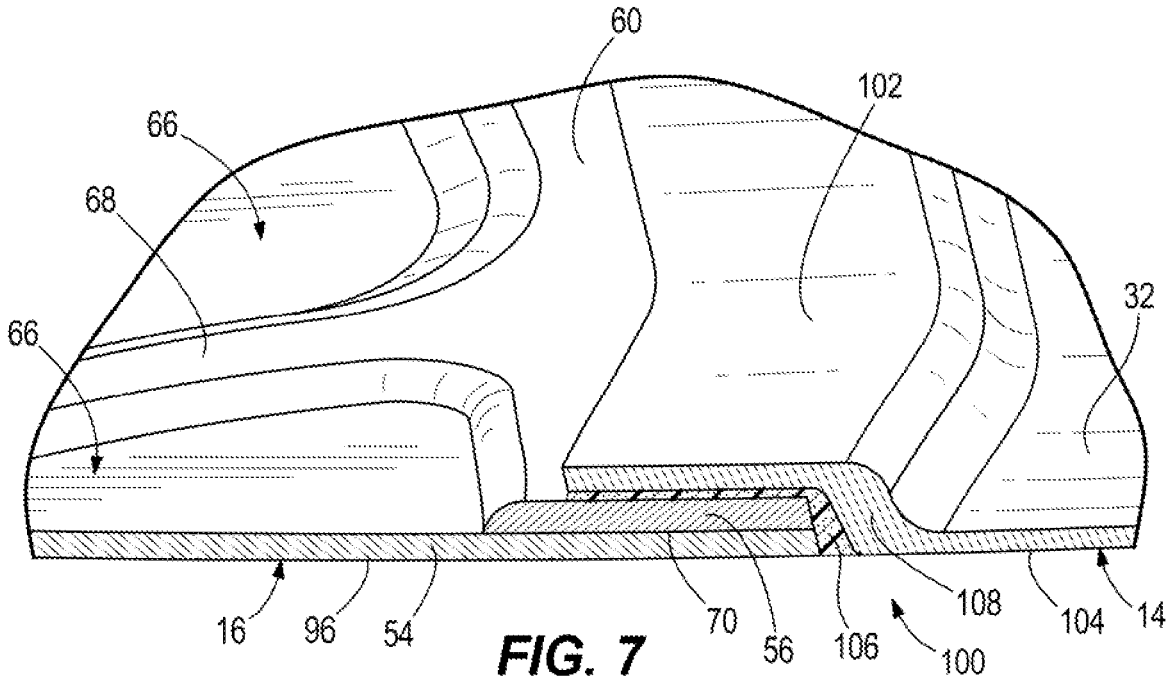
FIG. 7 is a schematic partial cross-sectional view of a joint structure of the golf club head of FIG. 2, taken along line 7-7.

As shown in FIG. 4, and more clearly in FIGS. 5-7, the resilient layer 54 may be bonded to an external surface 70 of the structural layer 56 such that it directly abuts and/or overlaps at least a portion of the forward portion 60, the rear peripheral portion 62, and the one or more structural members 68. In doing so, the resilient layer 54 may entirely cover each of the plurality of apertures 66 when viewed from the exterior of the club head 10. Likewise, the one or more structural members 68 may serve as selective reinforcement to an interior portion of the resilient layer 54, akin to a reinforcing rib or gusset.

With reference to FIGS. 2-4, in some embodiments, the structural layer 56 may include a weighted portion 72 that is adapted to receive the one or more metallic weights 40 (e.g., tungsten-based swing weights) either by directly adhering or embedding the weight into a molded cavity, or by providing a recess 74 that is operative to receive a removable metallic mass. The weighted portion 72 is may be located toward the rear most point on the club head 10, and therefore may be integral to and/or directly coupled with the rear peripheral portion 62 of the structural layer 56, and spaced apart from the forward portion 60. As noted above, the filled thermoplastic construction of the structural layer 56 is particularly suited to receive the one or more weights 40 due to its ability to form complex geometry in a structurally stable manner. More specifically, the filled thermoplastic construction of the structural layer 56 allows the design to include one or more dimensional recesses that would generally not be possible with an all-FRC construction (i.e., as the strength benefits of FRCs are typically only available across continuous surface geometries). For example, as shown in FIG. 3, the weighted portion 72 may be molded to define one or more weight-receiving channels or recesses that have non-uniform thicknesses, that extend around corners, and/or that join with other surfaces at sharp angles; all of which would be difficult or impossible to form strictly with a fiber reinforced composite.

While affixing the one or more weights 40 to the structural layer 56 at a rear portion of the club head 10 desirably shifts the center of gravity of the club head 10 rearward and lower while also increasing the club head's moment of inertia, it also can create a cantilevered point mass spaced apart from the more structural metallic front body 14. As such, in some embodiments, the one or more structural members 68 may span between the weighted portion 72 and the forward portion 60 to provide a reinforced load path between the one or more weights 40 and the metallic front body 14. In this manner, the one or more stiffening members 68 may be operative to aid in transferring a dynamic load between the weighted portion 72 and the front body 14 during an impact between the strike face 30 and a golf ball. At the same time, these same rib-like stiffening members 68 may be operative to reinforce the resilient layer 54 and increase the modal frequencies of the club head at impact such that the natural frequency is greater than about 3,500 Hz at impact, and exists without substantial dampening by the polymer. When this surface reinforcement is combined with the desirable metallic-like acoustic impact properties of polymers such as PPS or PEEK, a user may find the club head 10 to be audibly similar from an all-metal club head while the design provides significantly improved mass properties (CG location and/or moments of inertia).

In a preferred embodiment, the resilient layer 54 and the structural layer 56 may be integrally bonded to each other without the use of an intermediate adhesive. Such a construction may simplify manufacturing, reduce concerns about component tolerance, and provide a superior bond between the constituent layers than could be accomplished via an adhesive or other joining methods. To accomplish the integral bond, each of the resilient layer 54 and structural layer 56 may include a compatible thermoplastic polymer that may be thermally bonded to the polymer of the mating layer.

Figure 8:
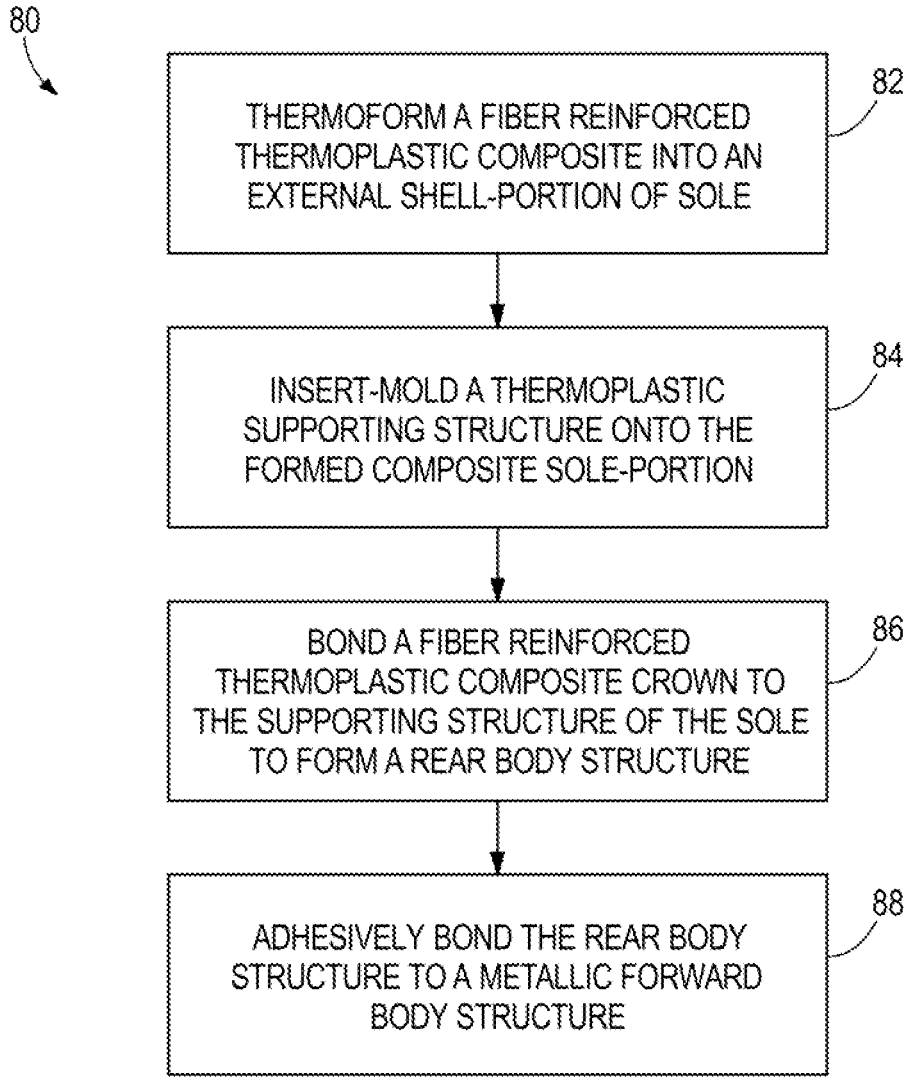
FIG. 8 is a schematic flow chart illustrating a method of manufacturing a mixed material golf club head.

FIG. 8 illustrates an embodiment of a method 80 for manufacturing a golf club head 10 having the integrally bonded resilient layer 54 and structural layer 56 of the sole member 52. The method 80 involves thermoforming a fabric reinforced thermoplastic composite into an external shell portion of the club head 10 at step 82. The thermoforming process may involve, for example, pre-heating a thermoplastic prepreg to a molding temperature at least above the glass transition temperature of the thermoplastic polymer, molding the prepreg into the shape of the shell portion, and then trimming the molded part to size.

Once the composite shell portion is in a proper shape, a filled thermoplastic supporting structure may then be injection molded into direct contact with the shell at step 84. Such a process is generally referred to as insert-molding. In this process, the shell is directly placed within a heated mold having a gated cavity exposed to a portion of the shell. Molten polymer is forcibly injected into the cavity, and thereafter either directly mixes with molten polymer of the heated composite shell, or locally bonds with the softened shell. As the mold is cooled, the polymer of the composite shell and supporting structure harden together in a fused relationship. The bonding is enhanced if the polymer of the shell portion and the polymer of the supporting structure are compatible, and is even further enhanced if the two components include a common or otherwise miscible thermoplastic resin component. While insert-molding is a preferred technique for forming the structure, other molding techniques, such as compression molding, may also be used.

With continued reference to FIG. 8, once the sole member 52 is formed through steps 82 and 84, an FRC crown member 50 may be bonded to the sole member 52 to substantially complete the structure of the rear body 16 (step 86). In a preferred embodiment, the crown member 50 may be formed from a thermoplastic FRC material that is formed into shape using a similar thermoforming technique as described with respect to step 82. Forming the crown member 50 from a thermoplastic composite allows the crown member 50 to be bonded to the sole member 52 using a localized welding technique. Such welding techniques may include, for example, laser welding, ultrasonic welding, or potentially electrical resistance welding if the polymers are electrically conductive. If the crown member 50 is instead formed using a thermoset polymer, then the crown member 50 may be bonded to the sole member 52 using, for example, an adhesive or a mechanical affixment technique (studs, screws, posts, mechanical interference engagement, etc).

FIG. 6 generally illustrates an embodiment of a joint 90 that is operative to couple the crown member 50 and sole member 52. As shown, the structural layer 56 separately receives the resilient layer 54 and crown member 50 to form a continuous external surface 92 (i.e., the external surface 92 of the rear body 16 comprises an external surface 94 of the crown member 50, an external surface 70 of the structural layer 56, and an external surface 96 of the resilient layer 54).

Referring again to FIG. 8, the rear body 16, comprising the affixed crown member 50 and sole member 52 may subsequently be affixed to the front body structure 14 at step 88. In an embodiment where both the frame 32 of the front body 14 and the forward portion of the rear body 16 comprise a common or otherwise miscible thermoplastic, the affixment step 88 may be performed via thermal fusing and without the use of intermediate adhesives. If the front body 14 is substantially formed from a metal, the affixment may require the use of adhesives to facilitate the bond. While adhesives readily bond to most metals, the process of adhering to the polymer may require the use of one or more adhesion promoters or surface treatments to enhance bonding between the adhesive and the polymer of the rear body 16.

FIG. 7 schematically illustrates an example of a bond interface 100 between the sole member 52 and a metallic embodiment of the frame 32 of the front body 14. As shown, the bond interface 100 resembles a lap joint where the structural layer 56 and/or resilient layer 54 overlay a bonding flange 102 that is inwardly recessed from an external surface 104 of the frame 32. In the illustrated embodiment, the structural layer 56 may be adhesively bonded directly to the bonding flange 102 via an intermediately disposed adhesive 106. Furthermore, the resilient layer 54 may extend over the entire forward portion 60 of the structural layer 56 such that the external surface 96 of the resilient layer 54 is flush with the external surface 104 of the frame 32. By recessing the bonding flange 102 in the manner shown, the structural layer 56 and/or resilient layer 54 may directly abut an extension wall 108 joining the frame 32 and flange 102 to further facilitate the transfer of dynamic impact loads from the weight 40/weighted portion 72 to the frame 32.

In some embodiments, the resilient layer 54 may have a substantially uniform thickness that may be in the range of from about 0.5 mm to about 0.7 mm, from about 0.5 mm to about 1.0 mm, or from about 0.6 mm to about 0.9 mm, or from about 0.7 mm to about 0.8 mm. In some embodiments, the resilient layer 54 may have a substantially uniform thickness of 0.5 mm, 0.55 mm, 0.60 mm, 0.65 mm, or 0.70 mm. In areas of the structural layer 56 that directly abut the resilient layer 54 (i.e., areas where the resilient layer 54 is located exterior to the structural layer 56), some embodiments of the structural layer 56 may have a substantially uniform thickness of from about 0.5 mm to about 0.7 mm, from about 0.5 mm to about 1.0 mm, or from about 0.6 mm to about 0.9 mm, or from about 0.7 mm to about 0.8 mm. In some embodiments, the structural layer 56 may have a substantially uniform thickness of 0.5 mm, 0.55 mm, 0.60 mm, 0.65 mm, or 0.70 mm. A substantially uniform construction of both the resilient layer 54 and the structural layer 56 is generally illustrated in FIGS. 4-7 and 11. In these embodiments, the total thickness of the resilient layer 54 and the structural layer 56 may be, for example, in the range of from about 1.0 mm to about 1.5 mm, from about 1.0 mm to about 2.0 mm, or from about 1.25 mm to about 1.75 mm, or from about 1.4 mm to about 1.6 mm. In some embodiments, the total thickness of the resilient layer 54 and the structural layer 56 may be 1.0 mm, 1.1 mm, 1.2 mm, 1.3 mm, 1.4 mm, or 1.5 mm.

Referring again to FIGS. 3 and 6, in an embodiment, the recessed bonding flange 102 may entirely encircle the strike face 30 and/or extend from the frame 32 across all portions of the crown 18 and sole 20. In this manner, as shown in FIG. 6, the rear body 16 may further be affixed to the front body 14 by adhering the crown member 50 to the bonding flange 102.

Figure 9:
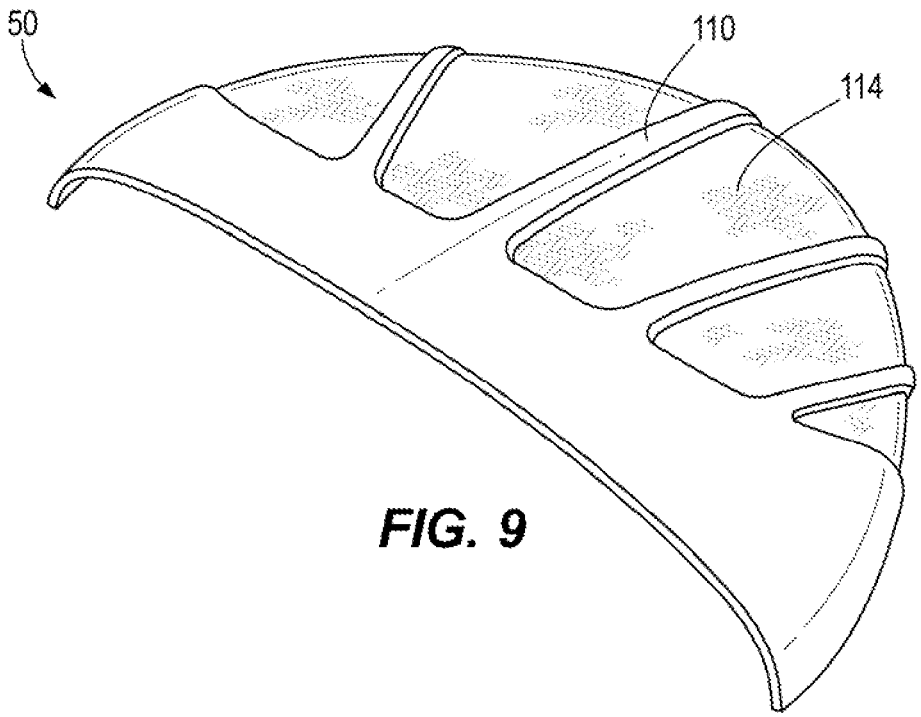
FIG. 9 is a schematic top perspective view of a mixed material crown member.
Figure 10:
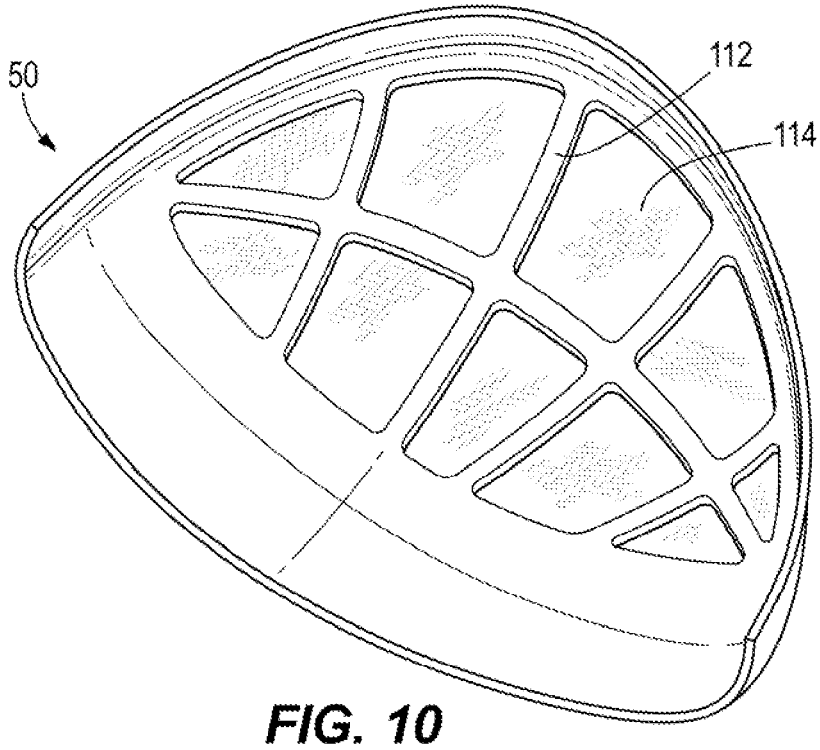
FIG. 10 is a schematic bottom perspective view of a mixed material crown member.

While the method 80 illustrated in FIG. 8 is primarily focused with forming a club head similar to that shown in FIG. 3 (i.e., where step 82 forms the resilient layer 54 of the sole member 52 and step 84 forms the structural layer 56 of the sole member 52), the processes described with respect to steps 82 and 84 may also (or alternatively) be used to form a crown member 50. For example, as shown in FIGS. 9 and 10, the crown member 50 may include one or both of an outer structural layer 110 and an inner structural layer 112 bonded to a thermoplastic FRC resilient crown layer 114. While the inner structural layer 112 may generally function in a similar manner as the structural layer 56 of the sole member 52, the outer structural layer 110 may provide further weight saving benefits by concentrating reinforcing structure in areas where it provides the most structural benefit while also enabling thinner component thicknesses at interstitial spaces. In general, the present concept of structural ribbing generally results in the creation of weight reduction zones between the ribbing. These weight reduction zones can be in the sole or the crown, and are further described in U.S. Pat. Nos. 7,361,100 and 7,686,708, which are incorporated by reference in its entirety.

Specific to construction of a mixed-material crown member 50, and similar to that described above with respect to the sole member 52, the formation may begin by thermoforming a fiber reinforced thermoplastic composite into an external shell portion of the club head 10. The thermoforming process may involve, for example, pre-heating a thermoplastic prepreg to a molding temperature at least above the glass transition temperature of the thermoplastic polymer, molding the prepreg into the shape of the shell portion, and then trimming the molded part to size.

Once the composite shell portion is in a proper shape, a filled thermoplastic supporting structure (i.e., one or both of the inner structural layer 112 and outer structural layer 114) may then be injection molded into direct contact with the shell (e.g., via insert-molding, as described above).

Figure 11:
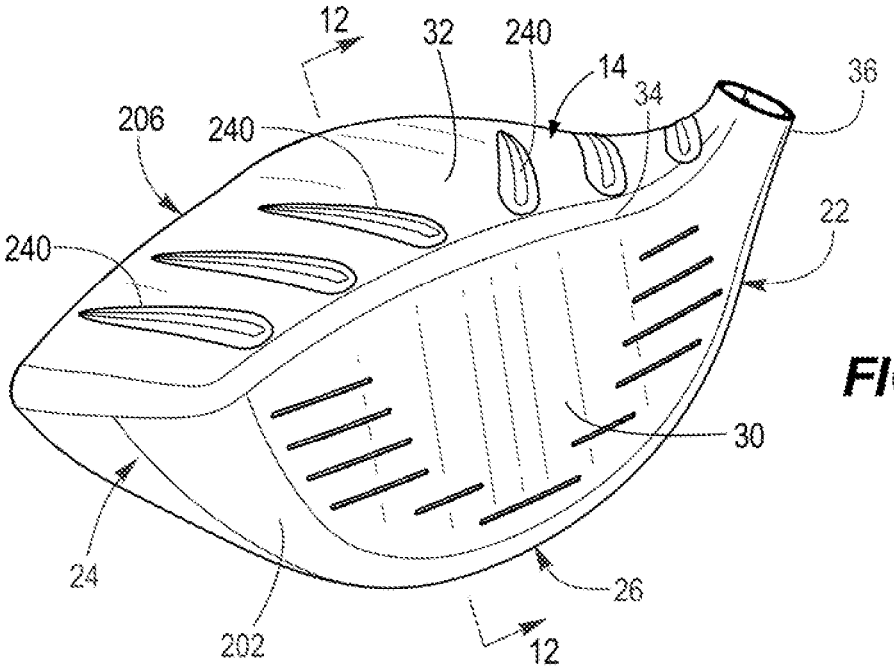
FIG. 11 is a schematic perspective view of a thermoplastic composite front body of a golf club head.
Figure 12:
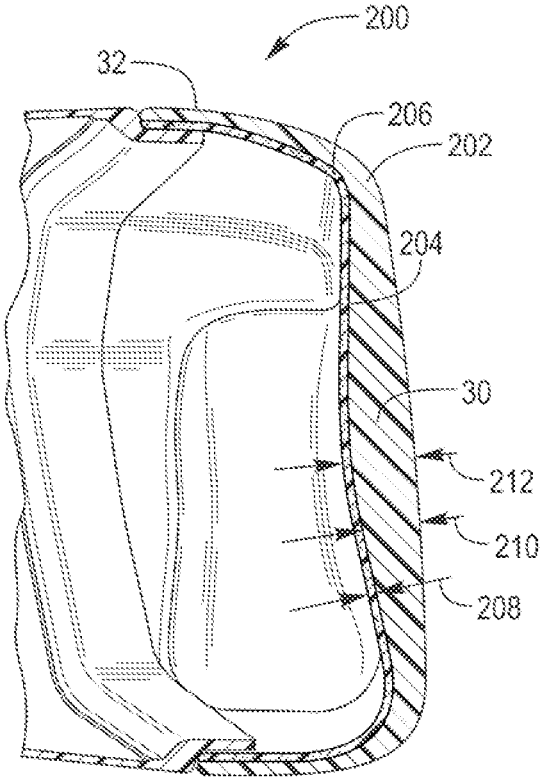
FIG. 12 is a schematic partial cross-sectional view of a first embodiment of a golf club head having a thermoplastic composite front body, and taken along line 12-12 in FIG. 11.
Figure 13:
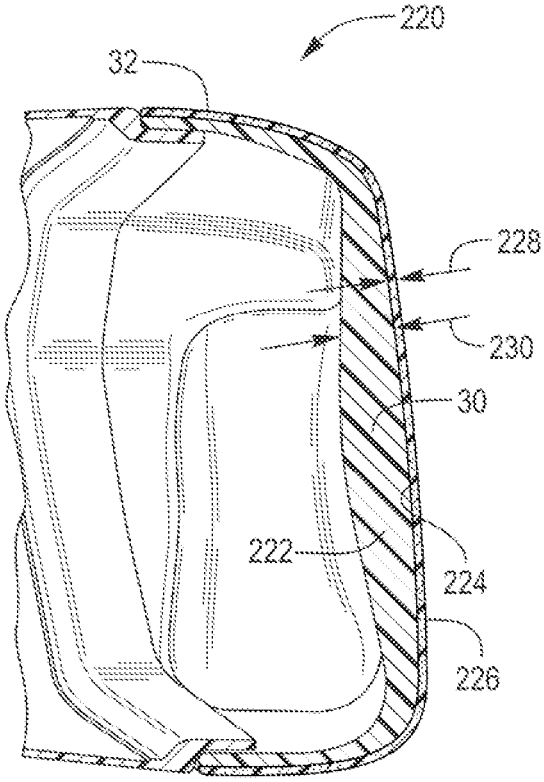
FIG. 13 is a schematic partial cross-sectional view of a second embodiment of a golf club head having a thermoplastic composite front body, and taken along line 12-12 in FIG. 11.

While FIGS. 4-10 generally focus on construction of the rear body 16, these same co-molding techniques may be employed to form a thermoplastic composite front body 14, such as generally illustrated in FIGS. 11-13. More specifically, FIG. 12 illustrates a first front body configuration 200 that includes a filled thermoplastic outer layer 202 coupled to the outer surface 204 of a fabric reinforced composite layer 206. In this embodiment, the filled thermoplastic outer layer 202 defines the ball-striking surface while the fabric reinforced composite layer 206 provides a high strength backing to the face 30. In some embodiments, the fabric reinforced composite layer and filled thermoplastic layer may each extend across the entire strike face to provide resiliency and strength to withstand repeated high speed impacts with a golf ball. Additionally, in some embodiments, the fabric reinforced composite layer 206 may sweep rearward to form at least a portion of the frame 32. As shown, in one embodiment, the fabric reinforced composite layer 206 may have a generally uniform thickness 208 that is formed from one or more layers of a uni- and/or multi-directional ply extending continuously across a substantial majority of the strike face 30.

As further shown, the filled thermoplastic outer layer 202 may have a variable thickness 210 that extends between the fabric reinforced composite layer 206 and the ball striking surface. In embodiments where the fabric reinforced composite layer 206 has a substantially uniform thickness, the filled thermoplastic outer layer 202 may primarily contribute to a variable thickness 212 of the strike face 30 as a whole.

FIG. 13 then provides a second front body configuration 220 that includes a filled thermoplastic inner layer 222 coupled to the inner surface 224 of a fabric reinforced composite layer 226. In this embodiment, the fabric reinforced composite layer 226 defines the strike face 30 and extends rearward to form at least a portion of the frame 32. The filled thermoplastic inner layer 212 then serves as a structural backing to the composite layer 226. Similar to FIG. 12, in an embodiment, the fabric reinforced composite layer 226 may generally have a uniform thickness 228 that is formed from one or more layers of a uni- and/or multi-directional ply extending continuously across a substantial majority of the strike face 30. The filled thermoplastic inner layer 222 may then have a variable thickness 230 that may be designed to tune the dynamic response of the face 30 to an impact.

As shown in FIGS. 12-13, each front body configuration 200, 220 may include a variable face thickness that is substantially provided for by the filled thermoplastic layer 202, 222. In many embodiments, the face thickness may vary such that the minimum face thickness ranges from 0.114 inch and 0.179 inch, and the maximum face thickness ranges from 0.160 inch to 0.301 inch. The minimum face thicknesses can be 0.110 inches, 0.114 inches, 0.115 inches, 0.120 inches, 0.125 inches, 0.130 inches, 0.135 inches, 0.140 inches, 0.145 inches, 0.150 inches, 0.155 inches, 0.160 inches, 0.165 inches, 0.170 inches, 0.175 inches, 0.179 inches, or 0.180 inches. The maximum face thickness can be 0.160 inches, 0.165 inches, 0.170 inches, 0.175 inches, 0.180 inches, 0.185 inches, 0.190 inches, 0.195 inches, 0.200 inches, 0.205 inches, 0.210 inches, 0.215 inches, 0.220 inches, 0.225 inches, 0.230 inches, 0.235 inches, 0.240 inches, 0.245 inches, 0.250 inches, 0.255 inches, 0.260 inches, 0.265 inches, 0.270 inches, 0.275 inches, 0.280 inches, 0.285 inches, 0.290 inches, 0.300 inches, 0.301 inches, 0.305 inches, or 0.310 inches.

Figure 14:
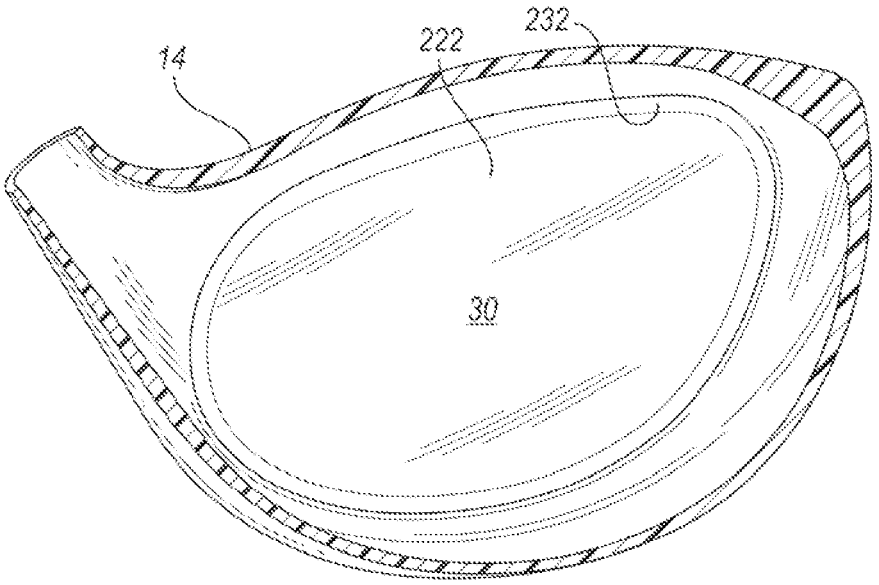
FIG. 14 is a schematic rear view of a thermoplastic composite front body of a golf club head with a debossed channel surrounding the strike face.

With reference to FIG. 14, in some embodiments, a filled thermoplastic inner layer 222 may include one or more discontinuities, voids, debossed geometries, or other irregular surface geometries. In some configurations, the fabric reinforced composite layer 226 may be visible through one or more molded-in holes or channels in the filled thermoplastic inner layer 222. In the embodiment shown in FIG. 14, the filled thermoplastic inner layer 222 may define a channel 232 extending around a perimeter of the strike face 30 to increase face bending and increase energy transfer to a golf ball during impact. The illustrated embodiment of FIG. 14 illustrates the channel 232 extending continuously around the perimeter of the strike face 30. However, in other embodiments, the channel 232 can extend discontinuously around one or more portions of the perimeter of the strike face 30. Further, in other embodiments, the channel 232 can extend along any portion of the back side of the strike face 30.

In the illustrated embodiment of FIG. 14, the channel 232 comprises a rounded concave cross sectional geometry. In other embodiments, the channel 232 can comprise any cross sectional geometry, including but not limited to circular, elliptical, square, rectangular, triangular, or any other polygon or shape with at least one curved surface. Further, the channel 232 comprises a depth, measured as the maximum depth of the channel 232 in a direction extending substantially perpendicular to the back side of the strike face 30. In many embodiments, the depth of the channel may range from about 0.1 mm about 3 mm. in another embodiment, the depth of the channel may range from about 0.125 mm to about 2 mm.

In the illustrated embodiment, the channel 232 allows the strike face 30 to absorb 0.9% more impact energy that is transferrable to a golf ball to increase ball speed and travel distance. In many embodiments, the channel 232 allows the strike face 30 to absorb 0.75% to 1.5% more impact energy that can be transferred to a golf ball to increase ball speed and travel distance.

In an embodiment where a filled thermoplastic outer layer 202 is disposed outward of a fabric reinforced composite layer 206, such as shown in FIG. 11, the filled thermoplastic material may form one or more aerodynamic features that may operatively reduce club head drag and increase the speed of the club. Such features may include a repeating pattern of debossed geometric shapes (e.g., hemispherical depressions, hexagonal depressions, pyramidal depressions, grooves, or the like), a repeating pattern of embossed geometric shapes (e.g., hemispherical protrusions, hexagonal protrusions, pyramidal protrusions, ribs, or the like). Likewise, these aerodynamic features may include discrete depressions or protrusions such as the plurality of turbulators 240 illustrated in FIG. 11. These aerodynamic features can be used to alter boundary layer air flow and are described further in U.S. Pat. No. 9,555,294 (the '294 patent), which is incorporated by reference in its entirety. As may be appreciated, the molded thermoplastic material may be particularly suited for creating these aerodynamic features (i.e., when compared with a fabric reinforced composite) due to the nature of polymeric molding where the surface profile of the mold dictates the surface geometry of the finished part.

Because filled thermoplastics can have anisotropic structural qualities that are dependent on the typical or average orientation of the embedded, discontinuous fibers, special attention may need to be paid to the formation of the filled thermoplastic (FT) layer 202, 222 to ensure that it has sufficient strength to withstand repeated impacts. More specifically, a filled polymeric component will generally have greater strength against loads that are aligned with the longitudinal axis of the embedded fibers, and comparatively less strength to loads applied laterally. Because fiber orientation within a filled polymer is highly dependent on mold flow during the initial part formation, embodiments of a polymeric front body 14 may utilize mold and part designs that aid in orienting the embedded fiber along the most likely force/stress propagation paths.

As is understood, during a molding process, such as injection molding, embedded fibers tend to align with a direction of the flowing polymer. With some fibers (i.e., particularly with short fiber reinforced thermoplastics) and resins, the alignment tends to occur more completely close to the walls of the mold or edge of the part. These layers are referred to as shear layers or skin layers. Conversely, within a central core layer, the fibers can sometimes be more randomized and/or perpendicular to the flowing polymer.

The thickness of the core layer can generally be altered by various molding parameters including molding speed (i.e., slower molding speed can yield a thinner core layer) and mold design. With the present designs, it is desirable to minimize the thickness of any randomized core layer to enable better control over fiber orientation.

Figure 15:
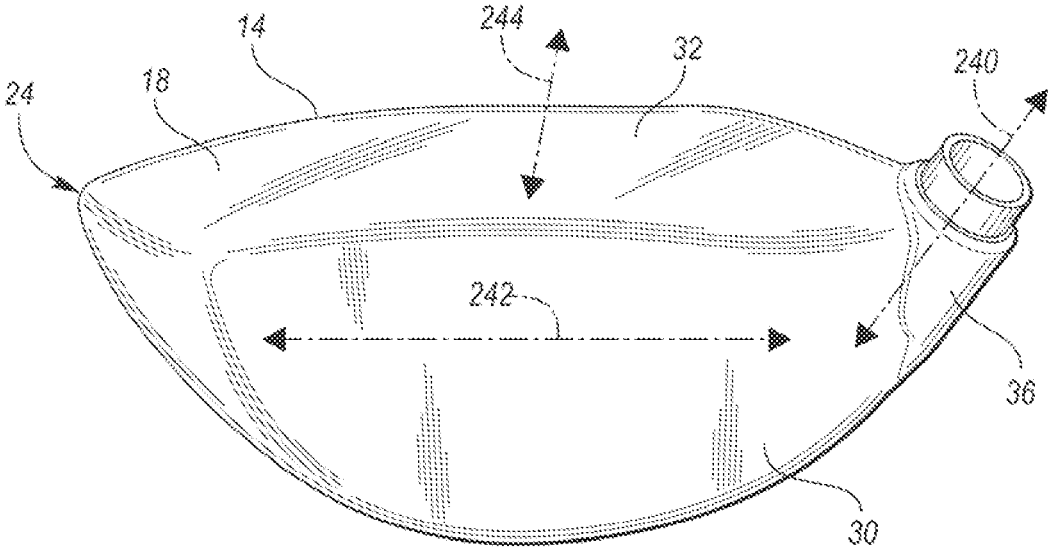
FIG. 15 is a schematic top face view of a front body of a golf club head.

During an impact, stresses tend to radiate outward from the impact location while propagating toward the rear of the club head 10. Additionally, bending moments are imparted about the shaft, which induces material stresses between the impact location and the hosel 36, and along the hosel 36/parallel to a hosel axis 240 (as shown in FIG. 15). Therefore, where applicable, it is preferable for the embedded fibers to generally follow these same directions; namely: within the hosel 36 parallel to the hosel axis 240; across at least the center of the face 30 (represented by the horizontal face axis 242); and, generally outward from the face center with the fibers turning largely rearward within the frame 32 (i.e., parallel to a fore-rear axis 244).

Because the discontinuous fibers are mixed within the flowable polymer prior to forming the part, it is impossible to guarantee perfect alignment. With that said, however, the design of the front body 14 and manner of injection molding (e.g., fill rate, gating/venting, and temperature) may be controlled to align as many of the embedded fibers with these axes as possible. For example, within the hosel, it is preferable if greater than about 50% of the fibers are aligned within 30 degrees of the hosel axis 240. Between the center of the face and the hosel 36, it is preferable if greater than about 50% of the fibers are aligned within 30 degrees of the horizontal face axis 242, and/or within the frame 32, it is preferable if greater than about 50% of the fibers are aligned within 30 degrees of the fore-rear axis 244. In another embodiment, greater than about 60% of the fibers within the hosel 36 are aligned within 25 degrees of the hosel axis 240, greater than about 60% of the fibers between the center of the face and the hosel 36 are aligned within 25 degrees of the horizontal face axis 242, and/or greater than about 60% of the fibers within the frame 32 are aligned within 25 degrees of the fore-rear axis 244. In still another embodiment, greater than about 70% of the fibers within the hosel 36 are aligned within 20 degrees of the hosel axis 240, greater than about 70% of the fibers between the center of the face and the hosel 36 are aligned within 20 degrees of the horizontal face axis 242, and/or greater than about 70% of the fibers within the frame 32 are aligned within 20 degrees of the fore-rear axis 244.

Figure 16:
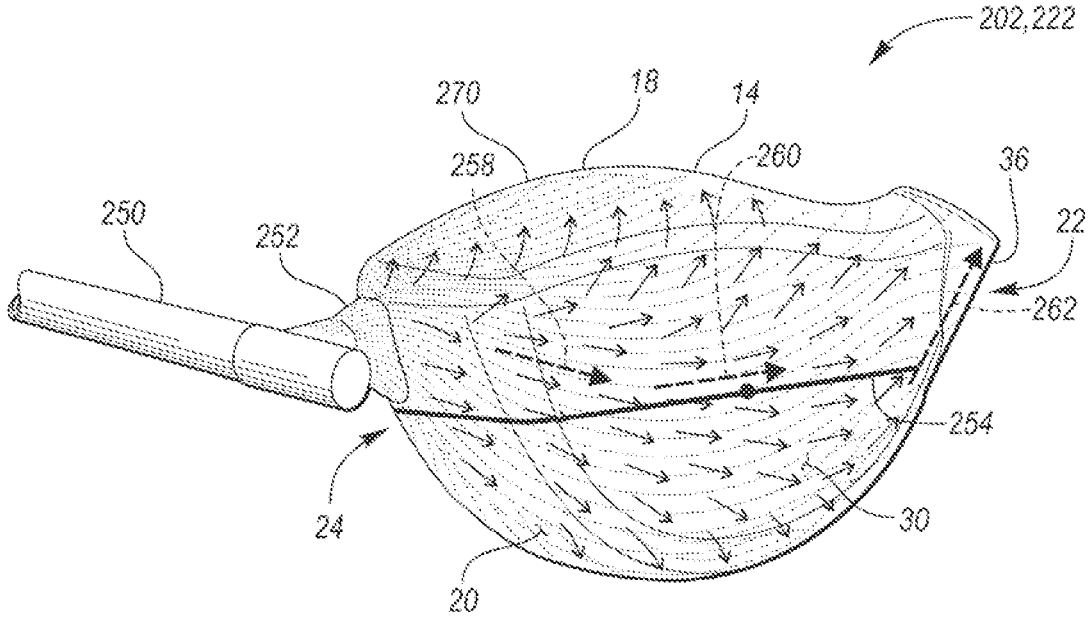
FIG. 16 is a schematic perspective view of a molded front body of a golf club head with a sprue and molding gate leading into the front body.
Figure 17:
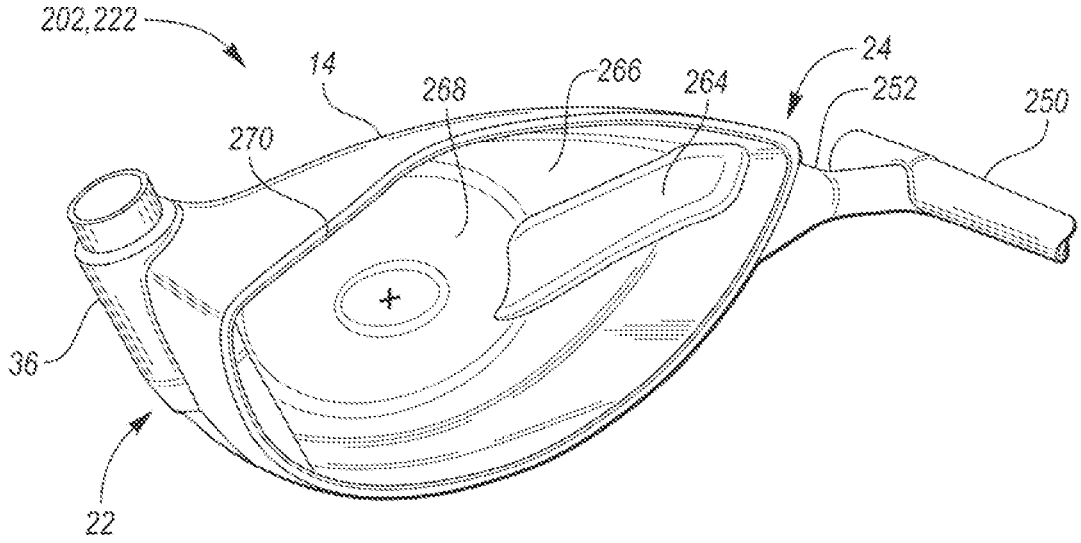
FIG. 17 is a reverse view of the front body of FIG. 16

FIGS. 16-17 illustrate an FT layer 202, 222 that generally accomplishes the fiber alignment described above. In these figures, the FRC layer 206, 226 is removed to better show the contours of the face 30. While FIGS. 16-17 illustrate the FT layer 202, 222 forming at least a portion of the frame 32, it should be noted that this layer need not form or complete the frame 32, and in some embodiments, the FT layer 202, 222 is constrained solely to the strike face 30 while the FRC layer 206, 226 forms the entirety of the frame 32.

FIG. 16 schematically illustrates the flow and fiber alignment within one embodiment of the FT layer 202, 222. As shown through these figures, flowable polymer passes from a sprue 250 and connected gate 252 directly into the toe portion 24 of the front body 14. From there, the polymer may flow across the face 30, and then upward through the hosel 36. By flowing across the face 30 and upward through the hosel 36, the FT may form the somewhat complex geometries of the hosel 36, while pushing weld lines high and to the heel side of the hosel 36, which is generally the lowest stress area of the hosel 36. If the front body 14 were attempted to be gated at the hosel 36 (instead of at the toe), there is a greater likelihood of introducing a weld line in or near the face 30, or on the toe side of the hosel 36, which experiences comparatively greater stress than the heel side. Because weld lines have a lower ultimate strength than the typical polymer, it is important to ensure that they do not get formed in areas that typically experience higher stresses.

To encourage the polymer to fill the hosel 36 from bottom to top, it may be desirable to fill the face from a location near the toe 24 and that is at or preferably above the horizontal centerline 254 of the face 30 (i.e., between the crown 18 and a line drawn through the center of the face 256 and parallel to a ground plane when the club is held at address). This may encourage the flow 258 and corresponding fiber alignment to follow a generally downward slant from above the horizontal centerline 254 at the toe 24 toward the center of the face 256 while between the toe and the center 256. Following this, at the center 256, the flow 260 and corresponding fiber alignment may generally be parallel to the horizontal centerline 254 at or immediately surrounding the center of the face 256. Finally, the flow 262 may arc upward and fill the hosel 36 largely from the bottom toward the neck. While FIG. 16 illustrates the gate 252 directly attaching to the frame 32, in the absence of an FT frame, the gate 252 may directly couple with a portion of the strike face 30 closest to the toe 24. The general directional references illustrated at 258, 260, and 262 are generally intended to indicate that greater than about 50% of the fibers within the polymer are aligned within about 30 degrees of the indicated direction, or more preferably that more than about 60% of the fibers are aligned within about 25 degrees of the indicated direction, or even more preferably that more than about 70% of the fibers are aligned within about 20 degrees of the indicated direction.

Figure 18:
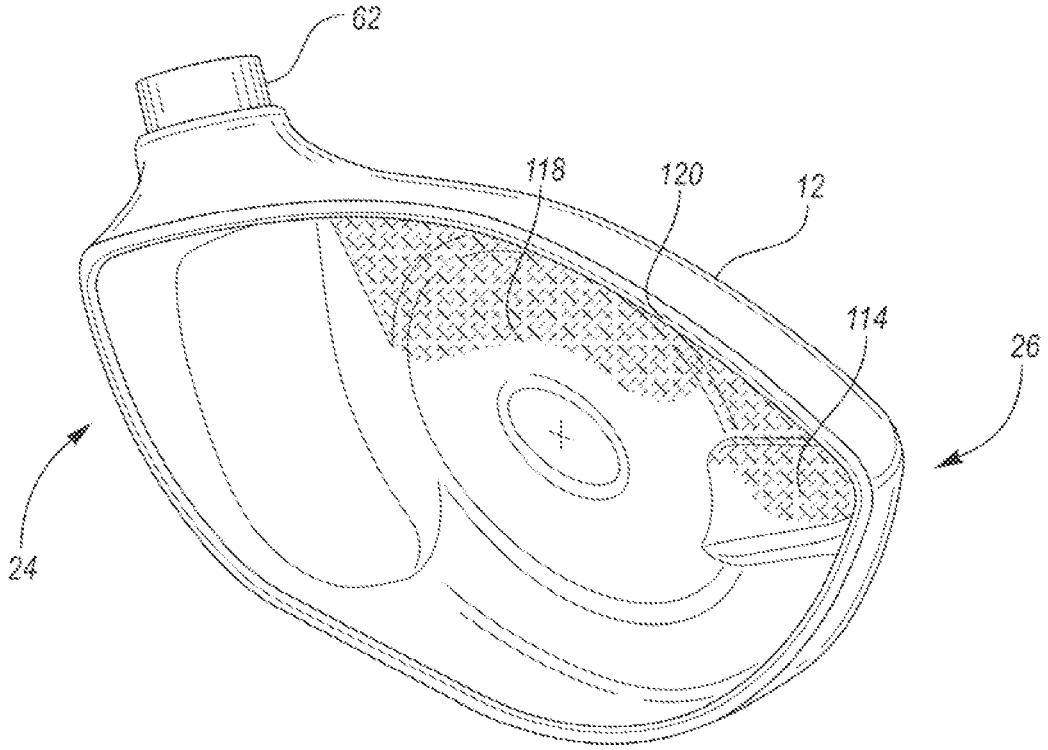
FIG. 18 is a schematic perspective view of the rear portion of a molded front body of a golf club head with a fabric reinforced composite inner surface.

As shown in FIG. 17-18, to promote the directional flow 258, 260 across the face 30 while also encouraging a slight downward arc at 258, a flow leader 264 may protrude from a rear surface 266 of the FT layer 202, 222. As shown, the flow leader 264 may be an embossed channel that extends from an edge of the FT layer 202, 222 at or near the gate and propagates away from the gate, inward toward a central region of the face 30. It may serve as a path of comparatively lower resistance for material to flow during molding, thus ensuring a primary flow-direction. In some embodiments, the flow leader 264 may be raised above the surrounding surface 266 by a height of from about 0.5 mm to about 1.5 mm, or from about 0.7 mm to about 1.0 mm. Furthermore, the flow leader 264 may have a lateral width, measured orthogonally to the height and to a line from the origin of the flow leader at the toe 24 to the face center 256, of from about 5 mm to about 15 mm, or from about 7 mm to about 12 mm.

As further shown in FIGS. 17-18, in one embodiment, the flow leader 264 may lead into a thickened central region 268 of the face 30. This thickened central portion 268 may primarily be used to stiffen the central region of the face against impacts so that the face moves more as a single unit while avoiding local deformations. From a molding perspective, this thickened region 268 may serve as a well or manifold of sorts that may supply polymer radially outward to fill the frame from front to back (or at least to steer polymer flowing through the thinner areas toward the rear edge 270 of the frame). The flow convergence from the thicker region 268 to the surrounding thinner areas will also aid aligning the embedded fibers. FIG. 18 further illustrates a FRC backing 206 provided on an internal surface of the front body 14, similar to FIGS. 11-12.

While FIGS. 16-18 specifically illustrate fiber alignment in the front body 14 and strike face 30, these techniques should be regarded as illustrative and equally applicable to the rear body 16. For example, in some embodiments, any injection molded structure of the rear body (e.g., the structural layer 56 shown in FIG. 3) may be gated/molded to align embedded, discontinuous fibers along primary load path axes, while minimizing knit lines or pushing knit lines to locations that experience comparatively lower stress. To accomplish this, for example, in one embodiment, the rear body 16 may be gated at the rear most point of the structural layer 56 such that fiber containing resin flows uniformly from back to front. The structure may likewise be optimized to promote a uniform flow front, such as by minimizing the amount of structure that may divert resin flow or prevent the flow from continuing forward. In other embodiments, the structure may include one or more flow leaders that are operative to channel resin in a back to front manner. In both the front body 14 and rear body 16, it is preferable to utilize only one gate, as the flow coming from multiple gates will eventually converge and form structurally unsound knit lines.

Figure 19:
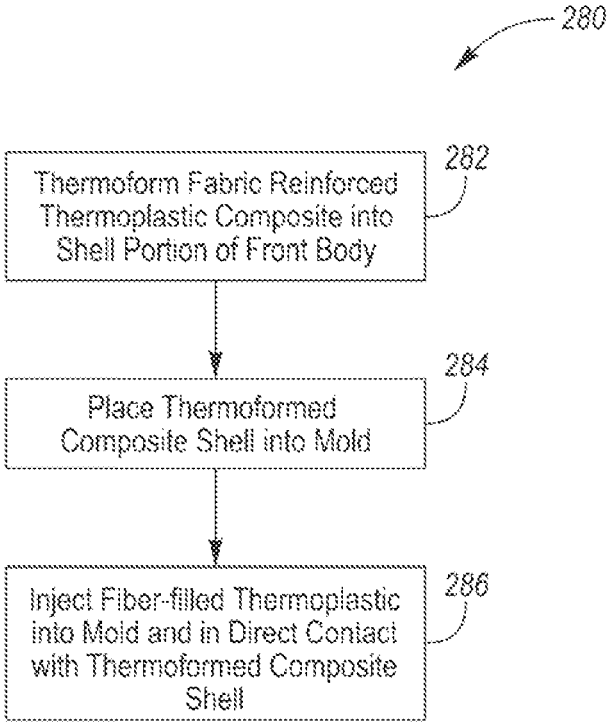
FIG. 19 is a schematic flow chart illustrating a method of manufacturing a thermoplastic composite front body of a golf club head.

FIG. 19 illustrates an embodiment of a method 280 of manufacturing a front body 14 having an integrally bonded FRC resilient layer 206, 226 and an FT structural layer 202, 222. The method 280 generally begins by thermoforming a fabric-reinforced thermoplastic composite into a shell portion of the front body 14 at step 282. The thermoforming process may involve, for example, pre-heating one or more thermoplastic prepregs to a molding temperature at least above the glass transition temperature of the thermoplastic polymer, molding the prepreg into a desired shape, and then trimming the molded part to size. In one configuration, the one or more prepregs are compression molded into a shape that may form the outer surface of the strike face 30 and frame 32, such as shown in FIG. 13. Such a configuration may generally entail a final shape with a plurality of flat and/or rounded surfaces. In another configuration, the one or more prepregs are compression molded into a shape that may form at least a portion of the inner surface of the front body 14 or strike face 30. In such an embodiment, the compression molded prepreg may follow the outer contours of any variable face thickness, flow leaders, or other internal surface features to direct the flow of material. In doing so, the outer surface 204 may create surface depressions that will eventually be filled by a flowable polymer.

Once the composite shell portion is in a proper shape, it is placed within a mold at 284, after which a filled thermoplasticic is then injection molded into direct contact with the FRC at step 286. As previously mentioned, such a process is generally referred to as insert-molding. In this process, the pre-formed shell is directly placed within a heated mold having a gated cavity/void that is directly abuts an exposed portion of the shell. Molten polymer is forcibly injected into the cavity, and thereafter it either directly mixes with molten polymer of the heated composite shell, or locally bonds with the softened shell. As the mold is cooled, the polymer of the composite shell and supporting structure harden together in a fused relationship. The bonding is enhanced if the polymer of the shell portion and the polymer of the supporting structure are compatible, and is even further enhanced if the two components include a common or otherwise miscible thermoplastic resin component. While insert-molding is a preferred technique for forming the structure, other molding techniques, such as compression molding, may also be used (e.g., where the FT layer is produced as a distinct, independent layer, and then fused with other layers via compression molding)

In further designs, a plurality of inserts are provided into the mold prior to injecting the filled thermoplastic. For example, a first insert may form the outer surface of the front body 14, a second insert may then form a reinforced back surface, and the filled thermoplastic may be injected in between. In another embodiment, one or more reinforcing meshes, including metallic meshes or screens, may be embedded within the FT layer to provide additional reinforcement and strength. In such an embodiment, to facilitate solid integration between the mesh and the FT layer, the mesh may include a plurality of apertures within which the thermoplastic resin may flow during creation of the FT layer.

While the disclosure above generally explains the use of thermoplastic composites that have at least one fabric-reinforced composite layer and at least one filled thermoplastic layer, it should be understood that the present techniques are not limited to simply two layers in a given component. In many embodiments, the thermoplastic composites may comprise a laminate that has two or more, three or more, four or more, five or more, six or more, seven or more, eight or more, nine or more, ten or more layers of mixed material. By forming each layer with a thermoplastic base resin, there is almost no limit to the number of times that any one or more layers may be reformed if the design so requires. This very nature may then enable the creation of intricate and/or complex three-dimensional material structures by pre-forming layers with different grain patterns, internal fiber orientations, and/or aperture size, shape, and/or spacing. This technology then enables the strength to weight ratio to be optimized by engineering the structure of the material, itself.

In some embodiments, one or more of the strike face 30, crown 18, or sole 20 may comprise a plurality of distinct layers of thermoplastic composite, each fused to at least one directly adjacent/abutting thermoplastic composite layer without the use of an intermediate adhesive. Each layer may consist of a fabric reinforced thermoplastic composite, a filled thermoplastic (preferably filled with a long and/or short fiber fill), or an unfilled thermoplastic. The base thermoplastic resin of each layer may be identical or otherwise miscible with the base thermoplastic resin of one or more of the directly abutting layers. In this manner, in one configuration, at least a plurality of the layers may be separately formed and then collectively fused together through the application of heat and pressure, such as with a compression molding process.

Figure 20:
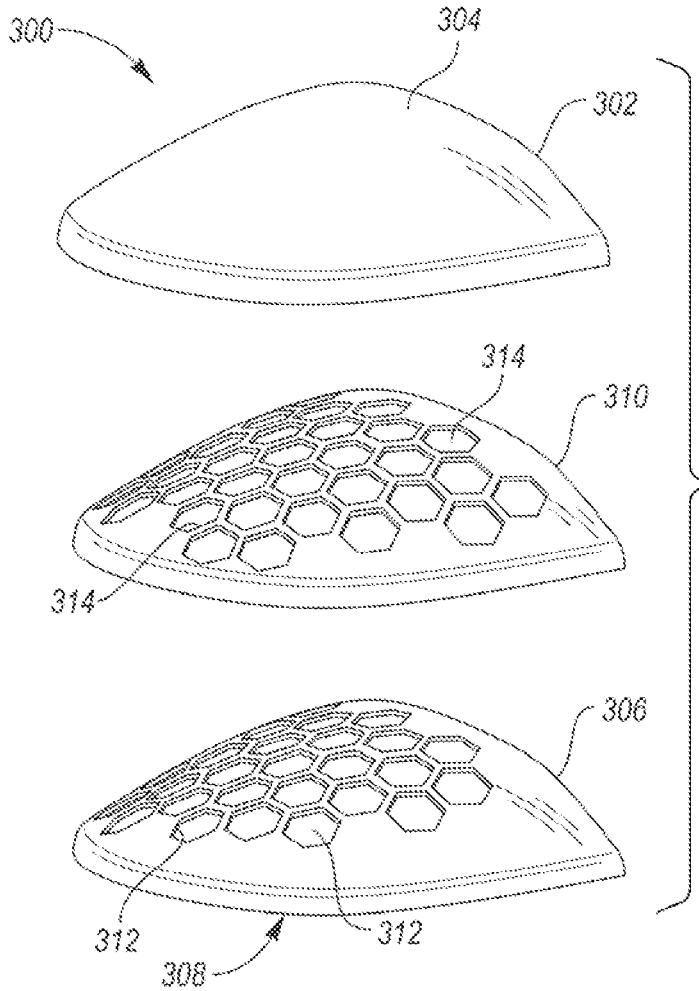
FIG. 20 is a schematic exploded view of a portion of a multi-layer thermoplastic crown.
Figure 21:
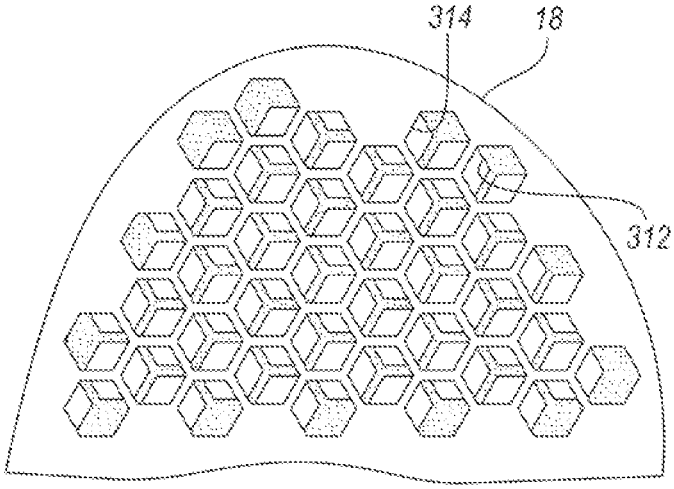
FIG. 21 is a schematic top view of the multi-layer thermoplastic crown of FIG. 20.

FIG. 20 illustrates an example of such a laminate construction as may be used with a crown 18 (though such a design may likewise be capable of being used in a sole). As shown via the exploded view 300, the crown 18 comprises three layers, with a first layer 302 forming a portion of the outer surface 304, a second layer 306 forming a portion of the inner surface 308, and a third layer 310 disposed between the first and the second layers 302, 306. In this embodiment, the first layer 302 is solid throughout and comprises no apertures. The second layer 306 comprises a first plurality of hexagonal-shaped apertures 312 spanning a majority of the crown 18. The third layer 310 comprises a second plurality of hexagonal-shape apertures 314 spanning a majority of the crown 18, though offset from the positioning of the first plurality of hexagonal-shaped apertures 312 when the layers are nested together, such as shown in FIG. 21. One or both of the second layer 306 and third layer 310 may comprise a filled thermoplastic. Likewise, one or both of the second layer 306 and the third layer 310 may comprise a fabric reinforced composite. If an FRC is employed, it is preferable for each of the reinforcing fibers to extend around the apertures 312, 314 rather that terminating at the aperture as if the apertures were cut into a pre-formed sheet. Further explaining the benefits of thermoplastics, each layer shown in FIG. 20 may be individually formed and fully hardened in a dimensionally stable manner before stacking within a compression mold that essentially welds the layers together across the entire surface by heating each layer to a temperature above its respective glass transition temperature. Doing so may enable complex 3D material structures to be engineered by forming and reforming each layer individually and/or collectively multiple times.

Figure 22:
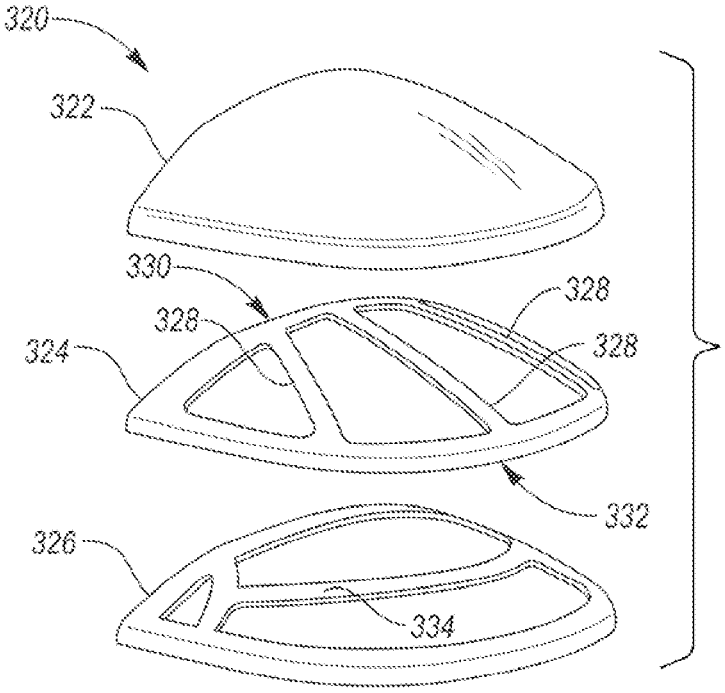
FIG. 22 is a schematic exploded view of a portion of a multi-layer thermoplastic crown.
Figure 23:
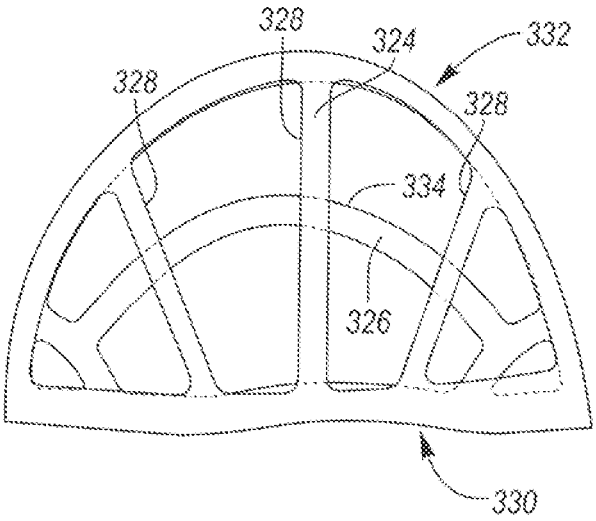
FIG. 23 is a schematic top view of the multi-layer thermoplastic crown of FIG. 22.

Further expanding on the concept of engineered material structures, FIGS. 22 and 23 illustrate an embodiment similar to that shown in FIGS. 20-21, though the designs of the different layers are made to serve different specific purposes. As shown, FIG. 22 illustrates an exploded (or pre-assembled) view of a crown member 320 that includes a first, outer layer 322, a second, middle layer 324, and a third, bottom layer 326. The first layer 322 is substantially solid, such as in the design of FIG. 20. The second layer 324 includes a plurality of struts 328 that extend between a forward portion 330 of the crown member, and a rear portion 332 of the crown member 320. These struts 328 are operative to stiffen the crown in a front-rear dimension. The third layer 326 then includes at least one strut 334 that extends laterally across the crown member 320 to stiffen the crown in a heel-toe direction.

While FIG. 22 demonstrates one embodiment of using the individual layer structures to achieve different structural design objectives, in some embodiments, the layers may be used to strategically alter weight performance as well. For example, different layers may have different densities (e.g., through the use of different density fillers or fabric reinforcements), and may be included solely to affect the location of the center of gravity or the moment of inertia. To this effect, each layer may have a different layer-specific center of gravity that is located in a different location within the layer than other layer-specific centers of gravity. Likewise, some layers may serve as "structural layers" and may provide an optimized structural design, while other layers may serve as "mass layers" that may be used to alter the placement of the center of gravity of the club head. In some embodiments, the mass layers may be doped with a metallic filler such as tungsten. Mass layers may be particularly suited for use in the sole, where additional mass may serve the functional purpose of moving the center of gravity of the club head rearward and down. An example of the structure of a mass layer may include a layer where apertures are concentrated in the forward portion of the layer, while the rear portion is devoid of apertures.

FIGS. 24-31 each illustrate different lamina layer design embodiments that may have functional characteristics and that may be used alone or in combination with other ones of the illustrated designs or solid layers to form a crown 18 or sole 20. If solid layers are used, they may comprise fabric reinforced composites, filled thermoplastics, or unfilled thermoplastics. In some embodiments, the laminate may comprise a plurality of unidirectional fabric reinforced composite layers, each provided at a different relative orientation (i.e., where the longitudinal axis of the fibers are rotated relative to abutting layers when viewed from a plan view).

Figure 24:
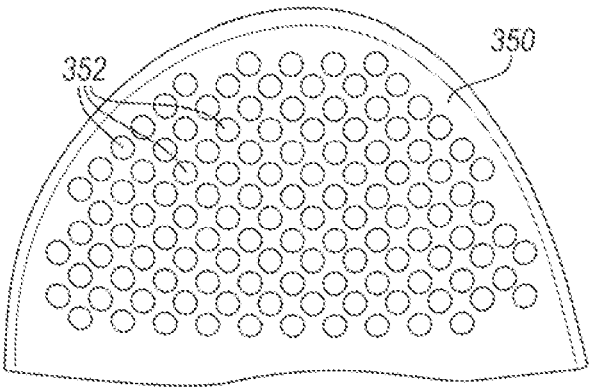
FIG. 24 is a schematic top view of a layer of a multi-layer thermoplastic crown or sole having a plurality of apertures.

FIG. 24 provides one embodiment of a fiber reinforced laminate layer 350 that may be used in the formation of a portion of the crown 18 or sole 20. As shown, the layer 350 can comprise a plurality of apertures 352, wherein the apertures 352 each have a circular shape. The apertures 352 can be positioned throughout the entire surface of the layer 350. Such apertures 352 may be similar to those described in U.S. Pat. No. 9,776,052, which is incorporated by reference in its entirety.

Figure 25:
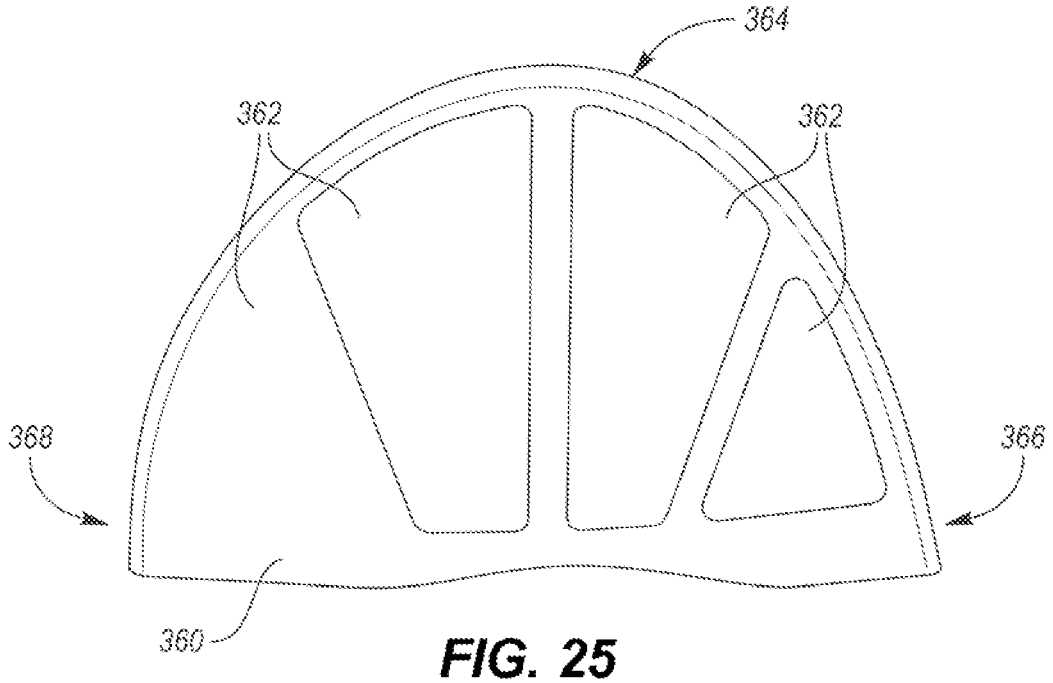
FIG. 25 is a schematic top view of an embodiment of a layer of a multi-layer thermoplastic crown or sole having a plurality of apertures.

FIG. 25 is another embodiment of a fiber reinforced laminate layer 360 that may be used in the formation of a portion of the crown 18 or sole 20. As shown, the layer 360 can comprise a plurality of apertures 362, including four apertures 362 extending from near the strikeface 30 toward the trailing edge 364. The apertures include a first aperture positioned near the heel end 366, a second aperture positioned near the toe end 368, a third aperture positioned between the first and second apertures, and a fourth aperture positioned between the third aperture and the second aperture, wherein the first and second aperture comprise a triangular shape, while the third and fourth aperture comprise a trapezoidal shape.

Figure 26:
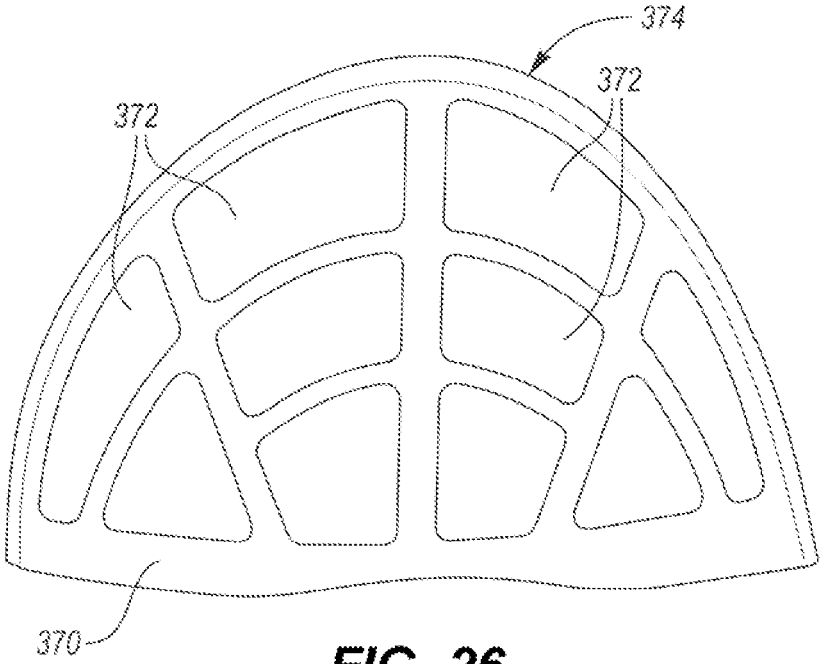
FIG. 26 is a schematic top view of an embodiment of a layer of a multi-layer thermoplastic crown or sole having a plurality of apertures.

FIG. 26 is another embodiment of a fiber reinforced laminate layer 370 that may be used in the formation of a portion of the crown 18 or sole 20. As shown, the layer 370 can comprise a plurality of apertures 372 that includes a first, second, third and fourth aperture near the strikeface 30, positioned in a heel-toe direction, a fifth, sixth, seventh, and eighth aperture near the trailing edge 374, positioned in a heel-toe direction, and a ninth and tenth aperture centered, positioned in between the first through eighth apertures.

Figure 27:
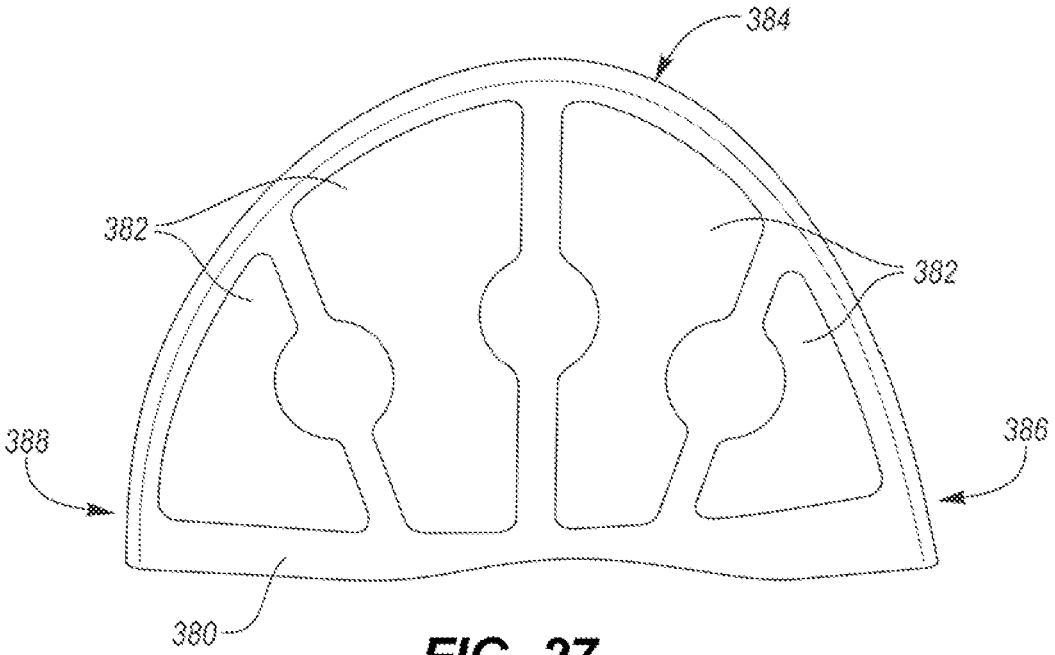
FIG. 27 is a schematic top view of an embodiment of a layer of a multi-layer thermoplastic crown or sole having a plurality of apertures and weighted portions.

FIG. 27 is another embodiment of a fiber reinforced laminate layer 380 that may be used in the formation of a portion of the crown 18 or sole 20. As shown, the layer 380 can comprise a plurality of apertures 382 that includes four apertures 382 extending from near the strikeface 30 toward the trailing edge 384, having a first aperture positioned near the heel end 386, a second aperture positioned near the toe end 388, a third aperture positioned between the first and second apertures, and a fourth aperture positioned between the third aperture and the second aperture, wherein the material between the first, second, third, and fourth apertures comprise a circular shape such that the first, second, third and fourth apertures comprise a skewed polygonal shape. In some embodiments, these circular portions may be used to alter one or more mass properties of the layer and/or the club head in general.

Figure 28:
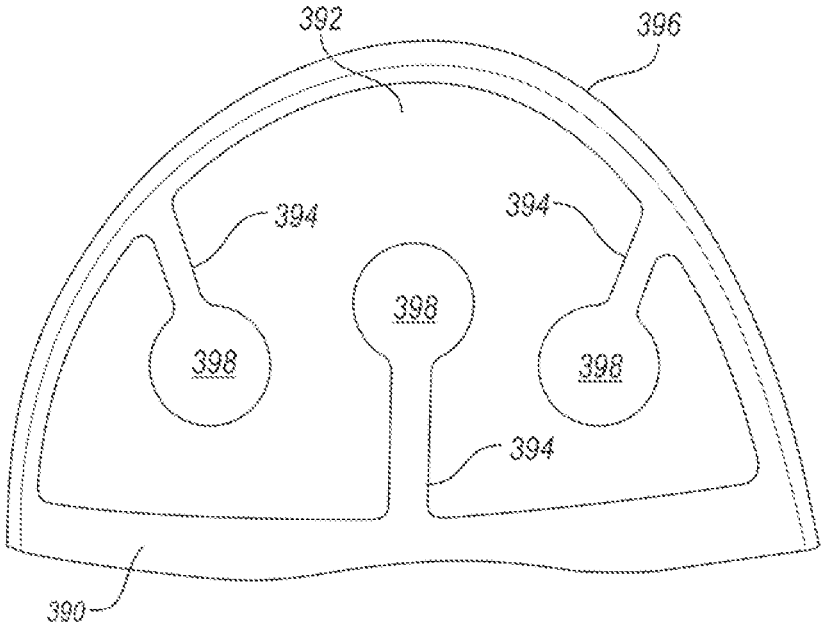
FIG. 28 is a schematic top view of an embodiment of a layer of a multi-layer thermoplastic crown or sole having an aperture and a plurality of weighted portions.

FIG. 28 illustrates another embodiment a fiber reinforced laminate layer 390 that may be used in the formation of a portion of the crown 18 or sole 20. As shown, the layer 390 can comprise an aperture 392 having a plurality of material portions 394 extending from the perimeter 396 of the layer 390 toward the center. In material portion 394 may include an enlarged mass portion 3986 at the distal end of the material portion 394 for the purpose of altering one or more mass properties of the layer 390 and/or the club head in general.

Figure 29:
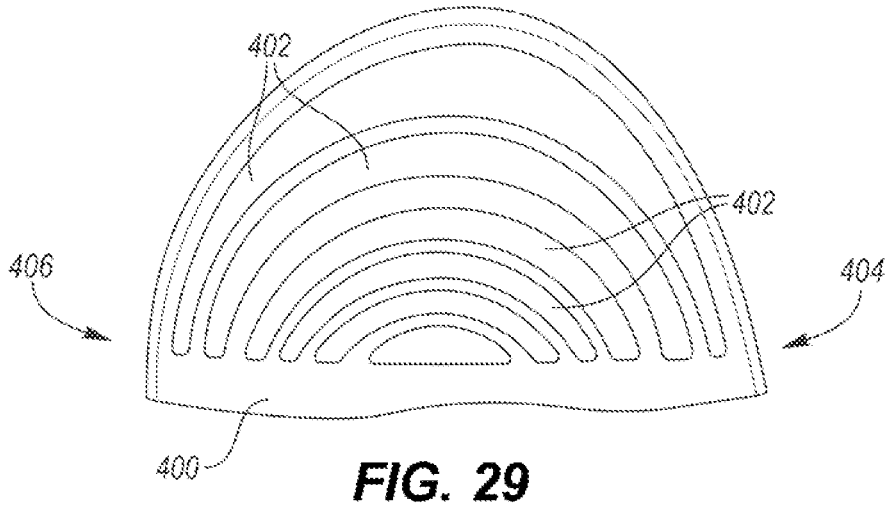
FIG. 29 is a schematic top view of an embodiment of a layer of a multi-layer thermoplastic crown or sole having a plurality of apertures.

FIG. 29 is another embodiment of a fiber reinforced laminate layer 400 that may be used in the formation of a portion of the crown 18 or sole 20. As shown, the layer 400 can comprise a plurality of apertures 402 that includes six apertures, with a first aperture closest to the strike face, and each consecutive aperture (i.e., second, third, fourth, fifth and sixth aperture) are positioned adjacent to one another in a direction toward the rear of the golf club head 10. Each aperture 402 comprises an arc like stripe shape, extending from a heel end 404 to the to end 406 in a arcuate manner.

Figure 30:
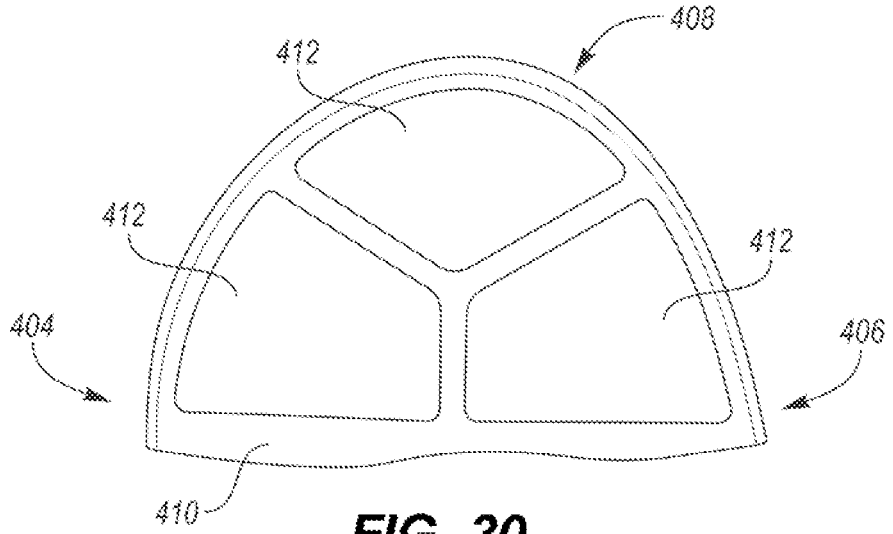
FIG. 30 is a schematic top view of an embodiment of a layer of a multi-layer thermoplastic crown or sole having a plurality of apertures.

FIG. 30 is another embodiment of a fiber reinforced laminate layer 410 that may be used in the formation of a portion of the crown 18 or sole 20. As shown, the layer 410 can comprise a plurality of apertures 412 that includes three apertures, with a first aperture positioned near the strike face on a toe end 404, a second aperture positioned near the strikeface on a heel end 406, and a third aperture positioned near the rear 408, in between the heel and toe ends 406, 404. The material partitioning the three apertures then may form a Y-shape.

Figure 31:
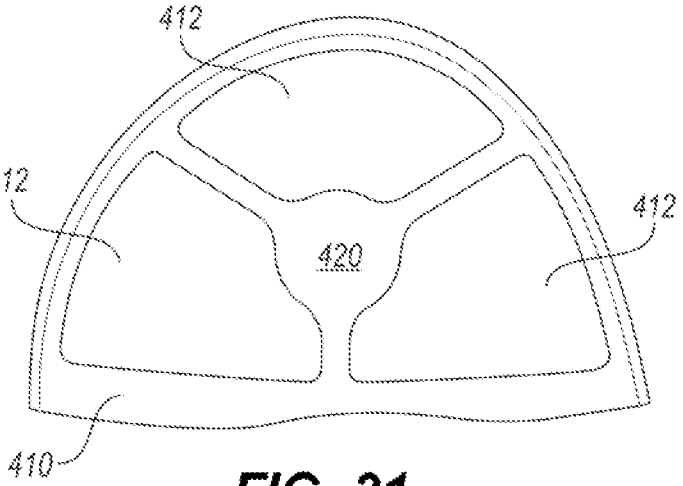
FIG. 31 is a schematic top view of an embodiment of a layer of a multi-layer thermoplastic crown or sole having a plurality of apertures and a weighted portion.

FIG. 31 then illustrates an embodiment similar to that in FIG. 30, though with the inclusion of a mass portion 420 in the center of the layer (at the intersection of each arm of the "Y-shape." In this manner, mass portions may be included with any of the example layers shown in FIGS. 24-30, and such mass portions are not limited to only circular portions, but rather can take any shape.

Figure 32:
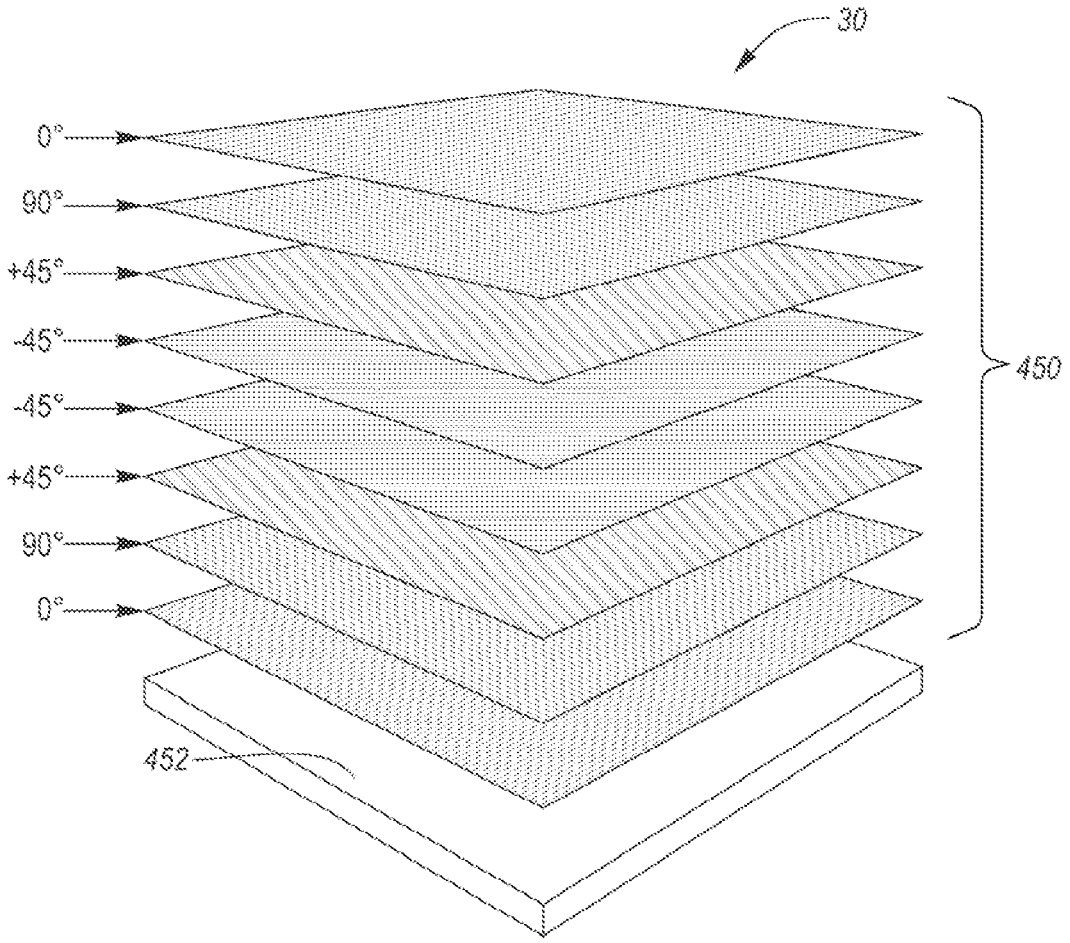
FIG. 32 is a schematic partial exploded view of a thermoplastic composite strike face having a plurality of unidirectional fabric reinforced composite layers and a filled or unfilled thermoplastic layer.

In a similar manner as illustrated with the crown/sole in FIGS. 20-31, the strike face 30 may comprise a plurality of lamina layers, where at least two of the layers are integrally fused through a compression molding operation. In one configuration, such as shown in FIG. 32, the strike face 30 may comprise a plurality of unidirectional fabric reinforced thermoplastic composite layers 450, with each layer being rotated relative to adjacent layers. Each layer may include a common base thermoplastic resin that, when collectively heated above the glass transition temperature of the polymer, will fuse with the polymer of the abutting layers. In some embodiments, the strike face 30 may further include a filled or unfilled thermoplastic layer 452 that may be pre-formed and compression molded together with the FRC layers 450, or may be injection molded into contact with the fused FRC layers, for example, through an insert injection molding process. Forming such a layup/laminate with thermoplastics used as the resin matrix has proven to provide a more repeatable layup while providing desirable weight savings and coefficients of restitution. Three examples of stacking sequences that have proven to have suitable strength properties are illustrated in Table 1, below:

| Layers | Nominal Thickness of Laminate | Stacking Sequence |
|---|---|---|
| 8 | 0.048 | 0/90/45/−45/−45/45/90/0 |
| 16 | 0.096 | 0/90/45/−45/−45/45/90/0/0/90/45/−45/−45/45/90/0 |
| 24 | 0.144 | 0/90/45/−45/−45/45/90/0/0/90/45/−45/ −45/45/90/0/0/90/45/−45/−45/45/90/0 |

Figure 33:
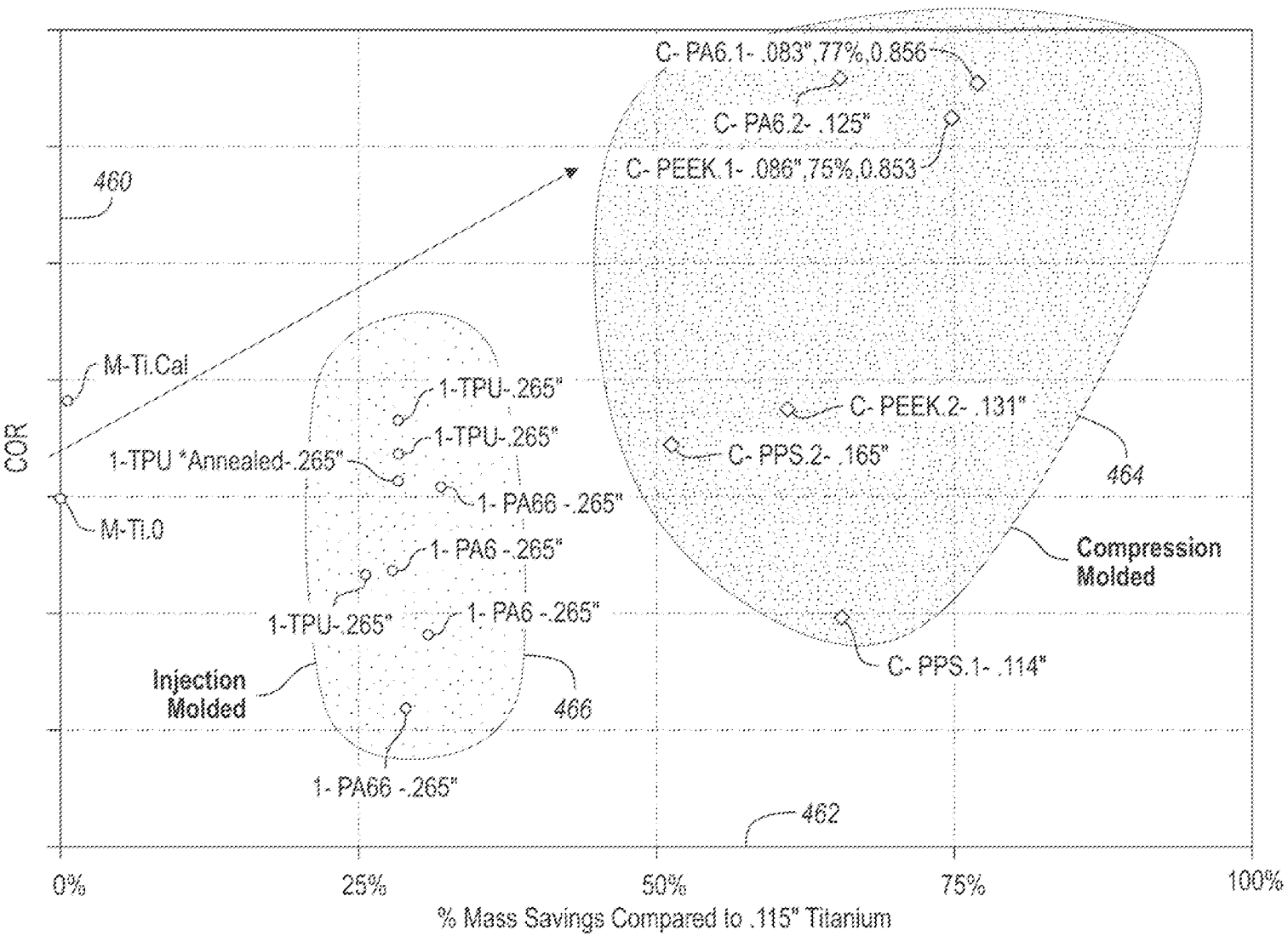
FIG. 33 is a schematic graph illustrating the coefficient of restitution and relative weight savings over titanium for a plurality of different polymers and methods of manufacturing polymeric strike faces.

FIG. 33 illustrates how different injection molded composites perform both in terms of relative coefficient of restitution (COR) 460 and in terms of relative weight savings 462 when compared with a titanium metal face. As can be seen, compression molded fabric reinforced composites 464 tend to be lighter and can have a greater COR than neat injection molded variants 466 of similar polymers. Due to the lower percentage of resin in the compression molded layers, however, the compression molded composites, however, tend to be comparatively more brittle than the illustrated injection molded variants. As such, in some design embodiments, a combination of the two may ultimately provide the most desirable results with the best balance of strength and resiliency.

As mentioned above, different mixed materials or compounds/elements can form each of these lamina layers within the crown 18, sole 20, and/or strike face 30. The different lamina layers may share a common matrix polymer (i.e., the same thermoplastic polymer in each lamina layer), and either the same or different reinforcement elements or compounds per lamina layer. The different lamina layers may share a common derivative matrix polymer that is not chemically the same, but is miscible to each other. For example, one lamina layer could be a thermoplastic polymer that is one chemical compound, and the next lamina layer is another thermoplastic compound that is a different chemical formula from the thermoplastic compound of the lamina layer above, but shares enough chemical structure, 3D shape, and chemical properties to be miscible with the thermoplastic layer above. Each of the reinforcement element or compound can be the same or different in these "miscible" thermoplastic lamina layers. The different lamina layer can also share a thermoplastic resin that is common with each layer, but each lamina layer can have the same or different matrix polymer and/or reinforcement element/compound.

The combination of the matrix polymer and reinforcement element (fabric or fiber fill) allows for the end product to comprise advantages of both the matrix polymer and the reinforcement element. Also, the matrix polymer having reinforcement elements shrink less than unfilled resins/polymers when subjected to any form of heat molding, thereby improving the dimensional control of molded parts and reduce the cost of composites. In many embodiments, the matrix polymer of the crown/sole member's 24/26 can be polycarbonate (PC), polyphenylene sulfide (PPS), polypropylene (PP), Nylon-6 (PA6), Nylon 6-6 (PA66), Nylon-12 (PA12), Polymethylpentene (TPX), polyvinylidene fluoride (PVDF), polymethylmacylate (PMMA), poly ether ketone (PEEK), polyetherimide (PEI), or polyether ketone (PEK).

The materials of, for example, the matrix polymer of the crown 18, sole 20, and/or strike face 30 each may be selected and/or formed to achieve one or more material properties such as tensile strength, tensile modulus, and density. The matrix polymer of the crown, sole, and/or strike face can comprise a tensile strength ranging from 30 MPa to 3000 MPa. In some embodiments, the tensile strength of the matrix polymer can range from 30 MPa to 500 MPa, 500 MPa to 1000 MPa, 1000 MPa to 1500 MPa, 1500 Pa to 2000 MPa, 2000 MPa to 2500 MPa, 2500 MPa to 3000 MPa, 30 MPa to 1500 MPa, 1500 MPa to 3000 MPa, 500 MPa to 2500 MPa, 30 MPa to 1000 MPa, 1000 MPa to 2000 MPa, or 2000 MPa to 3000 MPa. In some embodiments, the tensile strength of the crown, sole, and/or strike face's matrix polymer can be 30 MPa, 200 MPa, 400 MPa, 800 MPa, 1200 MPa, 1600 MPa, 2000 MPa, 2400 MPa, 2800 MPa, or 3000 MPa.

The matrix polymer of the crown, sole, and/or strike face can comprise a tensile modulus ranging from 1.5 GPa to 12 GPa. In some embodiment, the tensile modulus can range from 1.5 GPa to 6 GPa, 6 GPa to 12 GPa, 1.5 GPa to 3 GPa, 3 GPa to 6 GPa, 6 GPa to 9 GPa, or 9 GPa to 12 GPa. In some embodiments, the matrix polymer of the crown, sole, and/or strike face can have a tensile modulus of 1.5 GPa, 2 GPa, 3 GPa, 4 GPa, 5 GPa, 6 GPa, 7 GPa, 8 GPa, 9 GPa, 10 GPa, 11 GPa, or 12 GPa.

The matrix polymer of the crown, sole, and/or strike face can comprise a density ranging from 0.80 g/cm$^3$ to 1.80 g/cm$^3$. In some embodiments, the density can range from 0.80 g/cm$^3$ to 1.3 g/cm$^3$, 1.3 g/cm$^3$ to 1.8 g/cm$^3$, 1.0 g/cm$^3$ to 1.6 g/cm$^3$, 0.8 g/cm$^3$ to 1.1 g/cm$^3$, 1.1 g/cm$^3$ to 1.5 g/cm$^3$, 1.5 g/cm$^3$ to 1.8 g/cm$^3$, 0.8 g/cm$^3$ to 1.0 g/cm$^3$, 1.0 g/cm$^3$ to 1.2 g/cm$^3$, 1.2 g/cm$^3$ to 1.4 g/cm$^3$, 1.4 g/cm$^3$ to 1.6 g/cm$^3$, or 1.6 g/cm$^3$ to 1.8 g/cm$^3$. In some embodiments, the matric polymer of the crown/sole can have a density of 0.8 g/cm$^3$, 0.9 g/cm$^3$, 1.0 g/cm$^3$, 1.1 g/cm$^3$, 1.2 g/cm$^3$, 1.3 g/cm$^3$, 1.4 g/cm$^3$, 1.5 g/cm$^3$, 1.6 g/cm$^3$, 1.7 g/cm$^3$, or 1.8 g/cm$^3$.

The reinforcement fabrics/fibers embedded within one or more of the crown, sole, and/or strike face may be carbon fiber, aramid fibers (e.g., Nomex, Vectran, Kevlar, Twaron), bamboo fiber, natural fiber (e.g., cotton, hemp, flax), glass fibers, glass beads, metal fibers (e.g., Ti, Al), ceramic fibers (e.g., TiO2), and granite, SiC). The materials of such reinforcement fabrics/fibers within the crown, sole, and/or strike face comprises material properties such as tensile strength, tensile modulus and density. In some embodiments, the tensile strength of the crown, sole, and/or strike face's reinforcement elements range from 300 MPa to 7000 MPa. In some embodiments, the tensile strength of the reinforcement elements can range from 300 MPa to 4000 MPa, 4000 MPa to 7000 MPa, 2000 MPa to 5500 MPa, 300 MPa to 2000 MPa, 2000 MPa to 3500 MPa, 3500 MPa to 5000 MPa, 5000 MPa to 7000 MPa, 300 MPa to 1500 MPa, 1500 MPa to 2500 MPa, 2500 MPa to 3500 MPa, 3500 MPa to 4500 MPa, 4500 MPa to 5500 MPa, or 5500 MPa to 7000 MPa. In some embodiments, the reinforcement elements of the crown, sole, and/or strike face can have a tensile strength of 300 MPa, 1000 MPa, 1500 MPa, 2000 MPa, 2500 MPa, 3000 MPa, 3500 MPa, 4000 MPa, 4500 MPa, 5000 MPa, 5500 MPa, 6000 MPa, 6500 MPa, or 7000 MPa.

In some embodiments, the tensile modulus of the crown, sole, and/or strike face's reinforcement elements range from 30 GPa to 700 GPa. In some embodiments, the tensile modulus of the reinforcement elements can range from 30 GPa to 400 GPa, 400 GPa to 700 GPa, 200 GPa to 550 GPa, 30 GPa to 200 GPa, 200 GPa to 350 GPa, 350 GPa to 500 GPa, 500 GPa to 700 GPa, 30 GPa to 150 GPa, 150 GPa to 250 GPa, 250 GPa to 350 GPa, 350 GPa to 450 GPa, 450 GPa to 550 GPa, or 550 GPa to 700 GPa. In some embodiments, the reinforcement elements of the crown, sole, and/or strike face can have a tensile Modulus of 30 GPa, 100 GPa, 150 GPa, 200 GPa, 250 GPa, 300 GPa, 350 GPa, 400 GPa, 450 GPa, 500 GPa, 550 GPa, 600 GPa, 650 GPa, or 700 GPa.

In some embodiments, the density of the reinforcement elements of the crown, sole, and/or strike face range from 0.75 g/cm$^3$ to 10 g/cm$^3$. In some embodiments, the density of the reinforcement elements can range from 1 g/cm$^3$ to 5 g/cm$^3$. In some embodiments, the reinforcement elements of the crown, sole, and/or strike face can be 1.8 kg/mm$^2$, 200 kg/mm$^2$, 400 kg/mm$^2$, 600 kg/mm$^2$, 800 kg/mm$^2$, 1000 kg/mm$^2$, 1200 kg/mm$^2$, 1400 kg/mm$^2$, 1600 kg/mm$^2$, 1800 kg/mm$^2$, 2000 kg/mm$^2$, or 2200 kg/mm$^2$.

Figure 34:
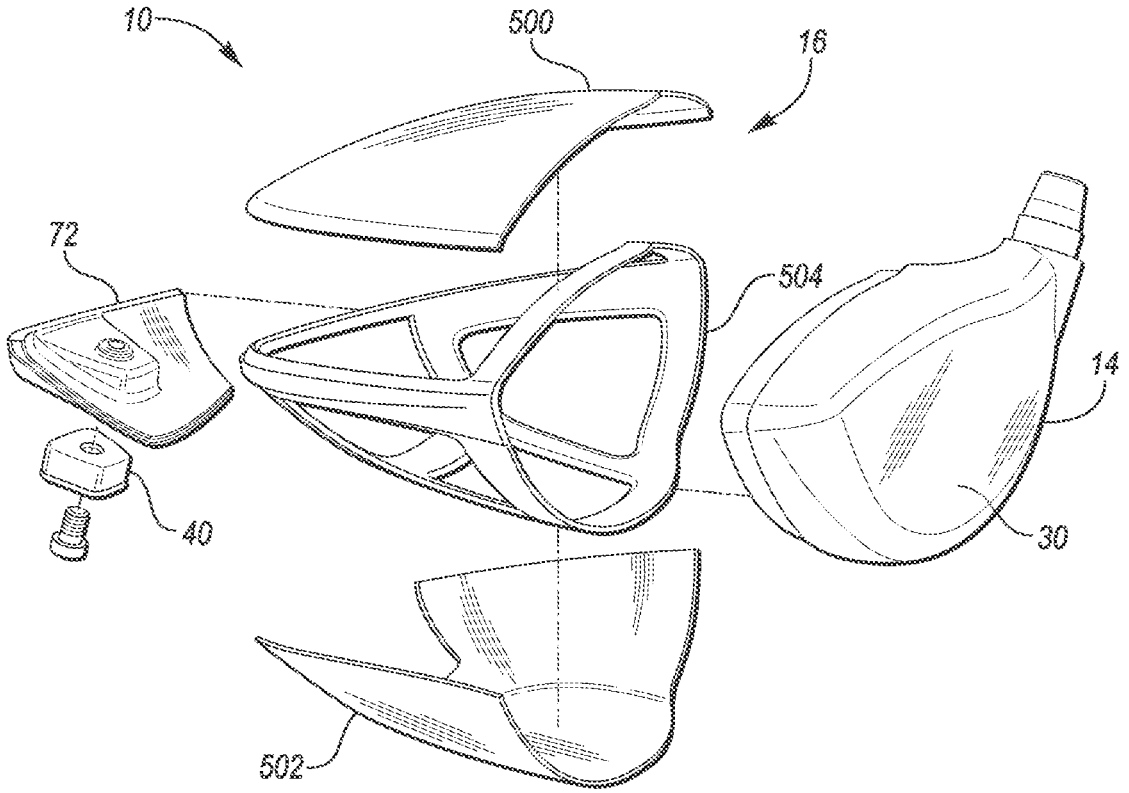
FIG. 34 is a schematic exploded perspective view of an embodiment of a mixed material club head.
Figure 35:
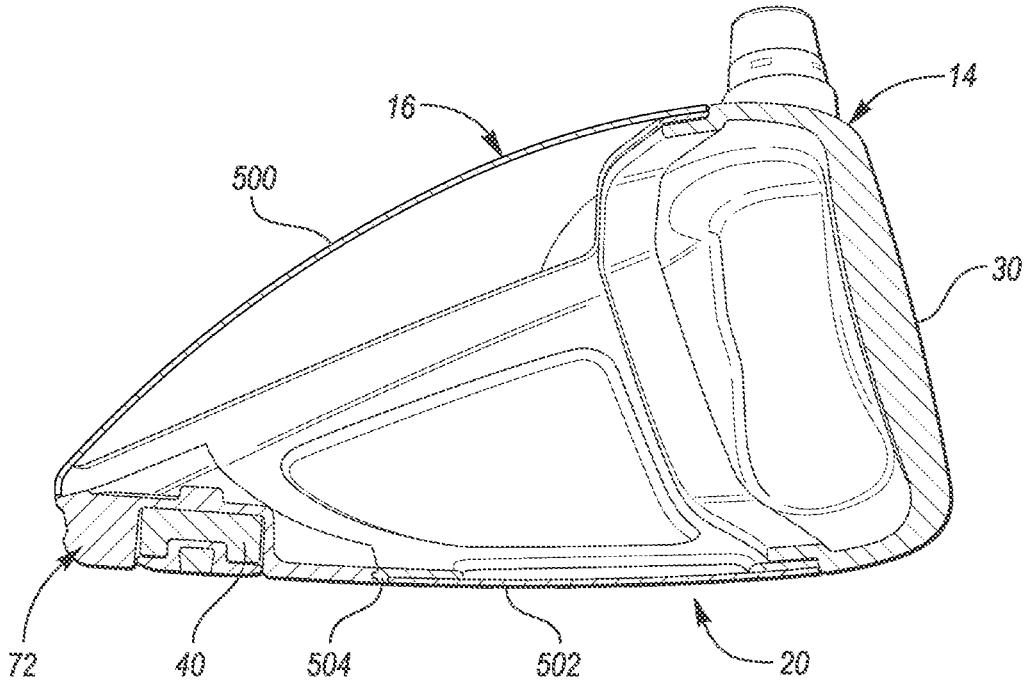
FIG. 35 is a schematic cross-sectional view of an embodiment of a mixed material club head, such as shown in FIG. 34, taken along a mid-plane of the club head.

FIGS. 34-35 illustrate an additional embodiment of a club head 10 that may be constructed, at least in part, according to the teachings above. As shown, the golf club head 10 includes a front body 14 and a rear body 16 that are secured together to define a substantially closed/hollow interior volume. In some embodiments, the front body 14 may be formed from metal (e.g., a titanium alloy or steel alloy). In other embodiments, however, at least a portion of the front body 14, including the strike face 30, may be formed from a filled thermoplastic and/or a fiber reinforced composite. In some embodiments, the front body 14 may be constructed as described above and/or illustrated in any of FIGS. 11-18.

The rear body 16 may generally be formed from a fabric reinforced thermoplastic composite crown member 500 forming at least a portion of the crown 18, a fabric reinforced thermoplastic composite sole member 502 forming at least a portion of the sole 20, and a filled or unfilled thermoplastic supporting structure 504 that supports one or both of the FRC crown member 500 or FRC sole member 502. In some embodiments, the thermoplastic supporting structure 504 may include a plurality of discontinuous reinforcing fibers and/or a metallic fill (e.g., a powder) embedded within a thermoplastic resin. In a preferred embodiment, the thermoplastic resin of the supporting structure 504 is the same or otherwise miscible with the thermoplastic resin used to form both the FRC crown member 500 and the FRC sole member 502. In this manner, the crown and sole members 500, 502 may be joined to the supporting structure 504 using direct bonding and without the need for intermediate adhesives.

FIG. 34 further illustrates the weighted portion 72 exploded out from the supporting structure 504. In some embodiments, the weighted portion 72 may comprise a metal section that is adapted to receive one or more removable and/or fixed weights. In one embodiment, the weighted portion 72 may comprise a steel alloy that is adapted to receive one or more fixed or removable weights 40 comprising tungsten. In some embodiments, at least a portion of the weighted portion 72 may be mechanically engaged with the supporting structure 504 through, for example, an insert injection molding process.

In embodiments where the front body 14 and rear body 16 are formed primarily using thermoplastic composite materials, it has been found that the club head moments of inertia and total mass both drop rather substantially. More specifically, switching to this particular thermoplastic construction provides a design that is about 60 to about 100 grams lighter than conventional driver heads, which generally weigh between about 200 grams and about 210 grams. In order to maintain a constant swing weight with improved moments of inertia (i.e., resistance to club head twisting during off-center impacts), it is desirable to incorporate this mass back into the club head in the form of discretionary, placed mass.

In some embodiments, it may be desirable to locate at least a portion of the discretionary mass toward a forward portion of the club head. In some embodiments, it has been found that the use of a forwardly located mass provides a more stable and balanced club head. More particularly, it has been discovered that if the center of gravity is pushed rearward beyond approximately the geometric center where the club head, the club head may become unstable, particularly during the deceleration phase of the swing near impact. This concern has not arisen with traditional metal constructions due to the structural mass maintained in the forward regions of the club head. With the low density of polymers, and the increase in discretionary mass, however, it is a concern that must be accounted for in the design or placement of discretionary mass.

Figure 36:
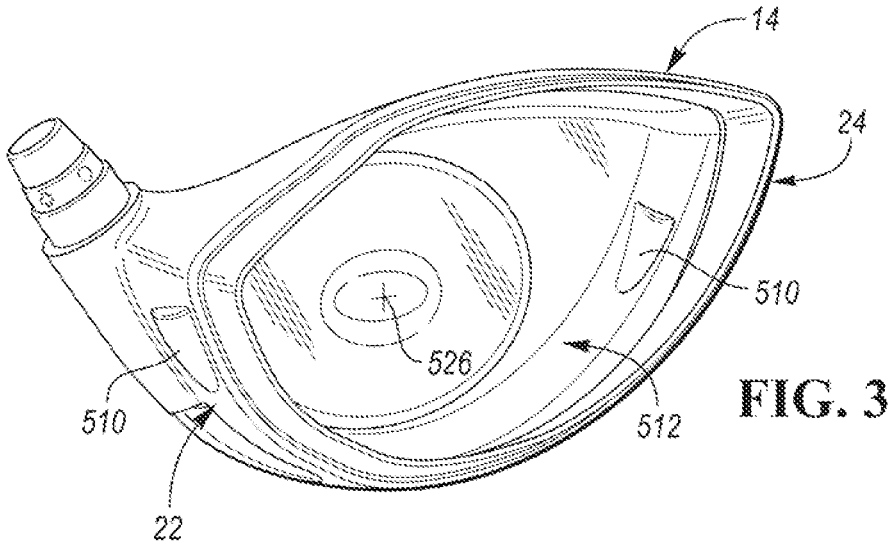
FIG. 36 is a schematic perspective view of an embodiment of a thermoplastic composite front body of a golf club head with integrated weighting.
Figure 37:
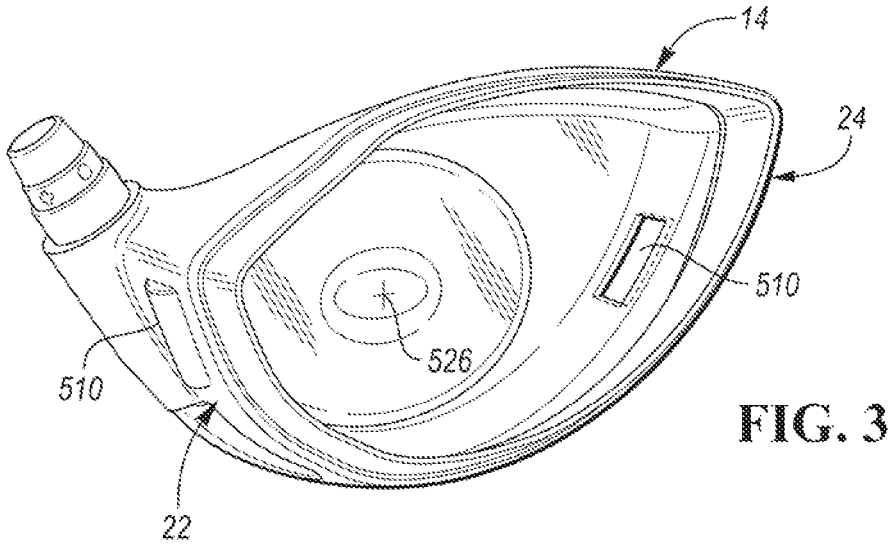
FIG. 37 is a schematic perspective view of an embodiment of a thermoplastic composite front body of a golf club head with integrated weighting.
Figure 38:
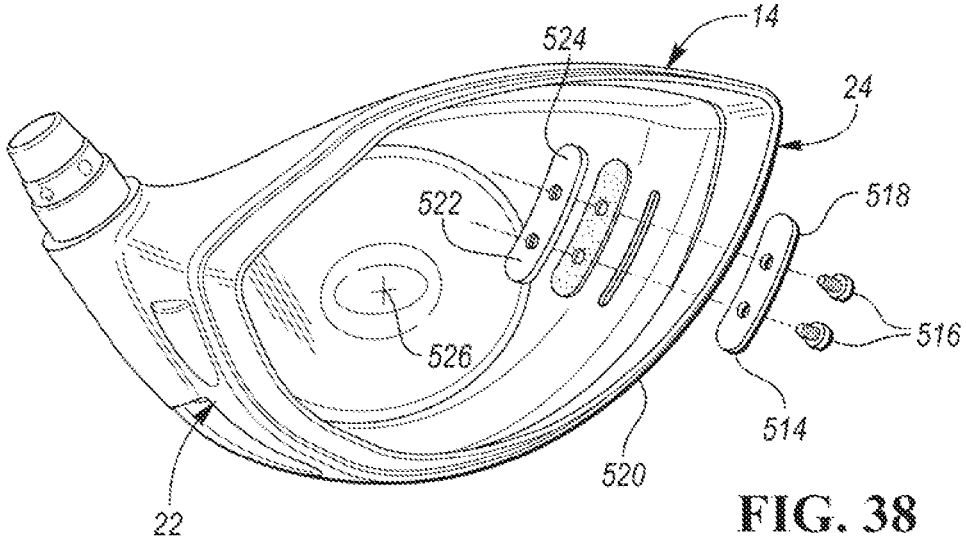
FIG. 38 is a schematic perspective view of an embodiment of a thermoplastic composite front body of a golf club head with affixed weighting.

FIGS. 36-38 illustrate three embodiments of a front body 14 that is similar to that shown in FIG. 34. Each embodiment provides a different means of placing discretionary mass in the toe portion 24 and/or the heel portion 22 of the front body 14. FIG. 36 illustrates an embodiment of a thermoplastic composite front body 14 where mass pockets 510 are molded into an internal portion 512 of the front body 14. Each mass pocket 510 may comprise a heavy metal such as lead, tungsten, or bismuth that is over-molded or encapsulated by a portion of the front body 14. In one embodiment, to prevent the occurrence of unnecessary stress risers created at the boundary between the metal and the polymer, the metal may be integrated as a filler into a thermoplastic resin that is misable with the resin used to form the surrounding FT and/or FRC. In such an embodiment, the metal filler may form up to about 90%, or up to about 80%, or up to about 70%, or up to about 60% by volume of the weighted slug incorporated into the mass pocket 510. In doing so, when the metal-filled polymer is over-molded, the abutting thermoplastic resins may form a stronger surface bond than a polymer to pure metal interface.

FIG. 37 illustrates a different embodiment of the design shown in FIG. 36. Finally, FIG. 38 illustrates a design where the forward weights 514 in the front body 14 are at least partially mechanically affixed, such as through the use of one or more screws 516. In one embodiment of such a design, an outer weight 518 may be affixed to an outer surface 520 of the club head, while an inner weight 522 may cooperate with the outer weight 518 to sandwich a portion of the club head wall. Both the inner weight 522 and the outer weight 518 may be formed from metal in an effort to most affect the location of the club head center of gravity. In one embodiment, the outer weight 518 may resemble a naming badge or applique. In some embodiments, the inner weight 522 may be at least partially separated from the club head wall via a gasket 524. In one embodiment, each of the weights shown in FIGS. 36-38 may be vertically aligned with the geometric center 526 of the face. In other embodiments, the weights may be located below the center of the face to help pull the center of gravity lower, which would generally result in a higher ball trajectory.

Figure 39:
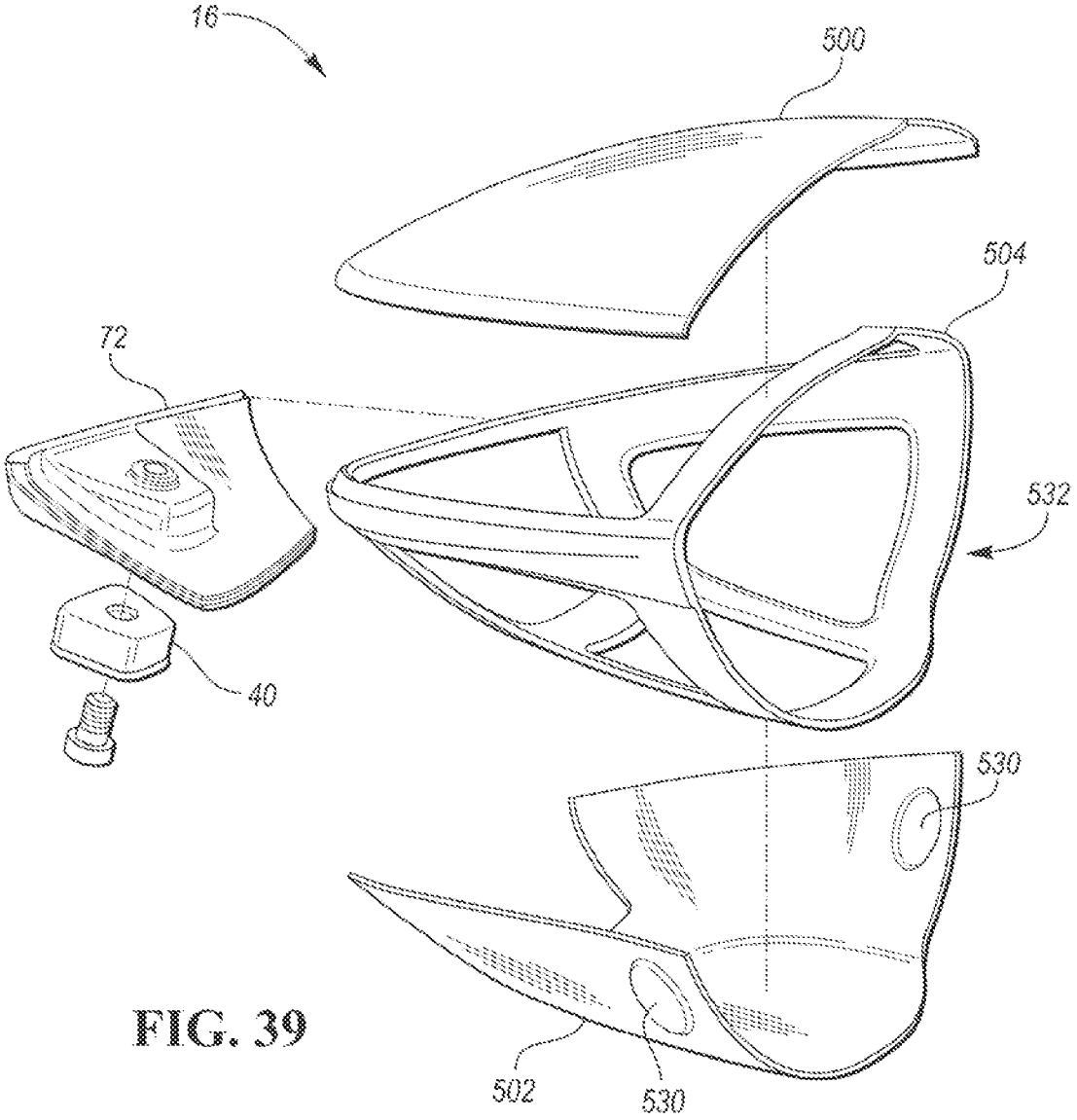
FIG. 39 is a schematic exploded perspective view of a thermoplastic composite rear body of a golf club head with weighting integrated into a forward portion of a laminate fabric reinforced composite sole member.
Figure 40:
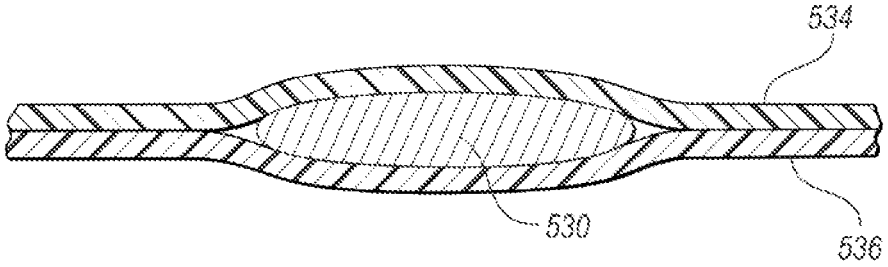
FIG. 40 is a schematic cross-sectional view of a weight member integrated between two fabric reinforced composite sheets.

FIG. 39 illustrates an embodiment of a rear body 16 design that integrates a weight 530 in one or more forward portions 532 of the FRC crown member 500 or FRC sole member 502. As shown in the cross-sectional view in FIG. 40, in one embodiment, these weights 530 may be encapsulated between two adjacent fabric-reinforced lamina layers 534, 536 used to form the sole member 502. Similar to the design described above, in one embodiment, to prevent the occurrence of unnecessary stress risers created at the boundary between the weight 530 and the polymer of the FRC lamina layers 534, 536, the metal may be integrated as a filler into a thermoplastic resin element having a polymeric resin that is misable with the resin used to form the surrounding FRC layers. In such an embodiment, the metal filler may be from about 30% to about 90% by volume of the weight 530, alternatively, it may be from about 60% to about 80% by volume, or even about 65% to about 75% by volume of the weighted element. In some embodiments, the weight 530 may have a specific gravity of greater than about 8, or greater than about 9, or greater than about 10. In one particular embodiment the weight 530 may comprise a 70% tungsten filler in a 30% thermoplastic resin (by volume), and may have a specific gravity in the range of about 12.5 to about 14.0. In these embodiments, when the metal-filled polymer is over-molded, the abutting thermoplastic resins may bond with the similar resins used to form the weight, thus reducing any boundary layer stresses that may form.

It has been found that in some designs, the face thickness and density can provide sufficient forward weighting to avoid the need for additional forward metallic weights. In one embodiment, the forward weighting was found to not be required if the maximum thickness of the variable thickness strikeface was from about 5.0 mm to about 9.0 mm, or from about 6.0 mm to about 8.0 mm, with the perimeter thickness of from about 3.0 mm to about 5.0 mm, or from about 3.5 mm to about 4.5 mm. In one embodiment, forward metallic weights were not required when the maximum face thickness was about 7.25 mm and the surrounding perimeter face thickness was about 4.45 mm.

In one embodiment that utilizes no added forward metallic mass, all of the discretionary mass may be added to the club head in the form of a tungsten or other dense metal weight that is provided, for example, in a rear weighted portion 72 of the sole 20. Such a design would aid in moving the center of gravity down and back, which improves the launch characteristics of an impacted ball. Unfortunately, in some circumstances a concentrated load of this nature may require a strengthened support structure between the weight and the strike face that may withstand the impact loading without catastrophically buckling. The further back, heavier, and more concentrated the mass becomes, the more structure and/or stiffer material would then be required to resist bucking of the intermediate portion of the club head.

Figure 41:
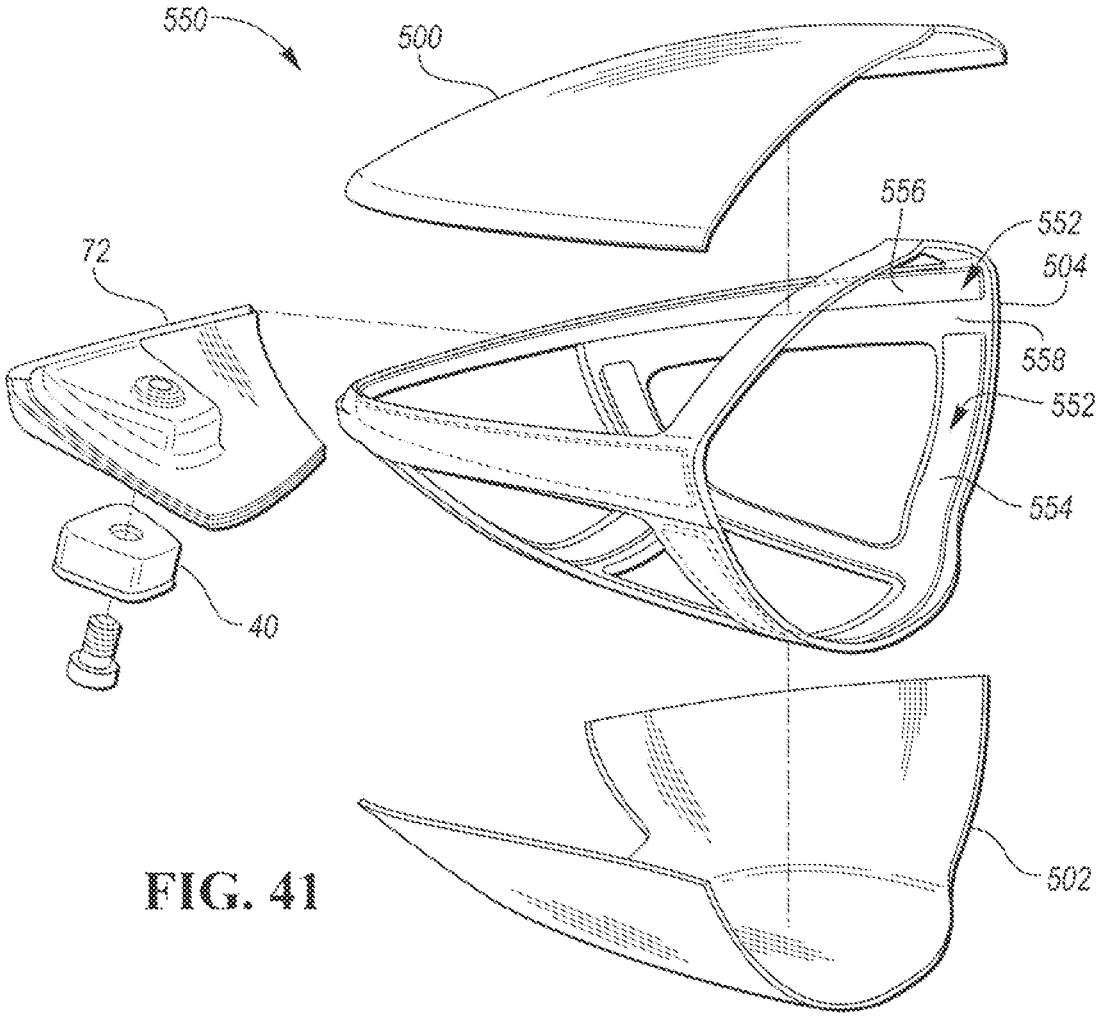
FIG. 41 is a schematic exploded perspective view of a thermoplastic composite rear body of a golf club head with an internal weighted skeleton.
Figure 42:
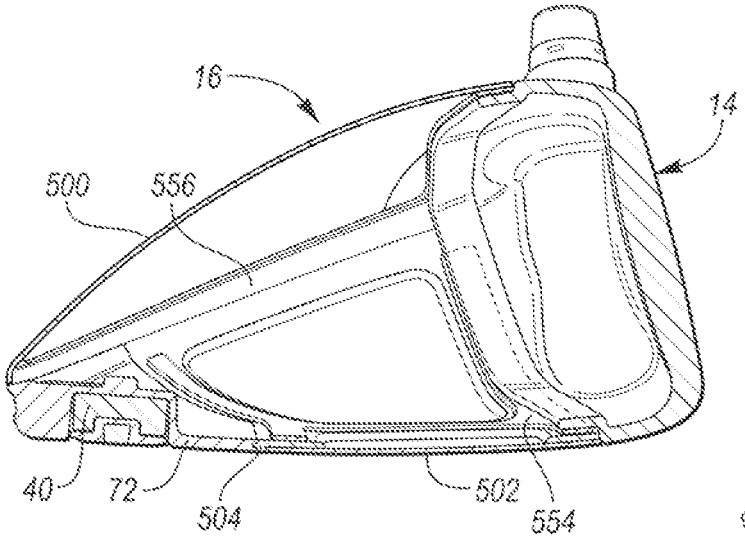
FIG. 42 is a schematic cross-sectional view of a thermoplastic composite rear body of a golf club head with an internal weighted skeleton, such as shown in FIG. 41.
Figure 43:
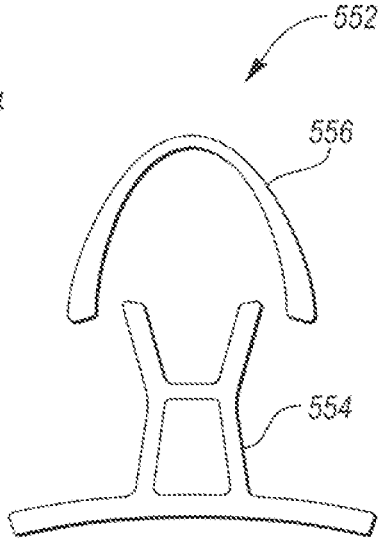
FIG. 43 is a schematic plan view of a lower cage and a perimeter band of a weighted skeleton, such as may be used with the golf club heads in FIG. 41 or 42.

FIGS. 41-42 schematically illustrate a design of the rear portion of a club head 550 that includes a weighted internal skeleton 552 that is operative to distribute weight in a structural manner while resisting impact buckling instead of encouraging it. As shown, in at least FIG. 43, the skeleton 552 includes a lower cage 554 and a perimeter band 556. In some embodiments, the lower cage 554 is distinct from the perimeter band 556 such that absent any intermediate polymer, the two components would be disconnected and separate (such as shown in FIG. 43). In some embodiments, the skeleton 552 may be formed from a metal material that is operative to alter the placement of the center of gravity. If formed from a metal material, the skeleton 552 may be adhered in place or overmolded (e.g., via insert injection molding).

In another embodiment, the skeleton 552 may be a thermoplastic composite that incorporates a metallic filler into a thermoplastic resin for at least one of the lower cage 554 and the perimeter band 556. This hybrid thermoplastic skeleton may then be bonded/fused to abutting thermoplastic structure 504, for example, on an inward-facing surface 558 of the structure 504. In such an embodiment, the metal filler may be from about 30% to about 90% by volume of the filled portion of the skeleton 552, alternatively, it may be from about 60% to about 80% by volume, or even about 65% to about 75% by volume of the filled portion of the skeleton 552. In some embodiments, the filled portion of the skeleton 552 may have a specific gravity of greater than about 8, or greater than about 9, or greater than about 10. In one particular embodiment the filled portion of the skeleton 552 may comprise a 70% tungsten filler in a 30% thermoplastic resin (by volume), and may have a specific gravity in the range of about 12.5 to about 14.0.

During manufacturing the skeleton 552 may be compression molded in contact with the structure 504, whereby each respective structure is heated to a temperature above the glass transition temperature of its respective resin. Upon cooling, the abutting parts may then be fused together.

In yet another embodiment, the supporting structure 504, itself, may include a metallic filler that is operative to reintroduce a portion of the available discretionary weight. In such an embodiment, at least a portion of the structure 504 may have specific gravity of greater than about 8, or greater than about 9, or greater than about 10, or in the range of about 12.5 to about 14.0.

Figure 44:
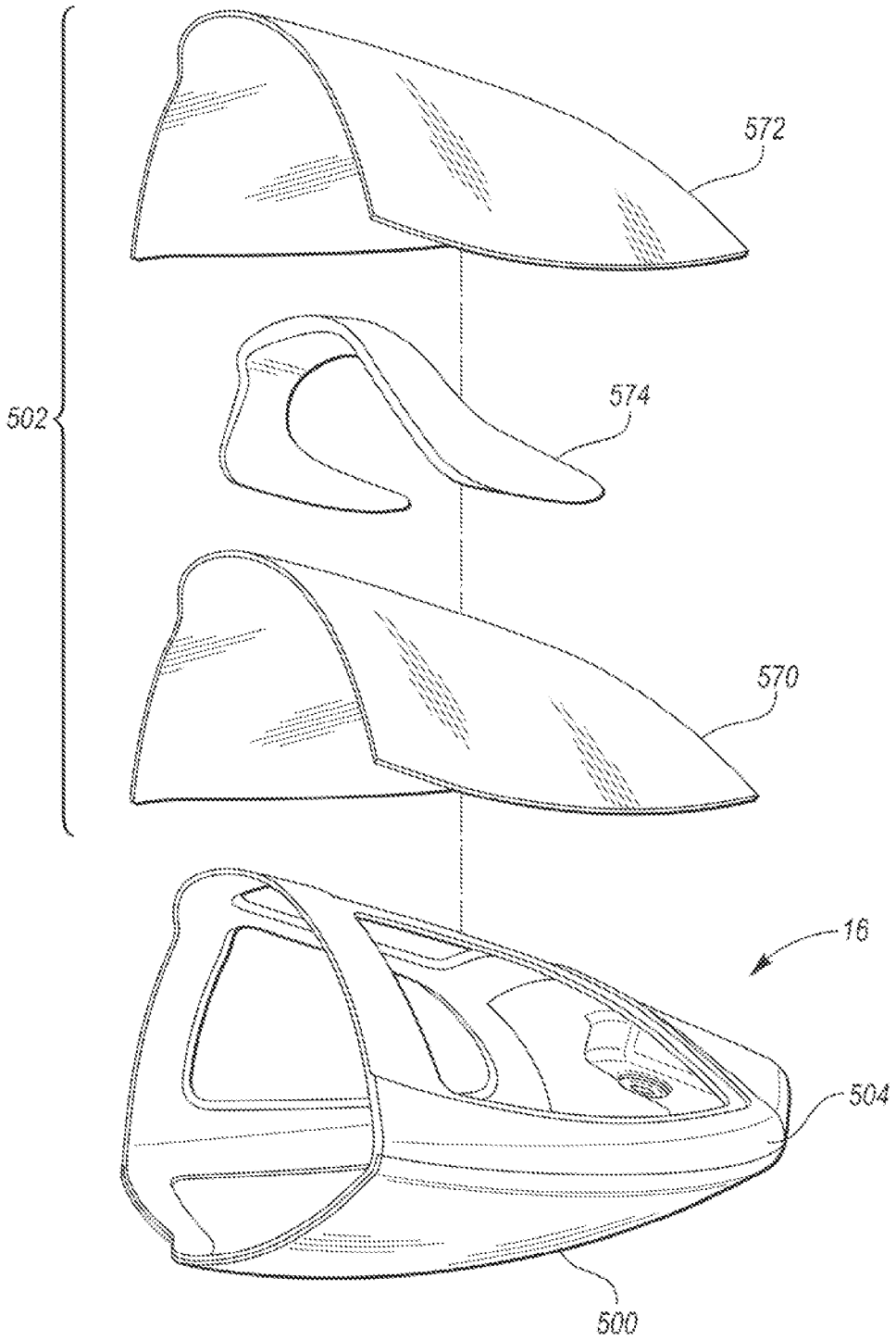
FIG. 44 is a schematic exploded perspective view of a thermoplastic composite rear body of a golf club head with a weighting member provided between laminate sheets of a fabric reinforced composite sole member.
Figure 45:
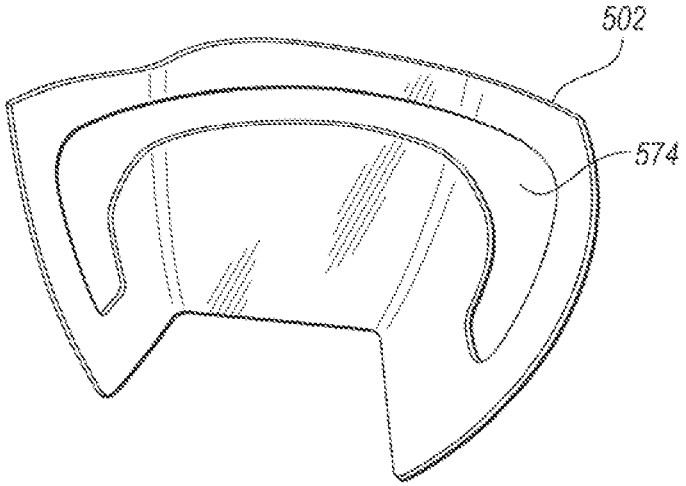
FIG. 45 is a schematic top view of a fabric reinforced composite sole member with an embodiment of an integrated weighting member.
Figure 46:
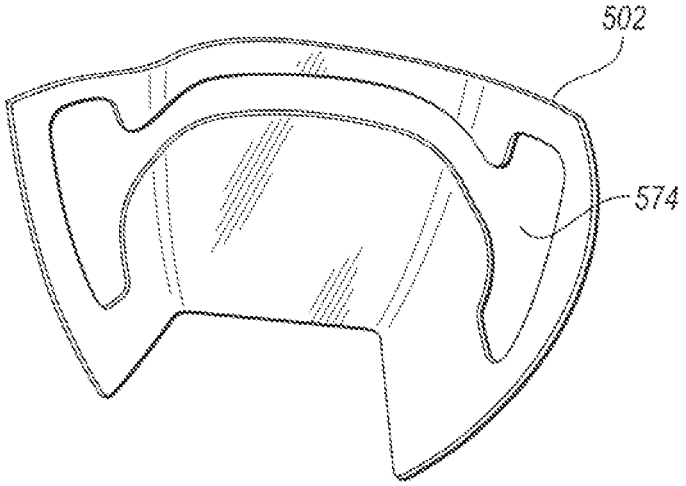
FIG. 46 is a schematic top view of a fabric reinforced composite sole member with an embodiment of an integrated weighting member.
Figure 47:
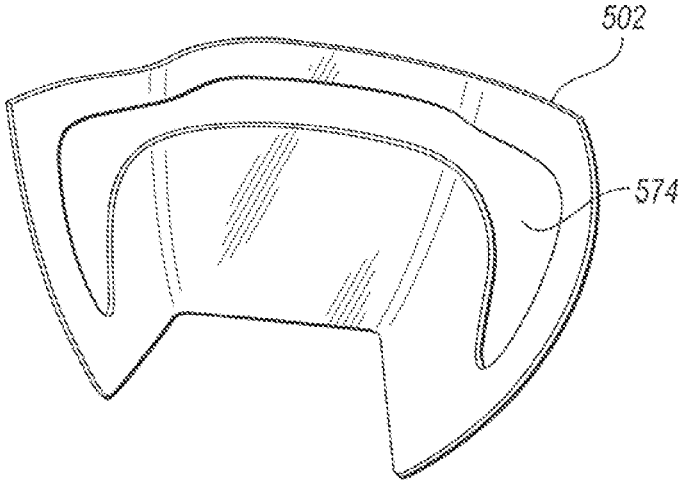
FIG. 47 is a schematic top view of a fabric reinforced composite sole member with an embodiment of an integrated weighting member.

FIG. 44 schematically illustrates an exploded view of an embodiment of the rear body 16 with the sole member 502 shown in an exploded view. In this embodiment, the sole member 502 may comprise a plurality of layers with at least two of the layers being thermoplastic composites. In particular, the embodiment shown in FIG. 44 includes an inner FRC sole layer 570, an outer FRC sole layer 572, and an intermediate weighting member 574 provided between the inner and outer FRC sole layers 570, 572. In this embodiment, the weighting member 574 may be either a metallic plate, or may be a FT composite with a metallic filler disposed within a thermoplastic resin (such as described above). FIGS. 45-47 then illustrate three different embodiments of an intermediate weighting member 574 that may be used with the multi-layered sole member 502.

Common to each of the presently disclosed designs is a desire to provide a golf club head that maximizes the total amount of discretionary mass, which may be employed to locate the center of gravity as close to the sole and rear of the club as is possible within stability constraints, while maximizing the moment of inertia toward the maximum limits allowable under U.S.G.A. regulations. To accomplish this desire, one or both of a forward body 14 or rear body 16 of the club head 10 is formed from a reinforced thermoplastic composite that has a lower specific gravity than typically used metals. It has been found, however, that accomplishing adequate durability with polymers that are less strong than metals requires an increase in the volume of material required thus offsetting at least a portion of the weight savings. The presently described embodiments utilize a design-based approach to reinforcing the polymeric structure in a way that attempts to minimize the amount of additional material that must be added. These designs incorporate selective reinforcement to guard against buckling within primary load paths, utilize aligned reinforcing fibers embedded within the thermoplastic to tune the anisotropic strengths of the thermoplastic composites to the dynamics of the structure, and/or utilize a mixed material thermoplastic laminate structure to leverage the design and material advantages of both filled thermoplastics and fabric reinforced composites in the same structure.

The present designs have realized net weight savings of up to about 60 to 100 grams. Absent any reintroduction of this weight, the club head would realize a dramatic reduction in both swing weight and moment of inertia. Reintroduction of the weight, however, posed separate challenges in how specifically to attach the weight to the structure, how to distribute the weight to avoid impact dynamics that may damage intermediate structure, and how to locate the weight to maximize moments of inertia while pushing the center of gravity as far down and back as possible. The presently described embodiments for re-weighting the club head each attempt to balance these objectives, for example, by placing weight forward to minimize impact stresses and maintaining a center of gravity forward of a critical point that could result in instability, by distributing the weight in a structural manner, such as using a skeleton or metal-doped reinforcing structure or by incorporating the weight into weighted and/or doped lamina layers within the outer shell of the club head. Incorporation of the weight into the structure, itself, is a design that is made possible largely through the use of thermoplastic resins, which can be used to form discrete layers having specific design properties, and then subsequently reforming the collection of layers into a collective laminate stack-up.

As discussed below, the designs described herein have proved to be successful in achieving the design objectives of a high moment of inertia club head with a center of gravity that is pushed down and back while still maintaining stability and durability.

General Mass Properties

Figure 48:
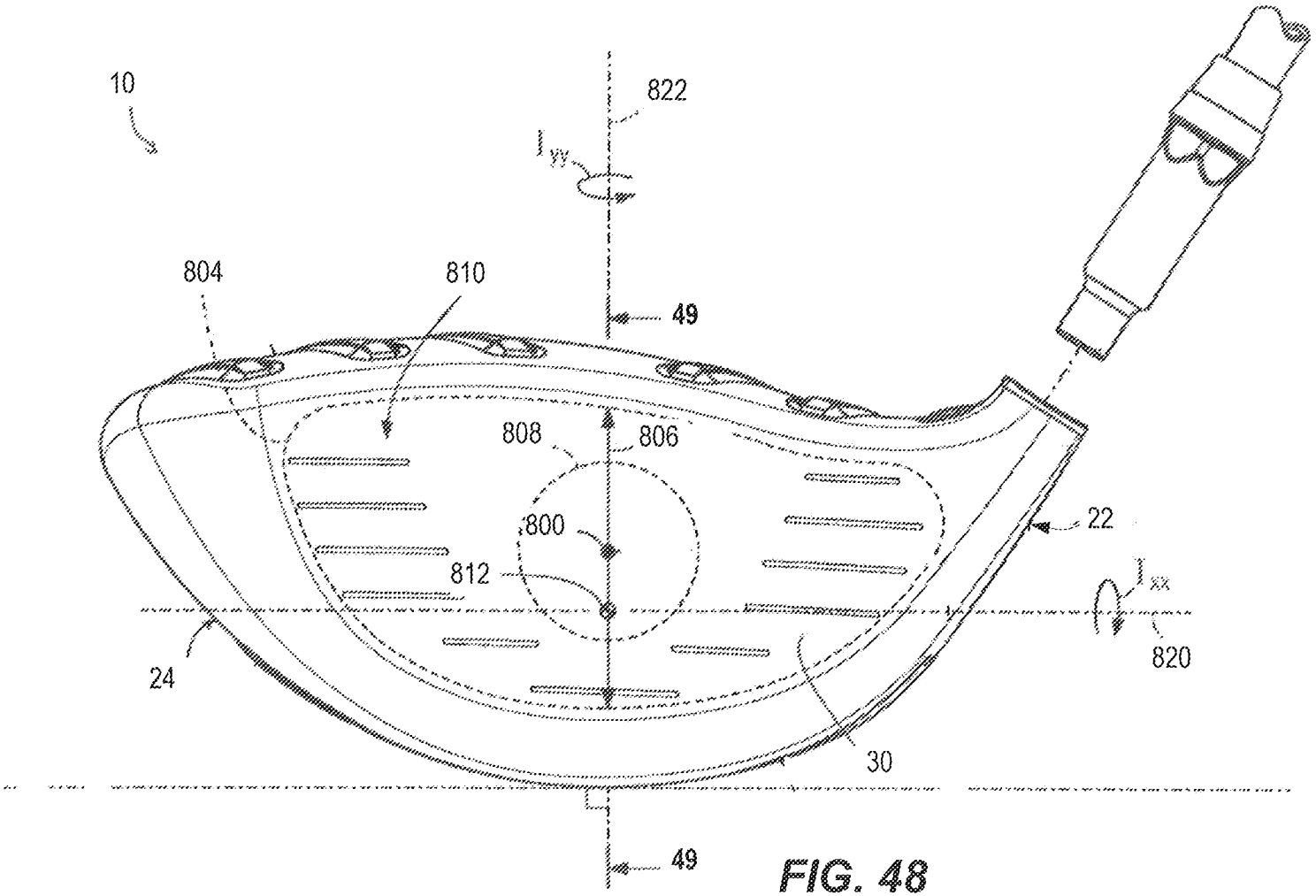
FIG. 48 is a schematic front view of a golf club head illustrating a club head center of gravity.
Figure 49:
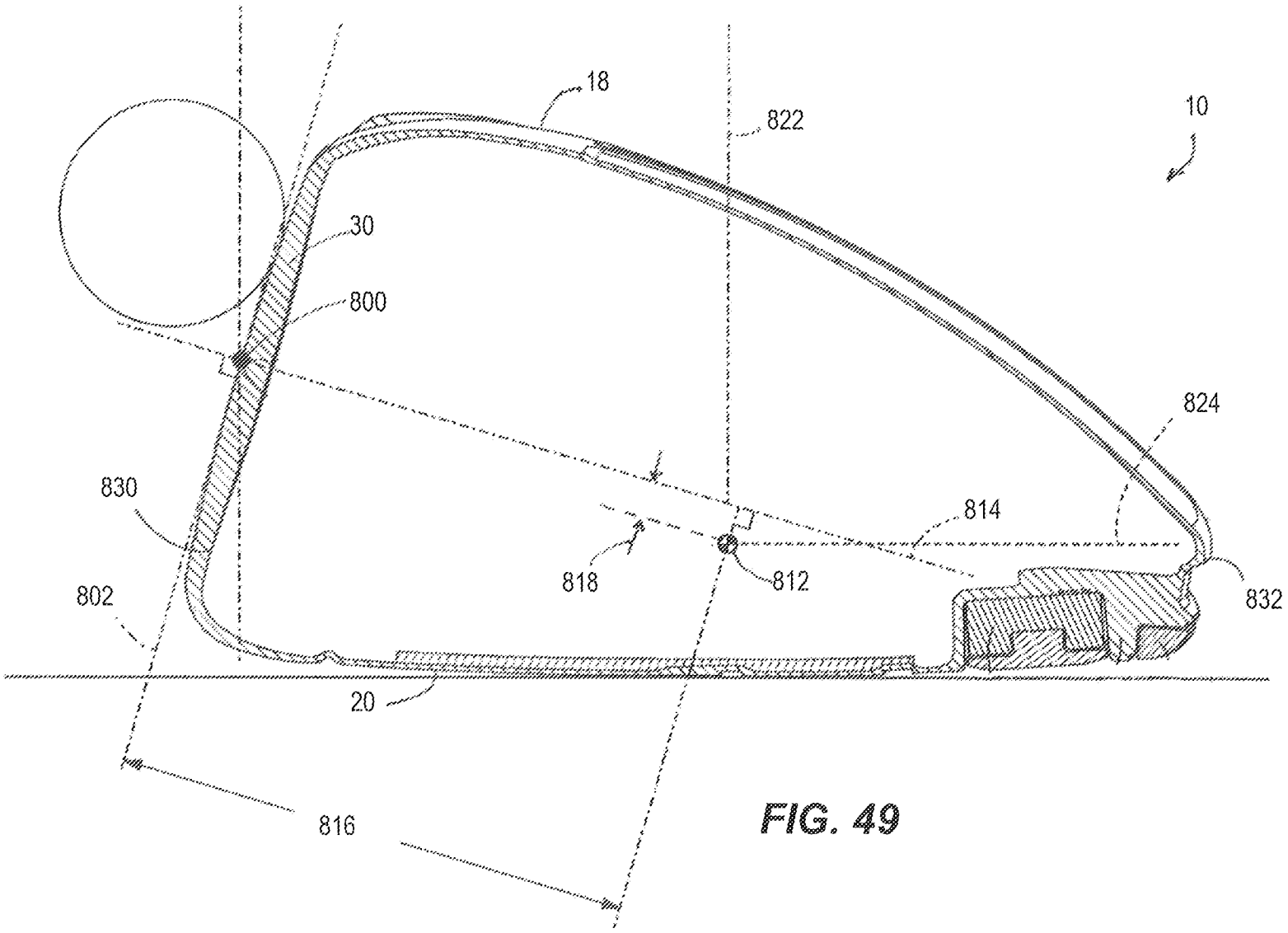
FIG. 49 is a schematic cross-sectional view of the golf club head of FIG. 48, taken along 49-49.

As generally illustrated in FIGS. 48-49, the strikeface 30 of the club head 10 defines a geometric center 800 and a loft plane 802 tangent to the geometric center 800 of the strikeface 30. In some embodiments, the geometric center 800 can be located at the geometric centerpoint of a strikeface perimeter 804, and at a midpoint of face height 806. In the same or other examples, the geometric center 800 also can be centered with respect to engineered impact zone 808, which can be defined by a region of grooves 810 on the strikeface. As another approach, the geometric center of the strikeface can be located in accordance with the definition of a golf governing body such as the United States Golf Association (USGA). For example, the geometric center of the strikeface can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The club head 10 further comprises a head center of gravity (CG) 812 and a head depth plane 814 extending through the geometric center 800 of the strikeface 30, perpendicular to the loft plane 802, in a direction from the heel 22 to the toe 24 of the club head 10. In many embodiments, the head CG 812 is located at a head CG depth 816 from the loft plane 802, measured in a direction perpendicular to the loft plane 802. The head CG 812 is further located at a head CG height 818 from the head depth plane 814, measured in a direction perpendicular to the head depth plane 814. In many embodiments, the head CG height 818 is positive when the head CG 812 is located above the head depth plane 814 (i.e. between the head depth plane 814 and the crown 18), and the head CG height 818 is negative with the head CG 812 is located below the head depth plane 814 (i.e. between the head depth plane 814 and the sole 20).

In many embodiments, the head CG height 818 can be less than 0.08 inches, less than 0.07 inches, less than 0.06 inches, less than 0.05 inches, less than 0.04 inches, less than 0.03 inches, less than 0.02 inches, less than 0.01 inches, or less than 0 inches (i.e. the head CG height can have a negative value, such that it is located below the head depth plane). Further, in many embodiments, the head CG height 818 can have an absolute value less than approximately 0.08 inches, less than approximately 0.07 inches, less than approximately 0.06 inches, less than approximately 0.05 inches, or less than approximately 0.04 inches. Further still, in many embodiments, the head CG depth 816 can be greater than approximately 1.7 inches, greater than approximately 1.8 inches, greater than approximately 1.9 inches, greater than approximately 2.0 inches, greater than approximately 2.1 inches, greater than approximately 2.2 inches, or greater than approximately 2.3 inches.

In many embodiments of the present designs, the head CG depth 816 and the head CG height 818 can be related by Relation 1 and/or Relation 2 below, with units measured in inches:

$$\text{Head } CG \text{ Depth} \geq \frac{\text{Head } CG \text{ Height} + 0.115}{0.10} \qquad \text{Relation 1}$$

$$\text{Head } CG \text{ Depth} \geq \frac{\text{Head } CG \text{ Height} + 0.14}{0.10} \qquad \text{Relation 2}$$

For the purpose of determining club head moments of inertia, a coordinate system may be defined at the CG 812 via mutually orthogonal axes (i.e., an x-axis 820, a y-axis 822, and a z-axis 824). The y-axis 822 extends through the head CG 812 from the crown 18 to the sole 22, perpendicular to a ground plane when the club head is at an address position. The x-axis 820 extends through the head CG 812 from the heel 22 to the toe 24 and perpendicular to the y-axis 822. The z-axis 824 extends through the head CG 812 from the front end 830 to the back end 832 and perpendicular to the x-axis 820 and the y-axis 822.

Moments of inertia then exist about the x-axis Ixx (i e crown-to-sole moment of inertia) and about the y-axis Iyy (i.e. heel-to-toe moment of inertia). In many embodiments, the crown-to-sole moment of inertia Ixx can be greater than approximately 3000 $gcm^2$, greater than approximately 3250 $gcm^2$, greater than approximately 3500 $g \cdot cm^2$, greater than approximately 3750 $g \cdot cm^2$, greater than approximately 4000 $g \cdot cm^2$, greater than approximately 4250 $gcm^2$, greater than approximately 4500 $gcm^2$, greater than approximately 4750 $gcm^2$, greater than approximately 5000 $g \cdot cm^2$, greater than approximately 5250 $g \cdot cm^2$, greater than approximately 5500 $g \cdot cm^2$, greater than approximately 5750 $g \cdot cm^2$, greater than approximately 6000 $g \cdot cm^2$, greater than approximately 6250 $g \cdot cm^2$, greater than approximately 6500 $g \cdot cm^2$, greater than approximately 6750 $g \cdot cm^2$, or greater than approximately 7000 $g \cdot cm^2$. Further, in many embodiments, the heel-to-toe moment of inertia Iyy can be greater than approximately 5000 $g \cdot cm^2$, greater than approximately 5250 $g \cdot cm^2$, greater than approximately 5500 $g \cdot cm^2$, greater than approximately 5750 $g \cdot cm^2$, greater than approximately 6000 $gcm^2$, greater than approximately 6250 $g \cdot cm^2$, greater than approximately 6500 $g \cdot cm^2$, greater than approximately 6750 $g \cdot cm^2$, or greater than approximately 7000 $g \cdot cm^2$.

In many embodiments, the club head comprises a combined moment of inertia (i.e. the sum of the crown-to-sole moment of inertia Ixx and the heel-to-toe moment of inertia Iyy) greater than 8000 $g \cdot cm^2$, greater than 8500 $g \cdot cm^2$, greater than 8750 $g \cdot cm^2$, greater than 9000 $g \cdot cm^2$, greater than 9250 $g \cdot cm^2$, greater than 9500 $g \cdot cm^2$, greater than 9750 $g \cdot cm^2$, greater than 10000 $g \cdot cm^2$, greater than 10250 $g \cdot cm^2$, greater than 10500 $g \cdot cm^2$, greater than 10750 $g \cdot cm^2$, greater than 11000 $g \cdot cm^2$, greater than 11250 $g \cdot cm^2$, greater than 11500 $g \cdot cm^2$, greater than 11750 $g \cdot cm^2$, or greater than 12000 $g \cdot cm^2$, greater than 12500 $g \cdot cm^2$, greater than 13000 $g \cdot cm^2$, greater than 13500 $g \cdot cm^2$, or greater than 14000 $g \cdot cm^2$.

Table 1, below numerically illustrates the mass parameters for eight different club heads. Specifically, the table shows the CG depth 816, CG height 818, moment of inertia Ixx about the horizontal x-axis 820, and moment of inertia Iyy about the y-axis 822.

TABLE 1

Mass properties of various driver head designs.

| Club | CG Depth (in) | CG Height (in) | Ixx ($g \cdot cm^2$) | Iyy ($g \cdot cm^2$) |
|---|---|---|---|---|
| Metal 1 | 1.716 | 0.111 | 3802.1 | 5258.2 |
| Metal 2 | 1.721 | 0.086 | 3770.6 | 5382.6 |
| Metal 3 | 1.840 | 0.082 | 4312.3 | 5789.5 |
| Metal Face; Polymer Body | 1.780 | 0.140 | 3954.5 | 5292.0 |
| Polymer Face; Metal Body | 2.031 | 0.103 | 3892.4 | 5443.7 |
| All Polymer 1 | 2.015 | 0.038 | 3716.8 | 5499.0 |
| All Polymer 2 | 2.384 | 0.078 | 4725.2 | 5949.7 |
| All Polymer 3 | 2.416 | 0.005 | 5096.1 | 6103.2 |

Metal clubs 1-3 are all commercially available drivers having an all metal structural design (i.e., at least the crown, sole, and face). Metal 1 is a metal driver head with a full titanium structure, a volume of less than about 445 $cm^3$, and a rear backweight. Metal 2 is metal driver head with a full titanium structure, a volume of greater than or equal to 460 $cm^3$, and a rear backweight. Metal 3 is a metal driver head with a full titanium structure, a volume of in the range of about 450-457 $cm^3$, and a movable weighting system.

"Metal Face; Polymer Body" is a driver head of similar construction as is shown in FIGS. 1-3, with a titanium front body 14 and a rear body 16 that is substantially formed from a polymeric composite structure. Metallic weights are added into the rear weighted portion to provide a similar swing weight as the commercially available all-metal driver heads. "Polymer Face; Metal Body" is a driver head that includes a polymer front body 14, such as shown in FIGS. 11-13, which is affixed to an optimized titanium rear body 16 that is substantially similar to the titanium rear portions of Metal 1 or Metal 2.

Finally, "All Polymer 1" is a polymeric composite driver head that includes a polymeric front body 14, such as shown in FIGS. 11-13, mated with a polymeric rear body 16, such as shown in any or all of FIGS. 1-7, with weight being re-introduced in a moderately distributed manner including at least some discretionary weighting provided forward of the center of gravity. "All Polymer 2" builds on the design of "All Polymer 1" by moving discretionary mass rearward in the form of an 80 gram tungsten weight placed in the furthest practical location at the rear of the club and as close to the sole as possible. Finally, "All Polymer 3" is a theoretical model that replaces the 80 gram weight of "All Polymer 2" with an 80 gram point mass placed at the rearmost point of the club head and as close to the sole as possible.

Figure 50:
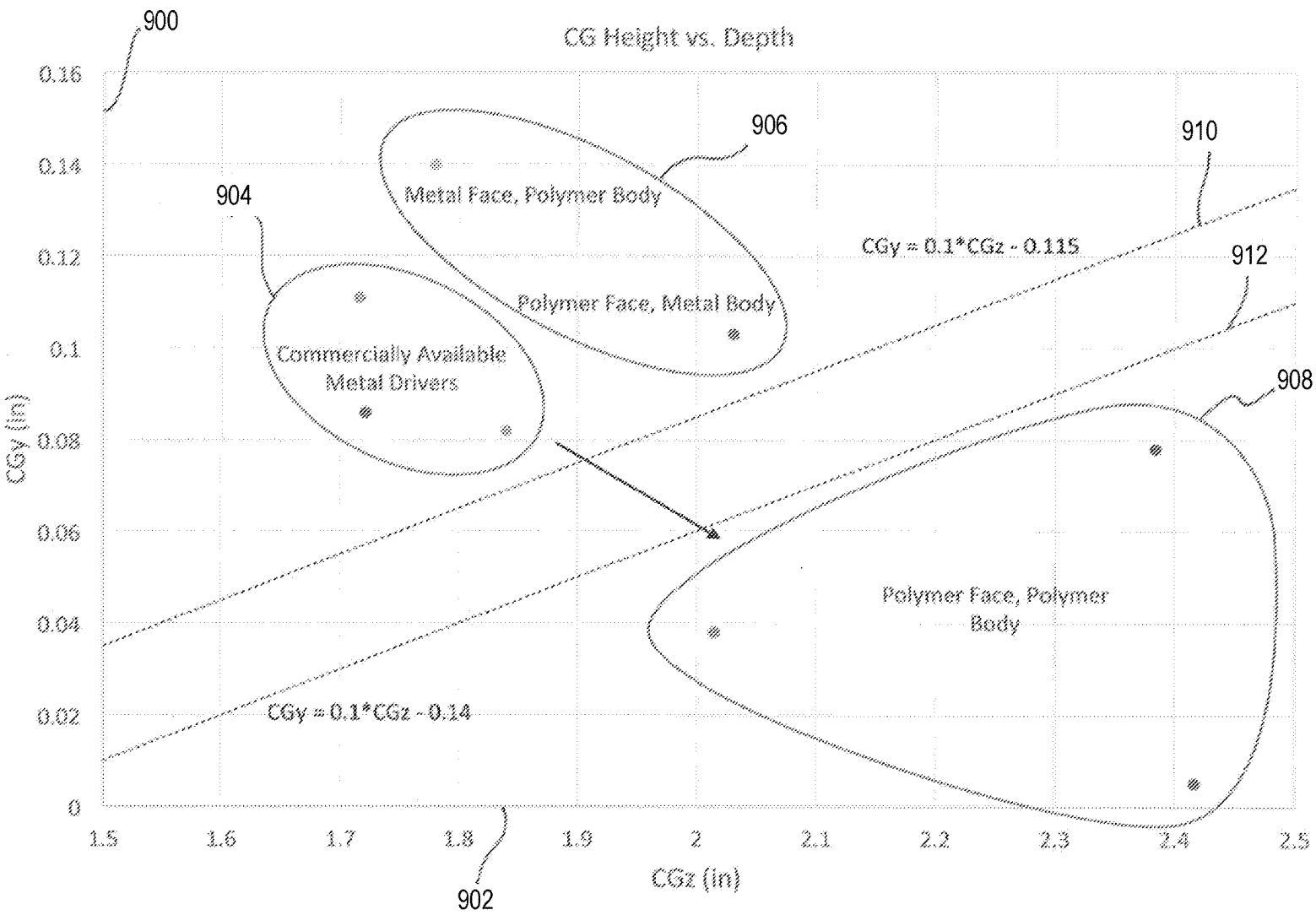
FIG. 50 is a plot of the center of gravity heights vs depths for various golf club head constructions.

FIG. 50 graphically represents the CG location, with the vertical axis 900 representing CGy (CG height 818) and the horizontal axis 902 representing CGz (CG depth 816) for each of the club head embodiment identified in Table 1. FIG. 50 further groups the various models into three categories: a first group 904 consisting of commercially available, all-metal drivers (i.e., Metal 1, Metal 2, and Metal 3); a second group 906 consisting of designs where a portion of the club head has been converted to a polymeric composite (i.e., "Metal Face; Polymer Body" and "Polymer Face; Metal Body"); and the third grouping 908 consists of designs where the entire structure has been converted to a polymeric construction (i.e., All Polymer 1, All Polymer 2, and All Polymer 3). FIG. 50 further illustrates the two relations discussed above ("Relation 1" 910 and "Relation 2" 912).

FIG. 50 demonstrates graphically, that a CG shift both lower and deeper (relative to the commercial, all-metal designs) is realized only by moving entirely to an all-polymer structure. As shown, the use of a partial polymer structure in the present designs can actually result in a higher CG, which can work against an ideal ball flight and reduce total distance. Furthermore, referring again to Table 1, these all-polymer designs (particularly where there is little or no forward discretionary mass, such as in All Polymer 2 and 3), may result in very substantial increases in the club head moments of inertia. For example, the "All Polymer 2" design, which has an 80 gram tungsten weight in the rear, provides a 19% gain in Ixx over an average Ixx from the all-metal designs, and provides a 9% gain in Iyy over the average Iyy from the all-metal designs. For comparison sake, it should be noted that each design provided in Table 1 has approximately the same mass (+/−about 3 grams).

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus, methods, and articles of manufacture described herein may be applicable to other types of golf club such as a driver wood-type golf club, a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosures are set forth in the following clauses.

Clause 1: A golf club head comprising: a rear body including a crown member and a sole member coupled to the crown member; a front body coupled to the rear body to define a substantially hollow structure, the front body including a strike face and a surrounding frame that extends rearward from a perimeter of the strike face;

wherein: at least a portion of an outer wall of the club head comprises a thermoplastic composite having a plurality of lamina layers; the plurality of lamina layers include at least a fabric reinforced thermoplastic composite layer and a filled thermoplastic layer;

and the fabric reinforced thermoplastic composite layer and the filled thermoplastic layer are directly bonded to each other without an intermediate adhesive.

Clause 2: The golf club head of clause 1, wherein the filled thermoplastic layer has a variable thickness.

Clause 3: The golf club head of clause 1, wherein the fabric reinforced thermoplastic composite layer comprises a multi- or uni-directional fabric embedded within a first thermoplastic resin; and wherein the filled thermoplastic layer comprises a plurality of discontinuous fibers embedded within a second thermoplastic resin.

Clause 4: The golf club head of clause 3, wherein the first thermoplastic resin and the second thermoplastic resin each comprise a common thermoplastic resin component.

Clause 5: The golf club head of clause 3, wherein the fabric reinforced thermoplastic composite layer comprises the first thermoplastic resin in an amount of less than about 45% by volume; and wherein the filled thermoplastic layer comprises the second thermoplastic resin in an amount of greater than about 45% by volume.

Clause 6: The golf club head of clause 1, wherein the fabric reinforced thermoplastic composite layer forms an outer surface of the club head.

Clause 7: The golf club head of clause 1, wherein at least one of the plurality of lamina layers includes an aperture extending through a thickness of the lamina layer.

Clause 8: The golf club head of clause 7, wherein at least two or more of the plurality of lamina layers includes an aperture extending through a thickness of the lamina layer.

Clause 9: The golf club head of clause 1, wherein the filled thermoplastic layer includes a weighted portion having a metallic mass embedded therein.

Clause 10: The golf club head of clause 8, wherein the metallic mass is a metallic filler embedded within a thermoplastic resin of the filled thermoplastic layer.

Clause 11: The golf club head of clause 1, wherein the outer wall forms at least a portion of one of the crown member, sole member, or strike face.

Clause 12: The golf club head of clause 1, wherein the outer wall includes the strike face.

Clause 13: The golf club head of clause 12, wherein the fabric reinforced thermoplastic composite layer forms an outward facing ball striking surface.

Clause 14: The golf club head of clause 12, wherein the filled thermoplastic layer forms an outward facing ball striking surface.

Clause 15: The golf club head of clause 12, wherein, between a center of the strike face and a hosel, greater than about 50% of an embedded fiber content within the filled thermoplastic layer is aligned within 30 degrees of a face axis extending between a toe portion of the strike face and a heel portion of the strike face and parallel to a ground plane when the club head is held at a neutral address position on the ground plane.

Clause 16: The golf club head of clause 12, wherein the fabric reinforced thermoplastic composite layer forms at least a portion of the frame.

Clause 17: The golf club head of clause 12, wherein the strike face includes a flow leader portion that extends outward from a rear surface of the strike face between a toe portion of the strike face and a center of the strike face.

Clause 18: The golf club head of clause 1, wherein the plurality of lamina layers includes a plurality of unidirectional fabric reinforced thermoplastic composite layers, each fabric reinforced thermoplastic composite layer having a fiber orientation that is different from at least one directly abutting fabric reinforced thermoplastic composite layer.

Clause 19: The golf club head of clause 1, wherein the filled thermoplastic layer includes a metallic mesh embedded therein, and wherein a resin of the filled thermoplastic layer extends within a plurality of apertures defined by the mesh.

Clause 20: The golf club head of clause 1, wherein each of the front body and the rear body comprise a thermoplastic resin; and wherein the thermoplastic resin of the front body is fused to the thermoplastic resin of the rear body without an intermediate adhesive.

Clause 21: A method of manufacturing a golf club head comprising: compression molding a fabric reinforced thermoplastic composite layer into a pre-defined shape corresponding to a surface of a golf club head; inserting the compression molded fabric reinforced thermoplastic composite layer into a mold; thermally fusing a filled thermoplastic to the fabric reinforced thermoplastic composite layer by heating each of the fabric reinforced thermoplastic composite layer and the filled thermoplastic to a temperature above a glass transition temperature of a thermoplastic resin of each layer;

wherein the fabric reinforced thermoplastic composite layer has a common thermoplastic resin as the filled thermoplastic.

Clause 22: The method of clause 21, wherein the predefined shape is an outer surface of a golf club head.

Clause 23: The method of clause 22, wherein the predefined shape is a sole.

Clause 24: The method of clause 22, wherein the predefined shape is a convex cup.

Clause 25: The method of clause 21, wherein the predefined shape is an inner surface of a golf club head.

Clause 26: The method of clause 21, further comprising injecting the filled thermoplastic into the mold.

Clause 27: The method of clause 26, wherein the injecting is performed such that zero knit lines form within the filled thermoplastic layer.

Clause 28: The method of clause 26, further comprising inserting at least one metallic weight into the mold prior to injecting the filled thermoplastic into the mold.

Clause 29: The method of clause 21, further comprising: compression molding a plurality of fabric reinforced thermoplastic composite layers, each into a pre-defined shape corresponding to a surface of a golf club head, and each comprising a unidirectional fabric embedded in a thermoplastic resin, wherein each unidirectional fabric has a discrete fiber orientation; inserting the compression molded fabric reinforced thermoplastic composite layers into a mold in a nested, abutting arrangement; thermally fusing each of the fabric reinforced thermoplastic composite layers to abutting fabric reinforced thermoplastic composite layers by heating the mold to a temperature above a glass transition temperature of the thermoplastic resin of each respective layer.

Clause 30: The method of clause 29, wherein each layer of the plurality of fabric reinforced thermoplastic composite layers directly abuts at least one other layer having a different fiber orientation.

The invention claimed is:

1. A golf club head comprising:

a rear body including a crown member and a sole member coupled to the crown member;

a front body coupled to the rear body to define a substantially hollow structure, the front body including a strike face and a surrounding frame that extends rearward from a perimeter of the strike face;

wherein:

the front body of the golf club head comprises a thermoplastic composite having a plurality of lamina layers;

the plurality of lamina layers includes at least a fabric reinforced thermoplastic composite outer layer and a filled thermoplastic inner layer;

wherein:

the filled thermoplastic inner layer forms a rear surface of the strike face;

the filled thermoplastic inner layer includes a channel extending around a perimeter of the rear surface of the strike face;

the fabric reinforced thermoplastic composite outer layer comprises a uniform thickness;

the fabric reinforced thermoplastic composite outer layer forms a portion of the crown member, a portion of the sole member, and the strike face; and the fabric reinforced thermoplastic composite outer layer and the filled thermoplastic inner layer are directly bonded to each other without an intermediate adhesive.

2. The golf club head of claim 1, wherein the filled thermoplastic inner layer has a variable thickness.

3. The golf club head of claim 1, wherein the channel extends continuously around the perimeter of the strike face.

4. The golf club head of claim 1, wherein the channel extends discontinuously around one or more portions of the perimeter of the strike face.

5. The golf club head of claim 1, wherein the channel extends along any portion of the rear surface of the strike face.

6. The golf club head of claim 1, wherein the channel comprises a rounded concave cross-sectional geometry.

7. The golf club head of claim 6, wherein the rounded concave cross-sectional geometry is circular, elliptical, square, rectangular, triangular, or a polygon.

8. The golf club head of claim 1, wherein the fabric reinforced thermoplastic composite outer layer comprises a multi-or uni-directional fabric embedded within a first thermoplastic resin; and wherein the filled thermoplastic inner layer comprises a plurality of discontinuous fibers embedded within a second thermoplastic resin.

9. The golf club head of claim 8, wherein the first thermoplastic resin and the second thermoplastic resin each comprises a common thermoplastic resin component.

10. The golf club head of claim 8, wherein the fabric reinforced thermoplastic composite outer layer comprises the first thermoplastic resin in an amount of less than about 45% by volume; and wherein the filled thermoplastic inner layer comprises the second thermoplastic resin in an amount of greater than about 45% by volume.

11. The golf club head of claim 1, wherein the fabric reinforced thermoplastic composite outer layer forms an outer surface of the club head.

12. The golf club head of claim 1, wherein at least one of the plurality of lamina layers includes an aperture extending through a thickness of the lamina layers.

13. The golf club head of claim 12, wherein at least two or more of the plurality of lamina layers includes an aperture extending through a thickness of the lamina layer.

14. The golf club head of claim 1, wherein the filled thermoplastic inner layer forms an outward facing ball striking surface.

15. The golf club head of claim 1, wherein, between a center of the strike face and a hosel, greater than about 50% of an embedded fiber content within the filled thermoplastic inner layer is aligned within 30 degrees of a face axis extending between a toe portion of the strike face and a heel portion of the strike face and parallel to a ground plane when the club head is held at a neutral address position on the ground plane.

16. The golf club head of claim 1, wherein the fabric reinforced thermoplastic composite outer layer forms at least a portion of the surrounding frame.

17. The golf club head of claim 1, wherein the plurality of lamina layers includes a plurality of unidirectional fabric reinforced thermoplastic composite layers, each unidirectional fabric reinforced thermoplastic composite layer having a fiber orientation that is different from at least one directly abutting fabric reinforced thermoplastic composite layer.

18. A golf club head comprising:

a rear body including a crown member and a sole member coupled to the crown member;

a front body coupled to the rear body to define a substantially hollow structure, the front body including a strike face and a surrounding frame that extends rearward from a perimeter of the strike face;

wherein:

at least a portion of an outer wall of the golf club head comprises a thermoplastic composite having a plurality of lamina layers;

the plurality of lamina layers include at least a fabric reinforced thermoplastic composite layer and a filled thermoplastic inner layer;

wherein:

the filled thermoplastic inner layer includes a channel extending around a perimeter of the strike face; and the fabric reinforced thermoplastic composite layer and the filled thermoplastic inner layer are directly bonded to each other without an intermediate adhesive;

wherein the outer wall includes the strike face; and wherein the strike face includes a flow leader portion that extends outward from a rear surface of the strike face between a toe portion of the strike face and a center of the strike face.

* * * * *